United States Patent [19]

Ogawa

[11] Patent Number: 4,895,794

[45] Date of Patent: Jan. 23, 1990

[54] SILVER HALIDE EMULSIONS HAVING HOST CRYSTALS WITH GUEST CRYSTALS FORMED IN PROJECTION THEREON AND PHOTOGRAPHIC MATERIALS CONTAINING SUCH EMULSIONS

[75] Inventor: Tadashi Ogawa, Kanagawa, Japan

[73] Assignee: Fuji Photo Film Co., Ltd., Kanagawa, Japan

[21] Appl. No.: 82,252

[22] Filed: Aug. 5, 1987

[30] Foreign Application Priority Data

Aug. 5, 1986 [JP] Japan ..... 61-183918

[51] Int. Cl.[4] ..... G03C 1/02; G03C 1/28; G03C 7/32

[52] U.S. Cl. ..... 430/567; 430/505; 430/542; 430/570; 430/571; 430/576; 430/577

[58] Field of Search ..... 430/567, 542, 570, 571, 430/575, 576, 577

[56] References Cited

U.S. PATENT DOCUMENTS

| | | | |
|---|---|---|---|
| 4,094,684 | 6/1978 | Maskasky | 430/567 |
| 4,142,900 | 3/1979 | Maskasky | 430/567 |
| 4,400,463 | 8/1983 | Maskasky | 430/567 |
| 4,471,050 | 9/1984 | Maskasky | 430/567 |
| 4,496,652 | 1/1985 | Haugh et al. | 430/567 |
| 4,683,192 | 7/1987 | Nishiyama | 430/567 |
| 4,684,607 | 8/1987 | Maskasky | 430/567 |
| 4,692,401 | 9/1987 | House | 430/567 |

FOREIGN PATENT DOCUMENTS

| | | | |
|---|---|---|---|
| 0199290 | 10/1986 | European Pat. Off. | 430/567 |
| 2007040 | 1/1987 | Japan | 430/567 |

*Primary Examiner*—Mukund J. Shah, PhD

[57] ABSTRACT

Disclosed is a novel silver halide emulsion containing silver chloride-containing crystal grains which are cubic or rectangular parallelepiped silver halide crystals containing 30 mol % or more silver chloride on the crystal surface and surrounded mainly by (100) crystal faces, where the silver halide crystal has a projection of another crystal part formed on at least one (100) surface of the six crystal faces thereof and starting from the (100) surface has a bottom surface, the projection crystal part has substantially the same halogen composition as that of the surface of the (100) face of the original cubic or rectangular parallelepiped silver halide crystal grain, and the adjacent projection crystal parts have a groove part therebetween which is parallel to the edge part of the original silver halide crystal grain. The projection crystal parts on the silver chloride-containing crystal grains in the emulsion are preferably formed in the presence of a crystal habit-controlling agent selected from the group consisting of a nucleic acid or decomposition products thereof, a mercaptotetrazole compound, a mercaptothiadiazole compound, a hydroxyazaindene compound, a dicarbocyanine compound and a merocyanine compound.

Also disclosed is a silver halide photographic material having at least one light-sensitive layer which contains the silver halide emulsion having the above-mentioned silver halide crystal grains having one or more of the projection crystals parts on a support. The material preferably has a coupler capable of forming a dye by a coupling reaction with an oxidation product of an aromatic primary amine color developing agent in the light-sensitive layer.

15 Claims, 27 Drawing Sheets

SILVER HALIDE EMULSIONS HAVING HOST CRYSTALS WITH GUEST CRYSTALS FORMED IN PROJECTION THEREON AND PHOTOGRAPHIC MATERIALS CONTAINING SUCH EMULSIONS

FIELD OF THE INVENTION

The present invention relates to silver halide emulsions and photographic light-sensitive materials containing the emulsions in the light-sensitive layer. More precisely, it relates to emulsions containing silver halide crystal grains with various novel shapes and silver halide photographic materials using the same and, specifically, silver halide photographic materials which are almost free from fog and which have excellent gradation and development processability.

BACKGROUND OF THE INVENTION

As silver halides for photographic light-sensitive materials, crystals of silver iodide, silver bromide or silver chloride and mixed crystals thereof are known and as the shapes of the silver halide crystal grains in an emulsion which contains the grains as precipitated and formed in a protective colloid, various kinds of crystal shapes are known including so-called regular grains such as cubic, tetradecahedral, octahedral or rhombic dodecahedral grains and irregular grains such as tabular grains or the like and also spherical and other amorphous grains whose crystal faces could hardly be specified by their appearances. Further, other crystal grains having a multiphase structure or junction structure inside the grain are known. The shapes of the silver halide crystal grains, as well as the halogen compositions and the structures thereof, would largely determine various properties of the grains and additionally would be important factors for determining the characteristics of silver halide photographic light-sensitive materials using the emulsions containing the crystal grains.

Silver halide emulsions form grains of different shapes depending upon their halogen compositions or upon the conditions under which the crystal grains are formed. For instance, E. Moisar and E. Klein reported in *Berichte der Bunsengesellschaft fur Physikalische Chemie,* 67, 949 (1963) that cubic, tetradecahedral or octadecahedral silver halide grains could be obtained by what is known as a double jet method where the excess amount of bromide ion is kept at a low value or at a high value during the addition of the silver salt and the halide salt in the formation of the grains. In addition, C. R. Berry, S. J. Marino and C. F. Oster reported in *Photographic Science and Engineering,* 5, 332 (1961) that similar crystal grains could be obtained by controlling the Ag value in the presence of ammonia. They further reported that the elevation of the pAg value in the absence of ammonia resulted in the formation of tabular grains with twin planes. Moreover, there are a number of reports in literature other than the above, mentioning so-called multiphase twin crystal grains having double phase or more multiphase twin planes. For instance, D. C. Skillman and C. R. Berry reported multiphase twin crystal grains in *Photographic Science and Engineering,* 6, 159 (1962) and ibid., 8, 65 (1964).

It is well known that silver iodobromide grains having silver iodide in some degree can also be formed almost in the same manner as the formation of the above-mentioned silver bromide grains. In addition, it is further known that silver chlorobromide grains having silver chloride can also be formed almost in the same manner, provided that the content of the silver chloride is not as high as the content of silver iodide in the above-mentioned silver iodobromide grains.

The same does not always hold, however, when the content of the silver chloride is high. It is difficult, for example, to form octahedral grains of silver chloride by regulation of the silver ion concentration. On the contrary, it is known that silver chloride or silver chlorobromide having a large content of silver chloride would often form cubic grains. However, some silver chloride or silver chlorobromide grains are known to be able to have some other shapes than cubic shape. For instance, West German Patent Publication No. 2,222,297 illustrates silver chloride or silver chlorobromide grains with a (110) crystal face or rhombic dodecahedral crystal grains. F. H. Claes, J. Libeer and W. Vanassche in *The Journal of Photographic Science,* 21, 39 (1973) report the formation of silver chloride crystals of rhombic dodecahedral grains with a (110) crystal face or of octahedral grains with a (111) crystal face by the use of various kinds of modifying agents. U.S. Pat. Nos. 4,399,215, 4,400,463 and 4,414,306 illustrate tabular grains with a (111) main crystal face of silver chloride or silver chlorobromide having a relatively high content of silver chloride. U.S. Pat. No. 4,386,156 illustrates tabular grains with a (100) main crystal face. Many of these silver halide crystals having various shapes, but not all of them are actually used in silver halide photographic materials in the form of an emulsion containing the grains singly or in the form of a mixture of different grains. It is well known that the silver halide crystal grains as contained in the emulsion of photographic materials display the characteristic features of the crystal grains themselves which are derived from the halogen compositions and the shapes thereof in the photographic materials.

However, these silver halide emulsions do not always fully satisfy any and every necessary property. Accordingly, improvements for higher sensitivity, better gradation, more excellent storage preservation and processing preservation and more rapid processability are always strived for, and various studies for improvements are being continued. In particular, rapid processability is especially desired in these days, and development of silver halide crystal grains having a higher potential with respect to the above-mentioned points as well as development of chemical sensitization, or spectral sensitization of the crystal grains and, additionally, development of techniques for incorporating the crystal grains in photographic light-sensitive materials are becoming increasingly important. In order to obtain rapid processing, it is important to prevent any fog of silver chloride-containing emulsions and to obtain a stable and excellent gradation without deteriorating the development processability of the photographic materials.

SUMMARY OF THE INVENTION

Accordingly, the first object of the present invention is to provide emulsions containing novel silver halide crystal grains with rapid development processability.

The second object of the present invention is to provide silver halide photographic light-sensitive materials which are almost free from fog and which are excellent in gradation and development processability.

The third object of the present invention is to provide a technique for especially overcoming the disadvantages of silver halide emulsions having a relatively high content of silver chloride.

The fourth object of the present invention is to easily provide silver halide photographic light-sensitive materials containing an emulsion with a relatively high silver chloride content.

The objects of the present invention can be achieved by a silver halide emulsion comprising silver halide crystal grains containing silver chloride, wherein on at least one of six (100) surfaces of a cubic or rectangular parallelepiped host crystals surrounded mainly by (100) surfaces and containing 30 mol % or more silver chloride at the (100) surfaces of the host crystal, a guest silver halide crystal containing substantially the same halide composition as the (100) surfaces is formed in projection so that the bottom surface of the guest crystal is a part of the (100) surfaces of the host crystal and so that the intersections of the surfaces of the host crystal and the guest crystal form re-entrant angle parallel to the edges of the (100) surfaces of the host crystal.

According to the preferred embodiment of the present invention, the silver halide emulsion contains silver chloride in an amount of at least 30 mol of the total silver halide content.

According to another preferred embodiment of the present invention, the silver halide emulsion contains silver chloride in an amount of at least 50 mol % of the total silver halide content.

According to still another preferred embodiment of the present invention, the projection crystal is formed in the presence of a crystal habit controlling agent (so-called "growth modifier") during the formation of the silver halide crystals.

According to a more preferred embodiment of the present invention, the crystal habit controlling agent is selected from the group consisting of nucleic acid or decomposition products thereof, and mercaptotetrazole compounds, mercaptothiadiazole compounds, hydroxyazaindene compounds, dicarbocyanine compounds and merocyanine compounds.

According to still another preferred embodiment of the present invention, there is provided a silver halide photographic materials having at least one light-sensitive sensitive layer which contains the silver halide emulsion as mentioned above on a support.

According to a more preferred embodiment of the present invention, there is provided a silver halide photographic material having a coupler capable of forming a dye through a coupling reaction with an oxidation product of an aromatic primary amine color developing agent in the light-sensitive layer.

DESCRIPTION OF THE DRAWINGS

FIGS. 1 (*a*) and (*b*) show a case wherein a formed projection crystal is a rectangular parallelepiped.

FIGS. 1 (*c*) and (*d*) show a case where a formed projection crystal is a trapezoidalpiped wherein the bias face of the trapezoidalpiped portion with respect to the original cubic is substantially comprised of (111) faces. In fact, the formed crystal may have a (111) face or the projection crystal parts may be fairly roundish.

Figure 1A:
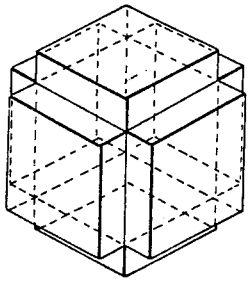
FIGS. 1 (*a*) to (*d*) show model drawings which represent typical shapes of the formed projection crystals of the present invention.
Figure 1B:
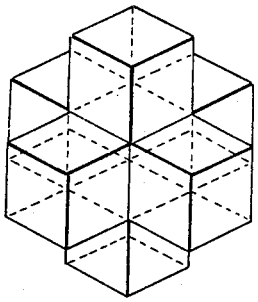
Figure 1C:
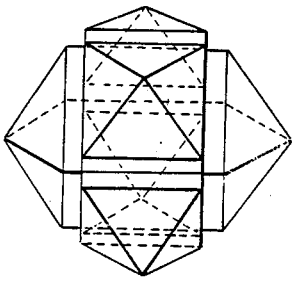
Figure 1D:
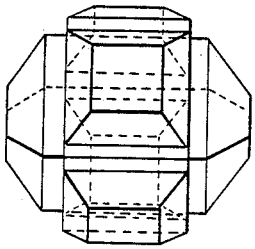
Figure 2:
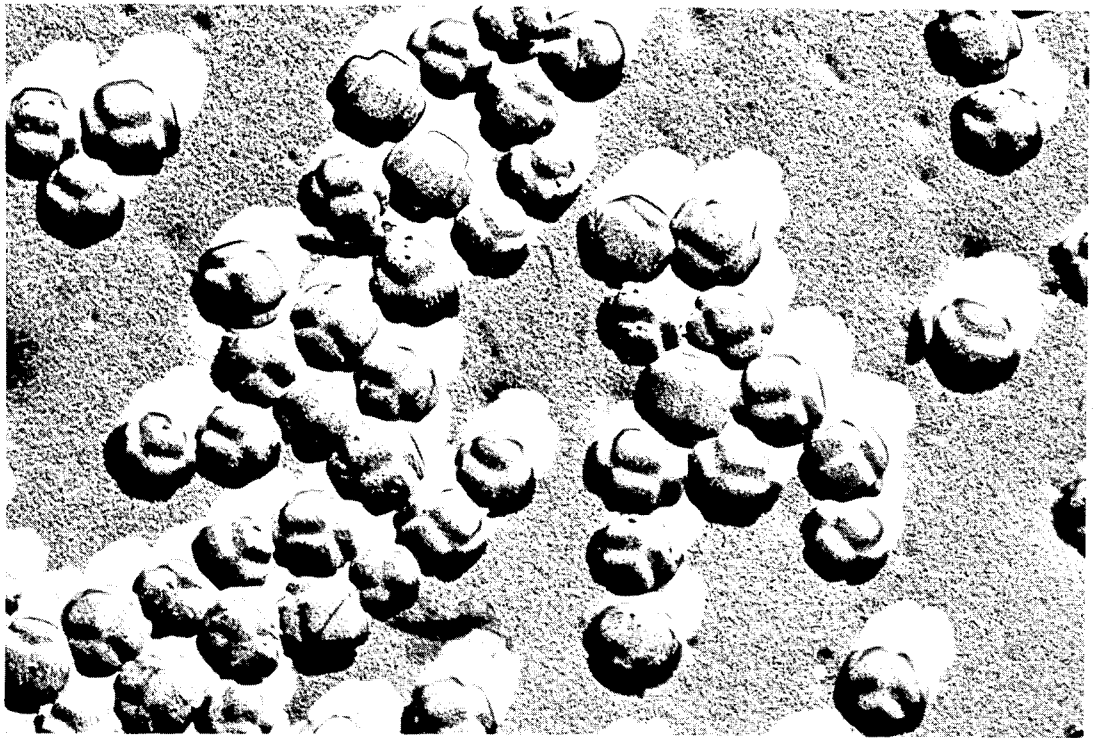
FIGS. 2 to 27 show electron microscope photographs (magnifying power: 30,000) of the silver halide crystals prepared in Examples of the present invention.
Figure 3:
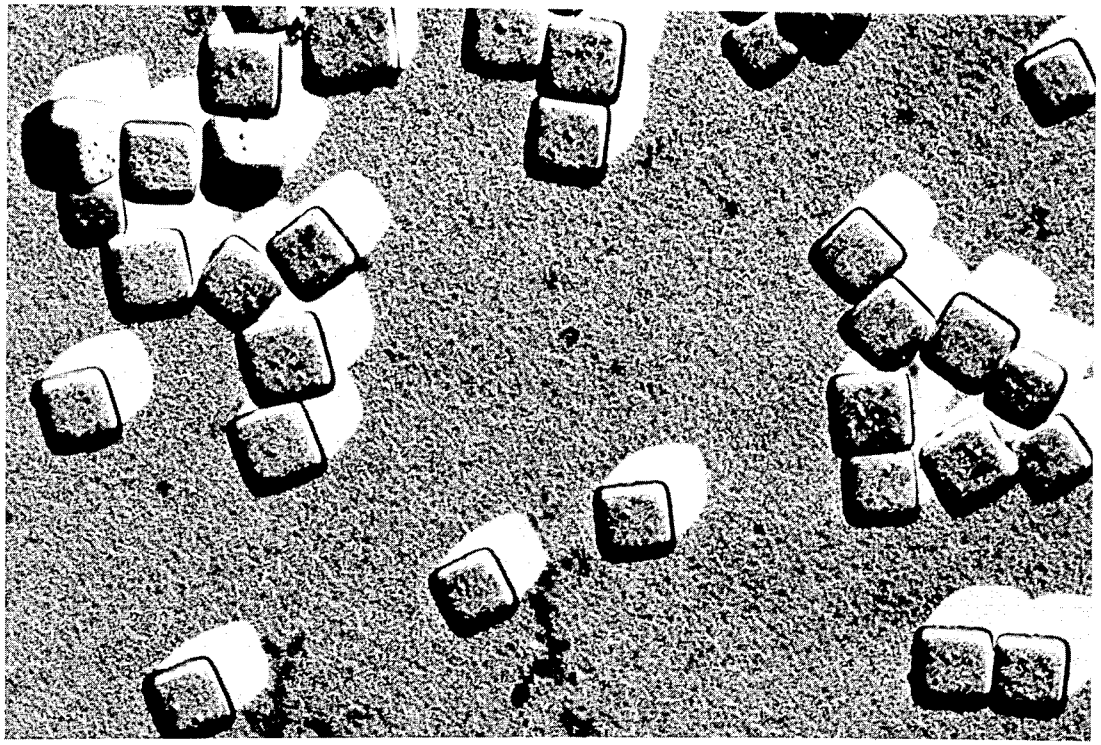
Figure 4:
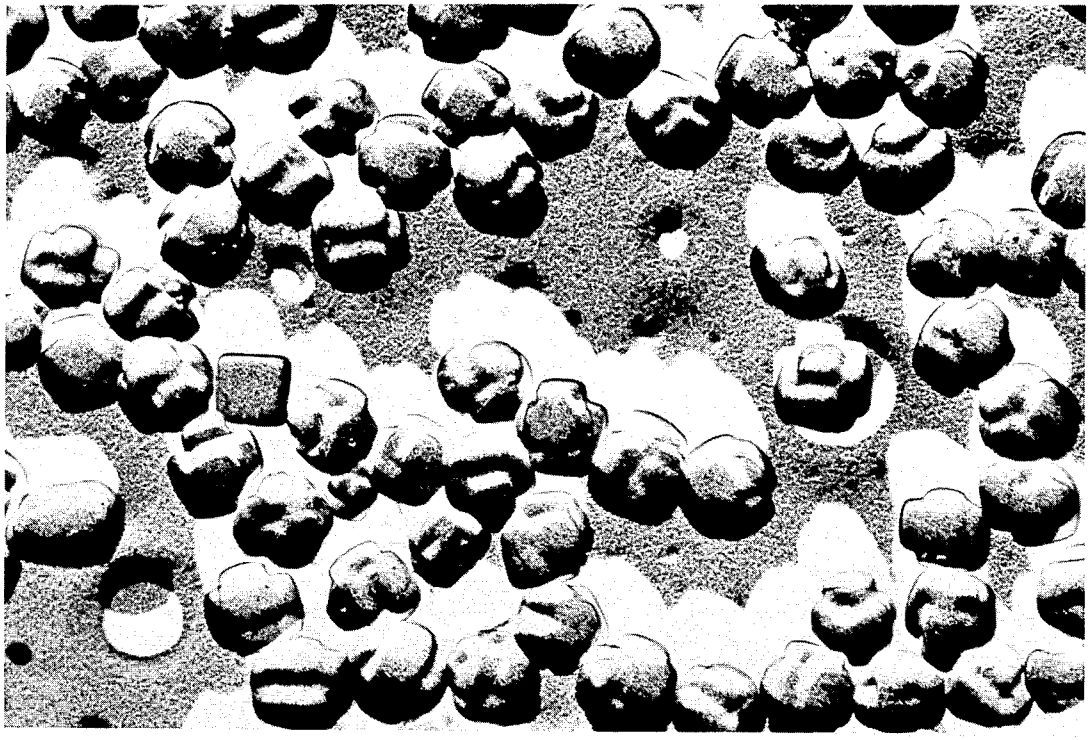
Figure 5:
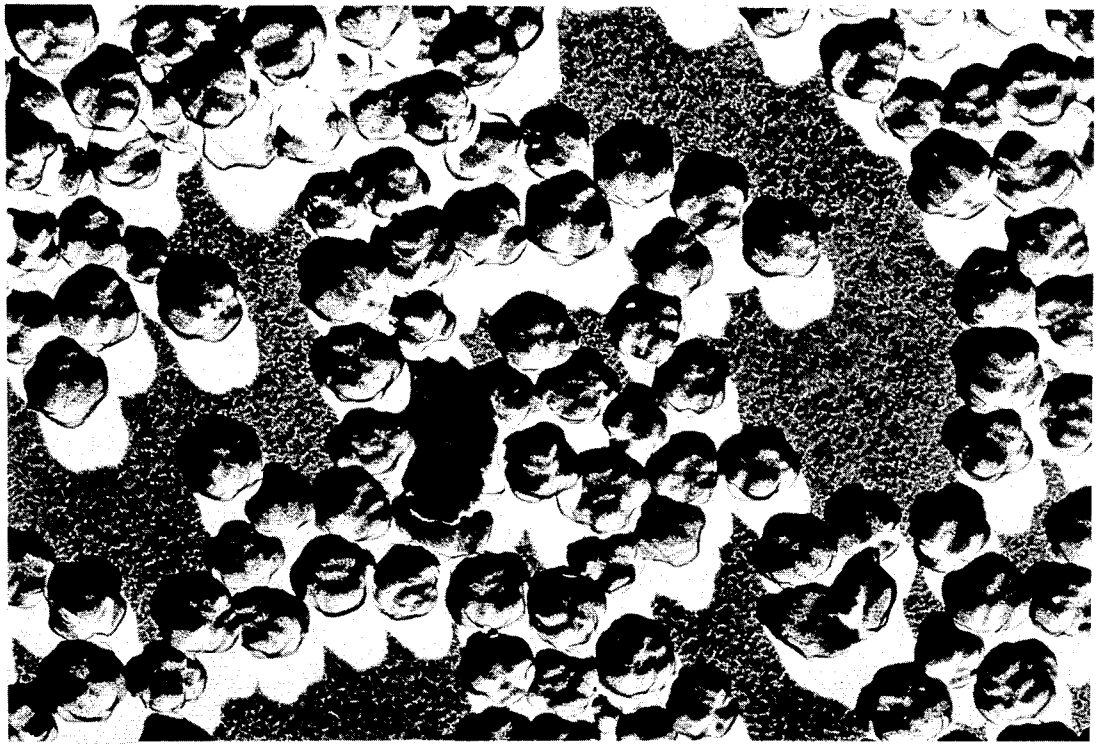
Figure 6:
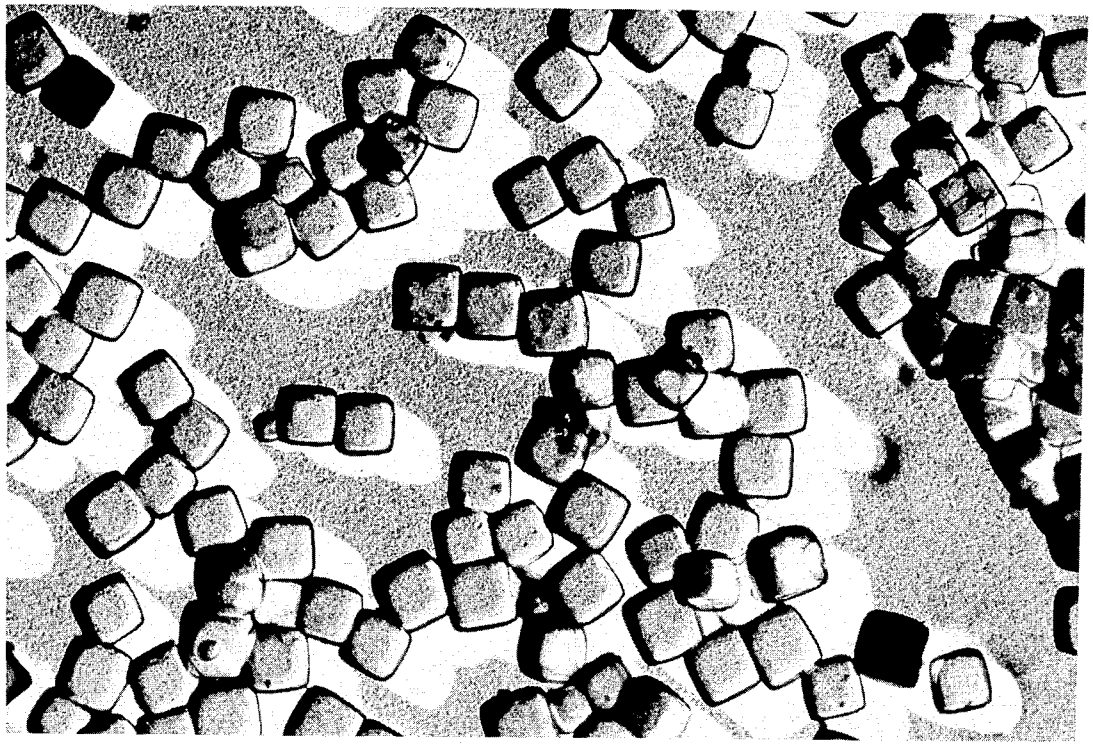
Figure 7:
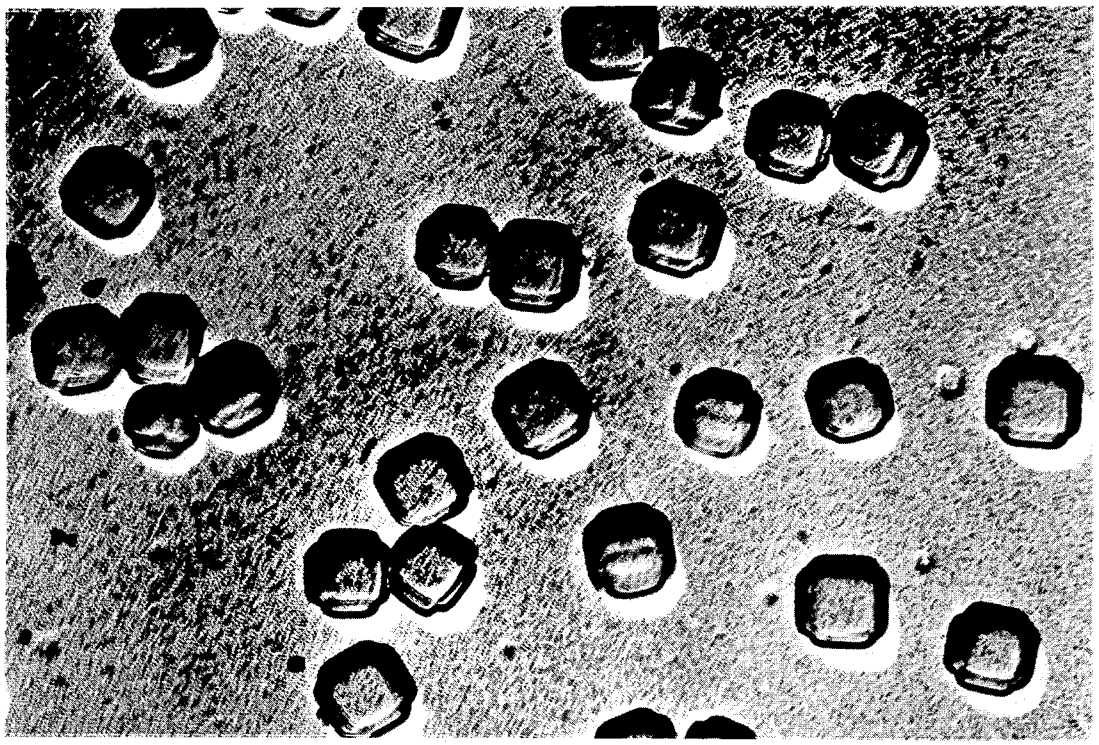
Figure 8:
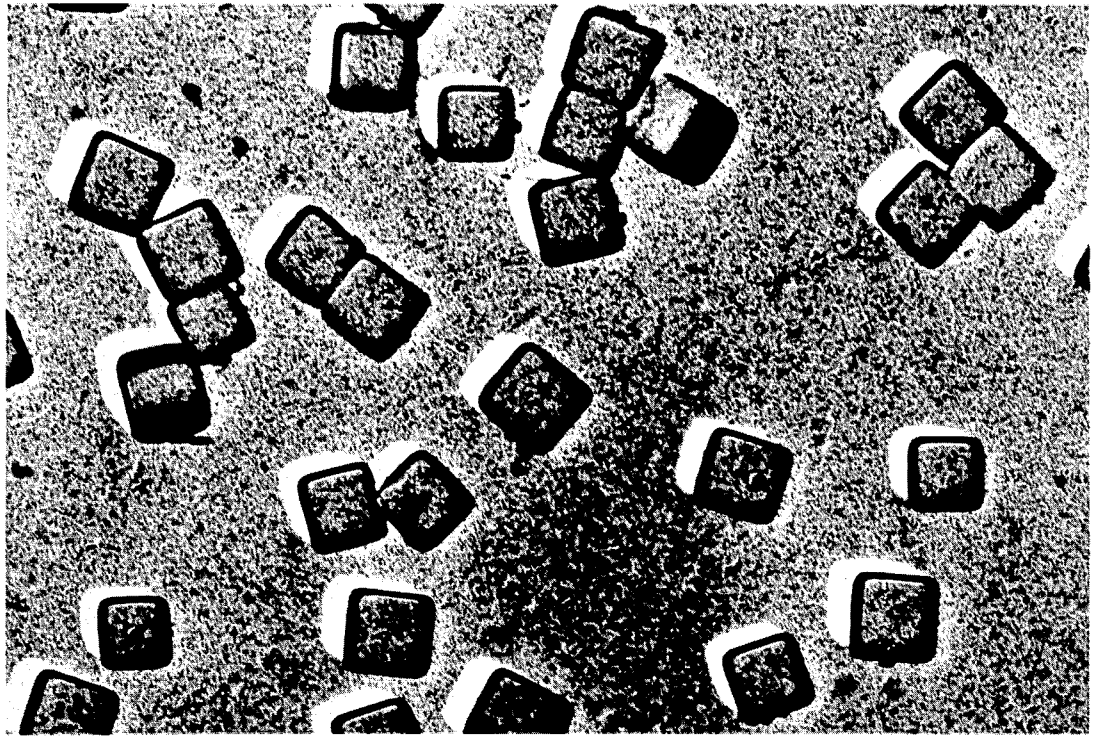
Figure 9:
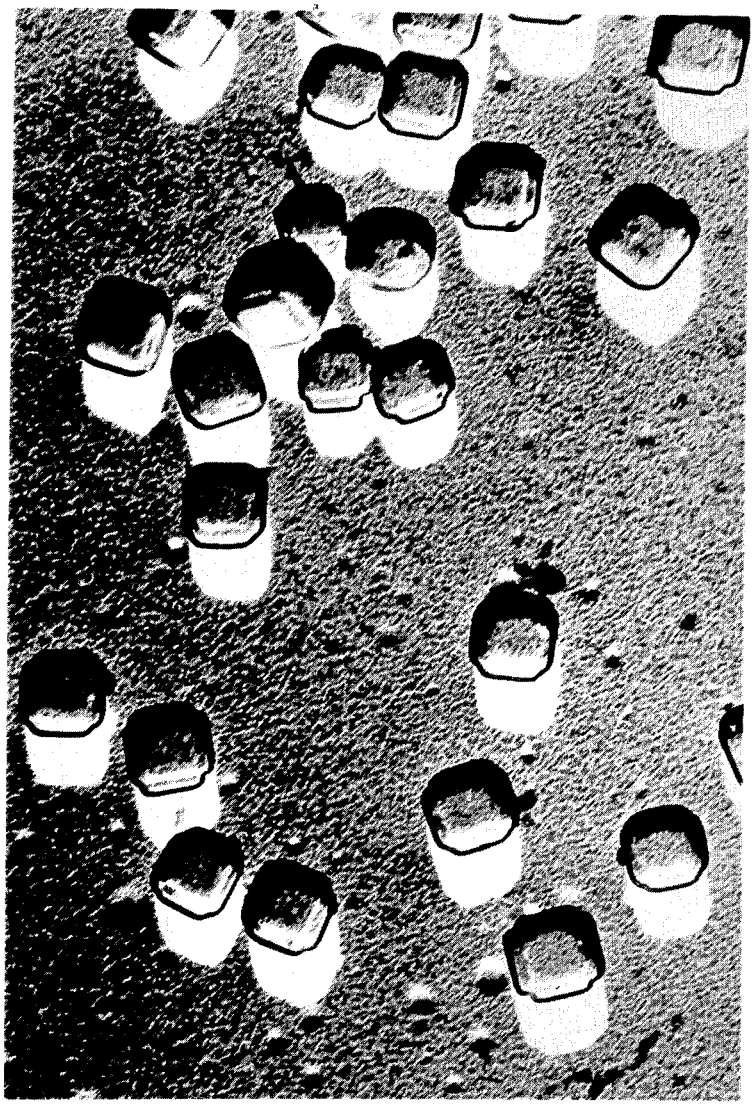
Figure 10:
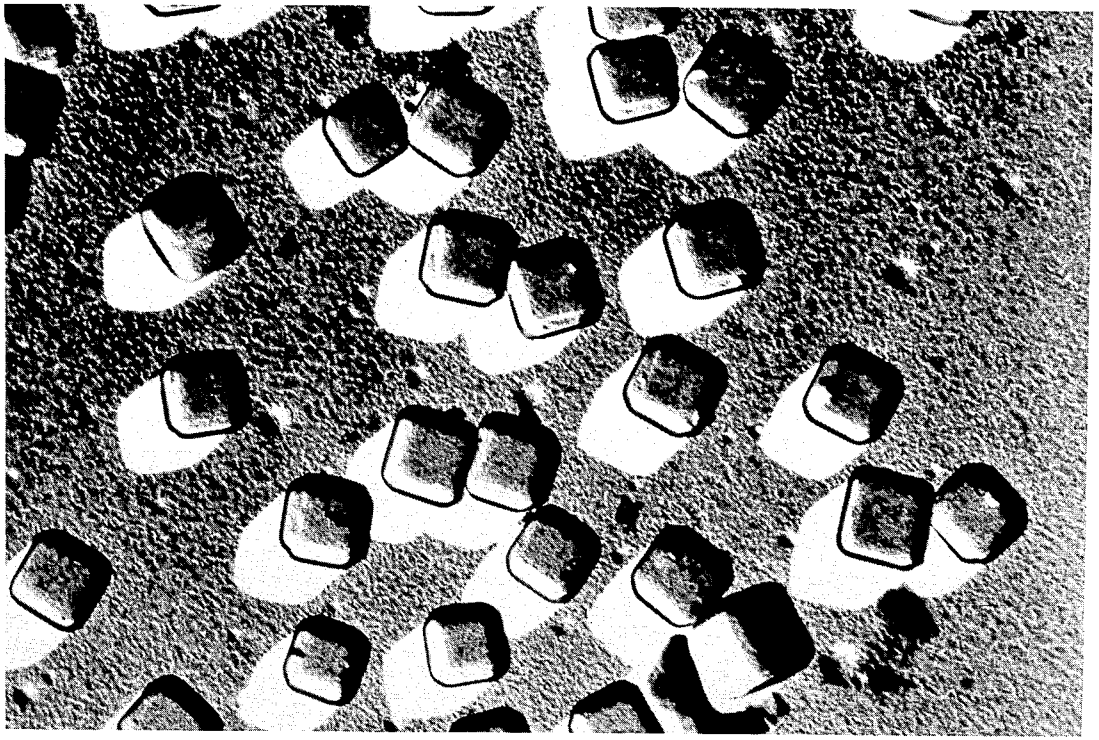
Figure 11:
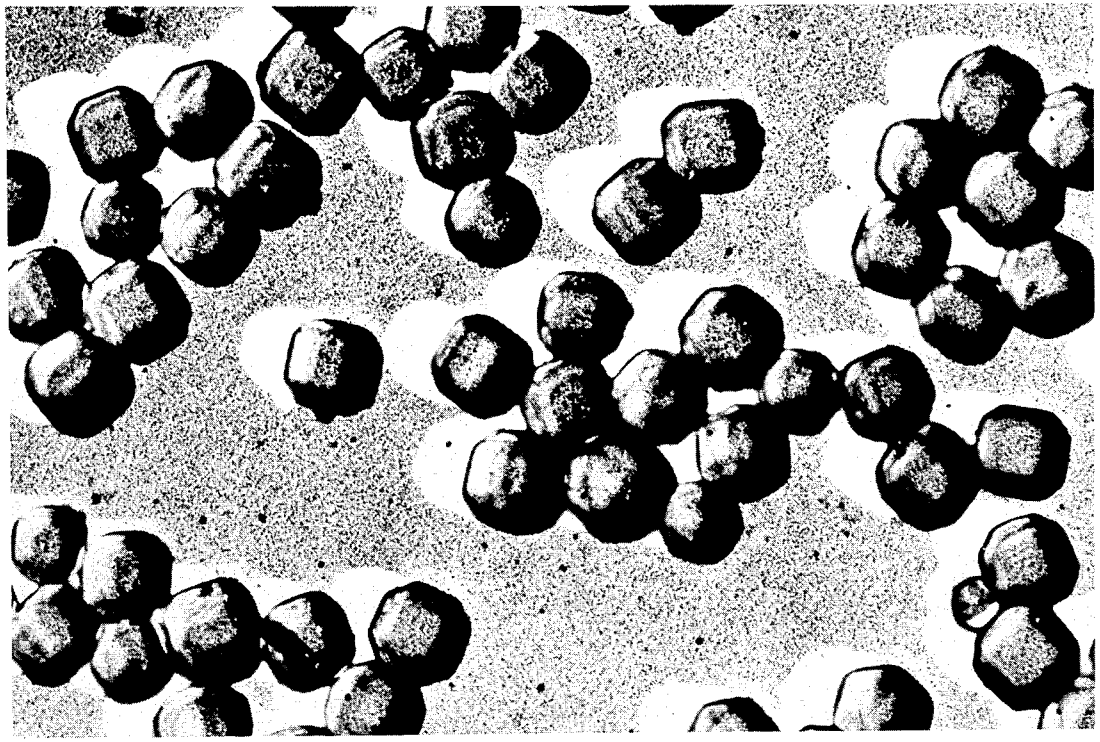
Figure 12:
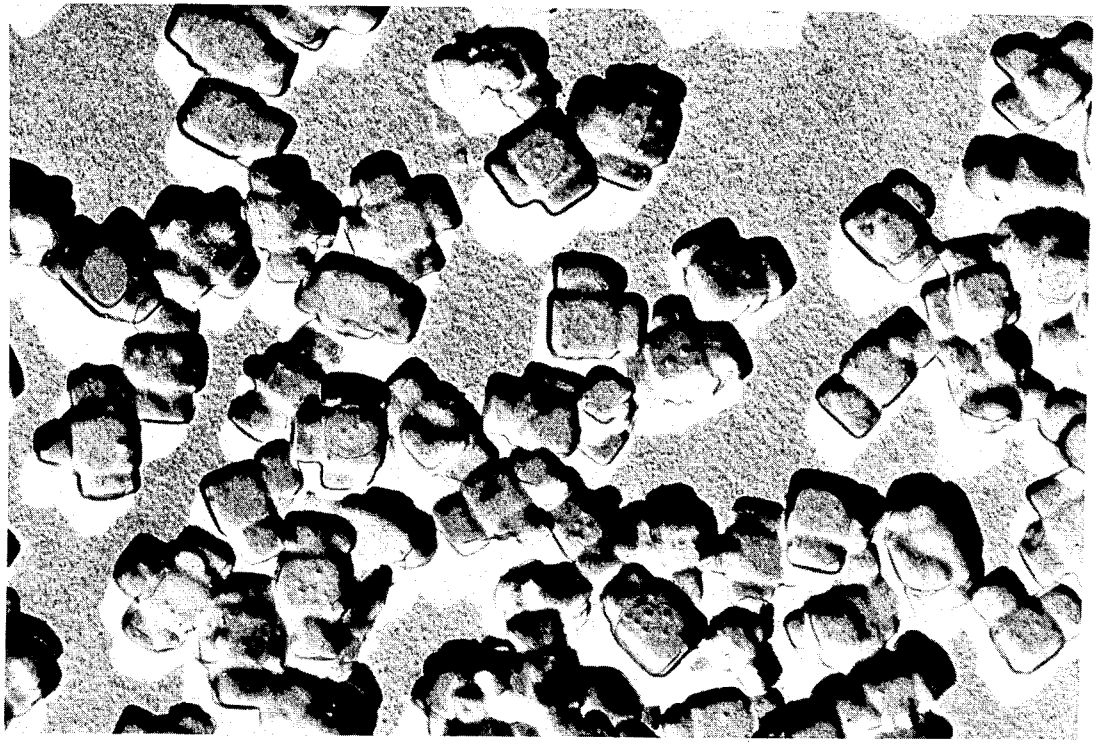
Figure 13:
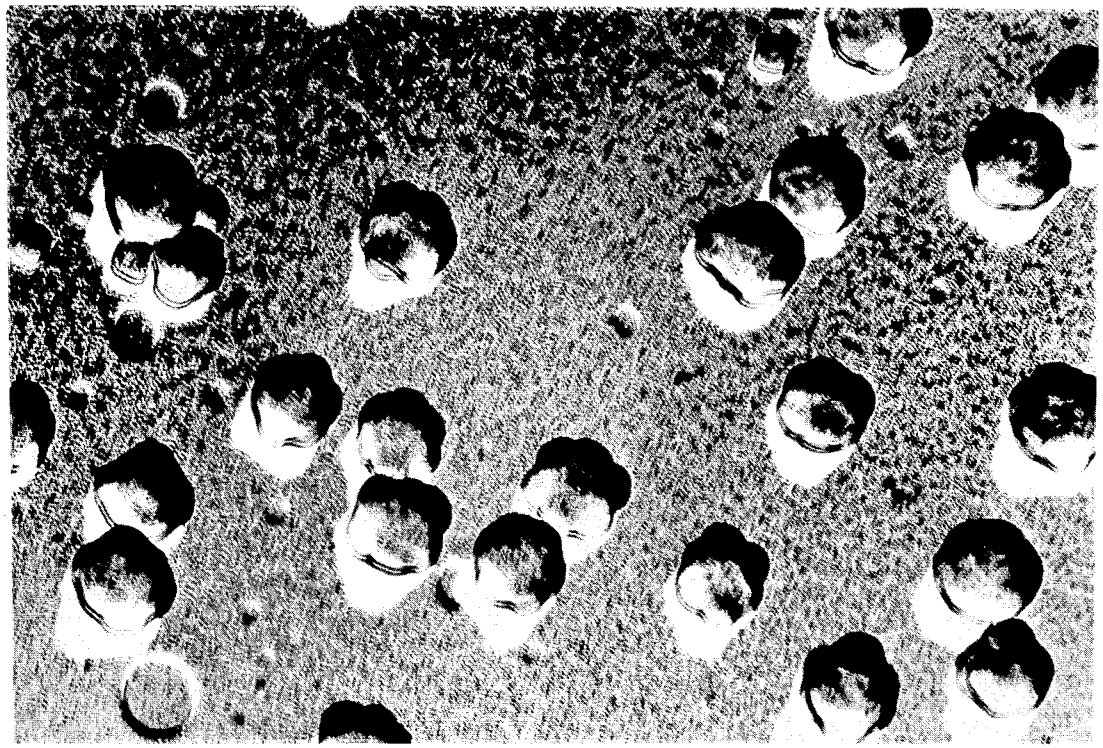
Figure 14:
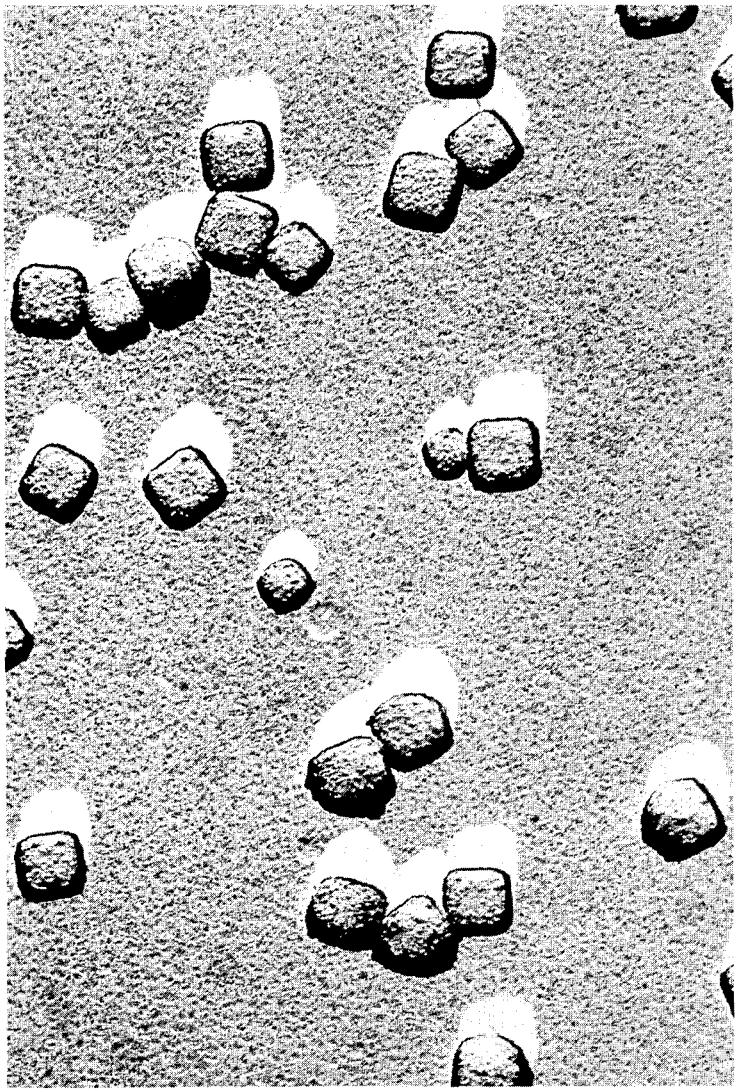
Figure 15:
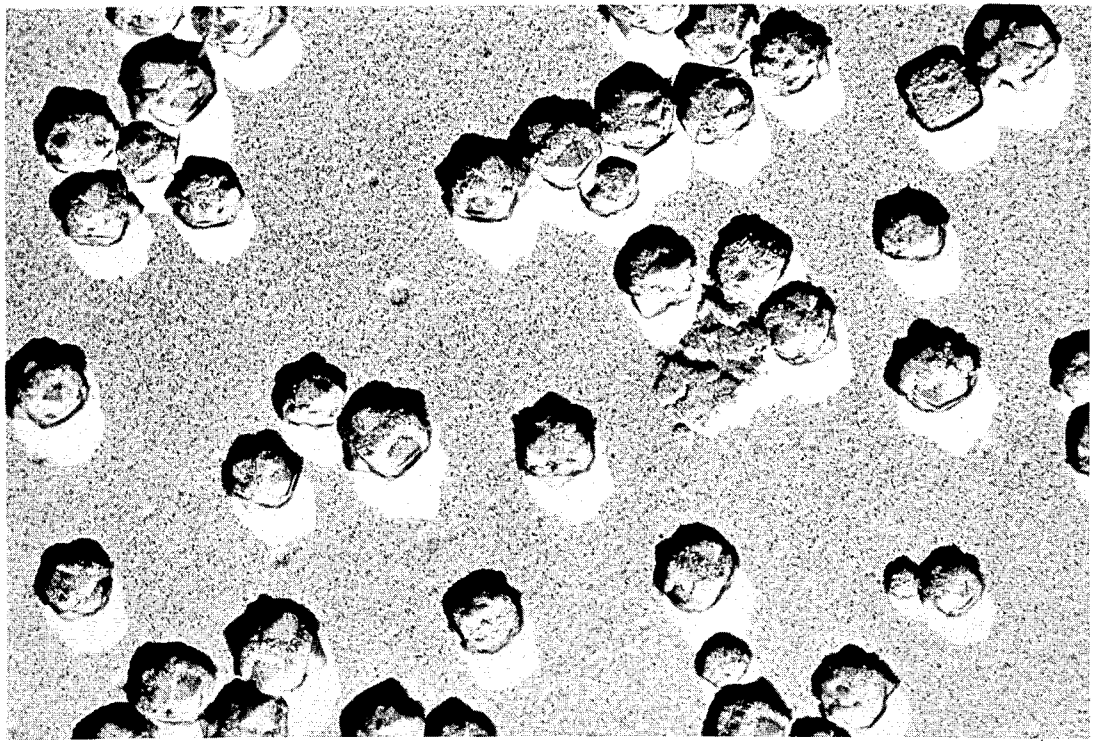
Figure 16:
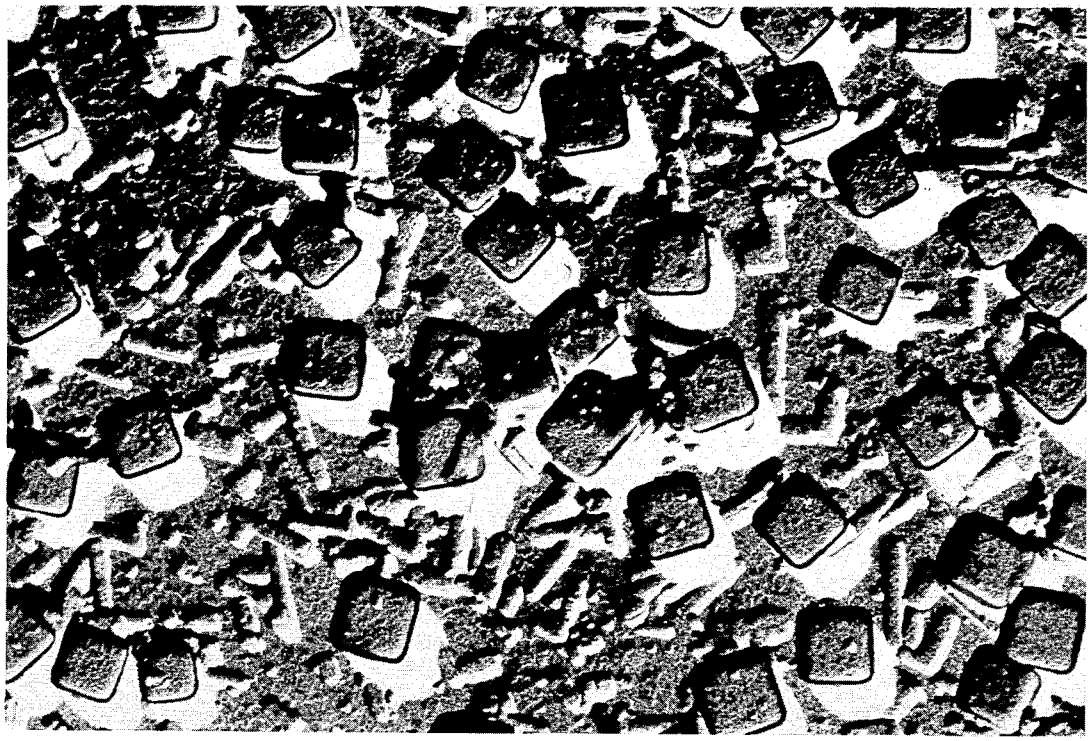
Figure 17:
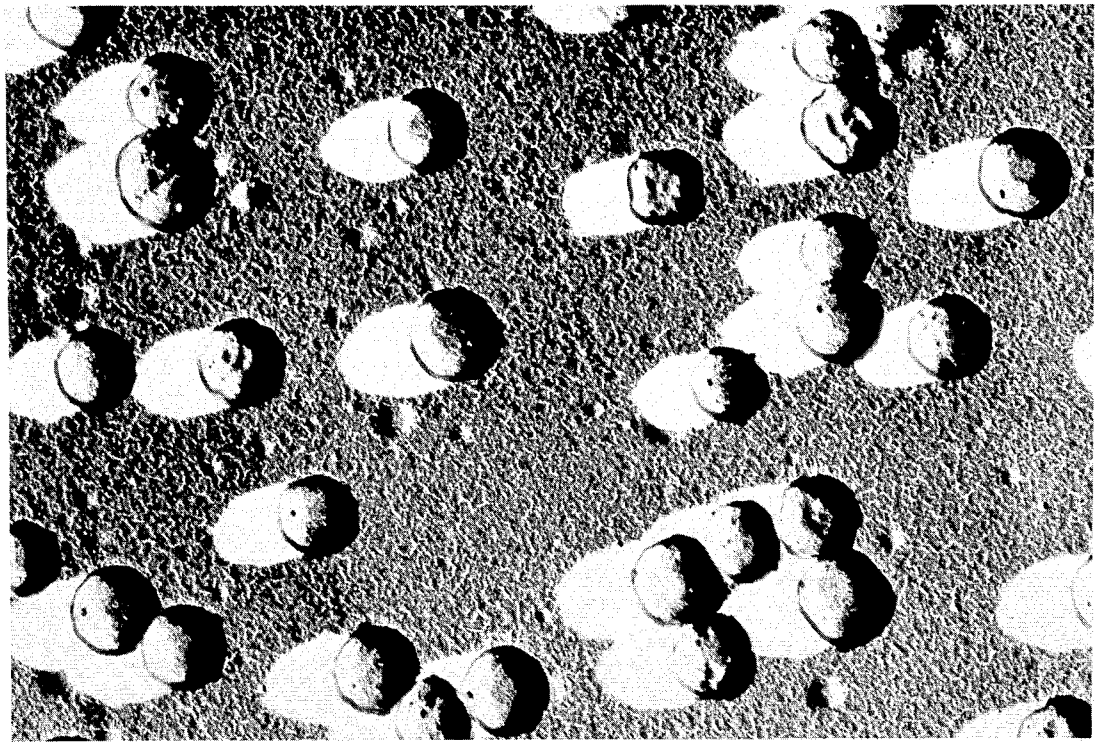
Figure 18:
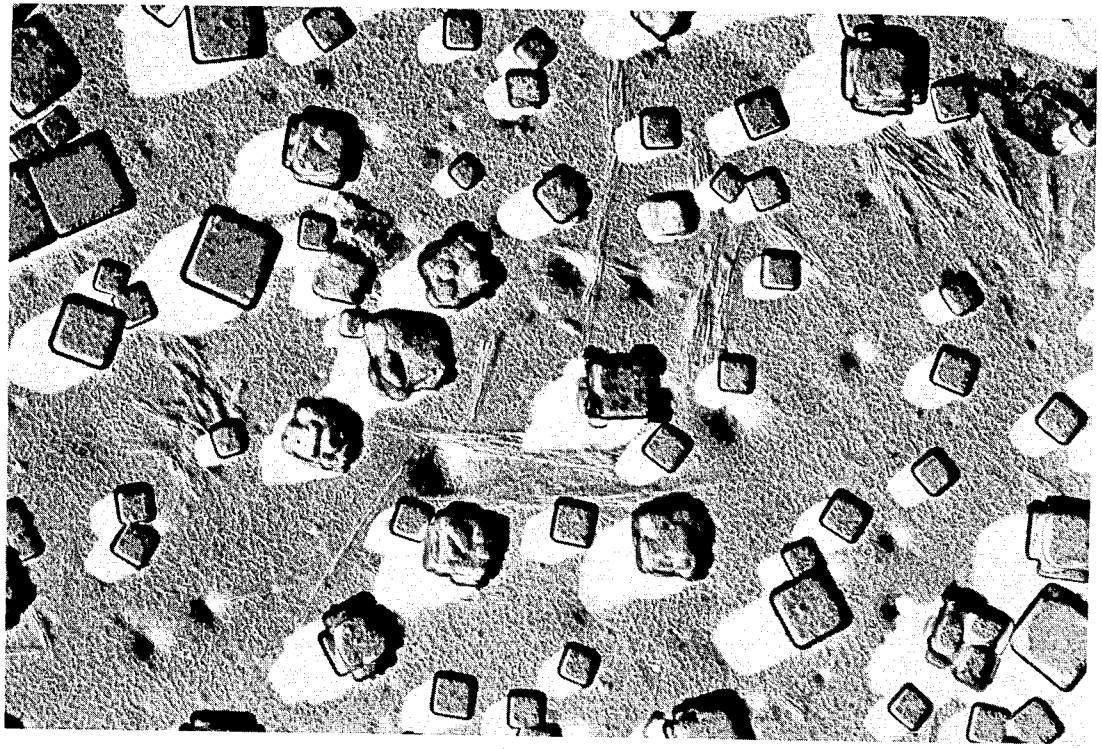
Figure 19:
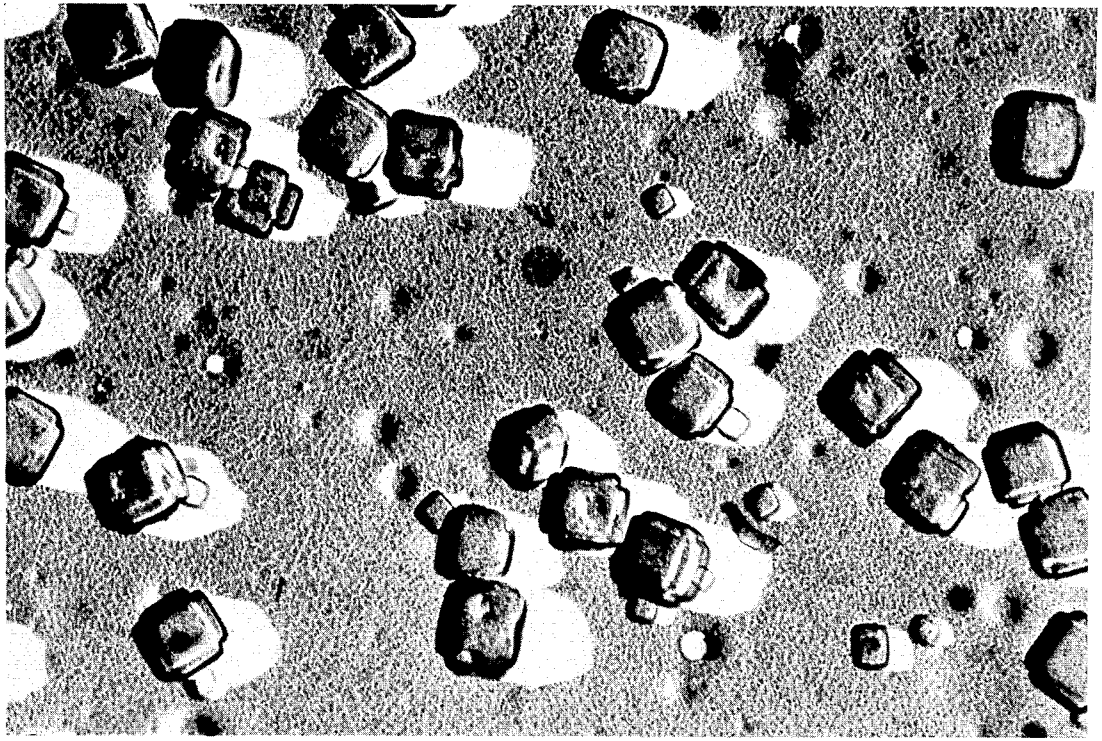
Figure 20:
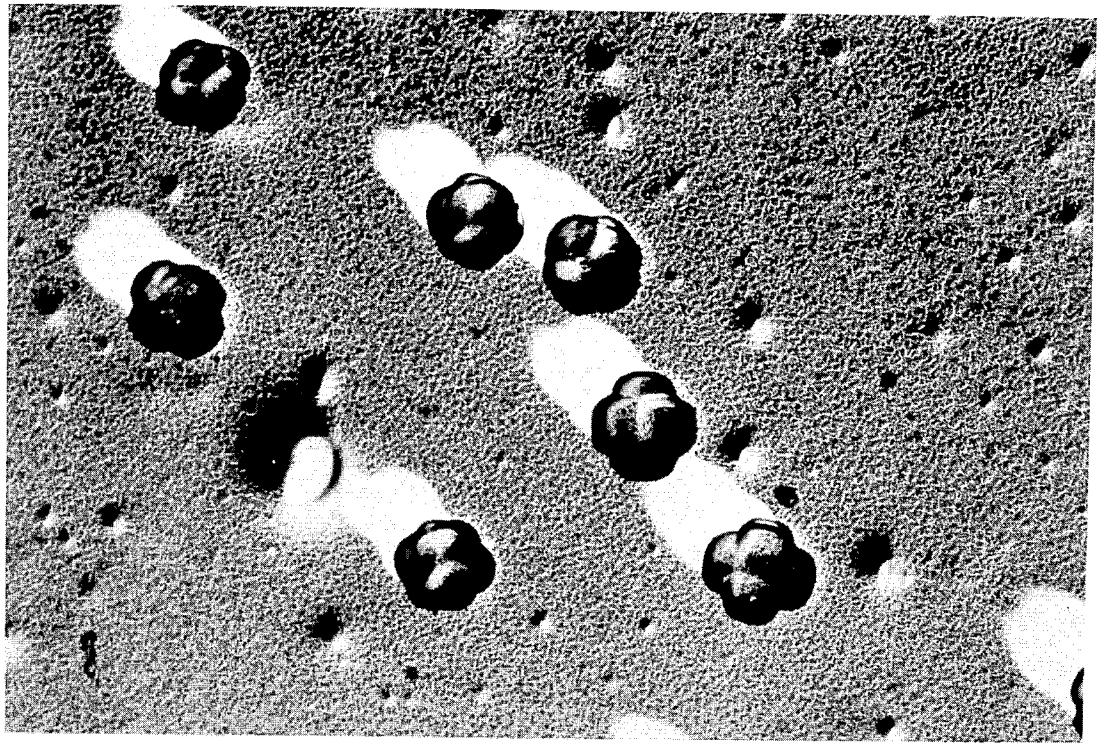
Figure 21:
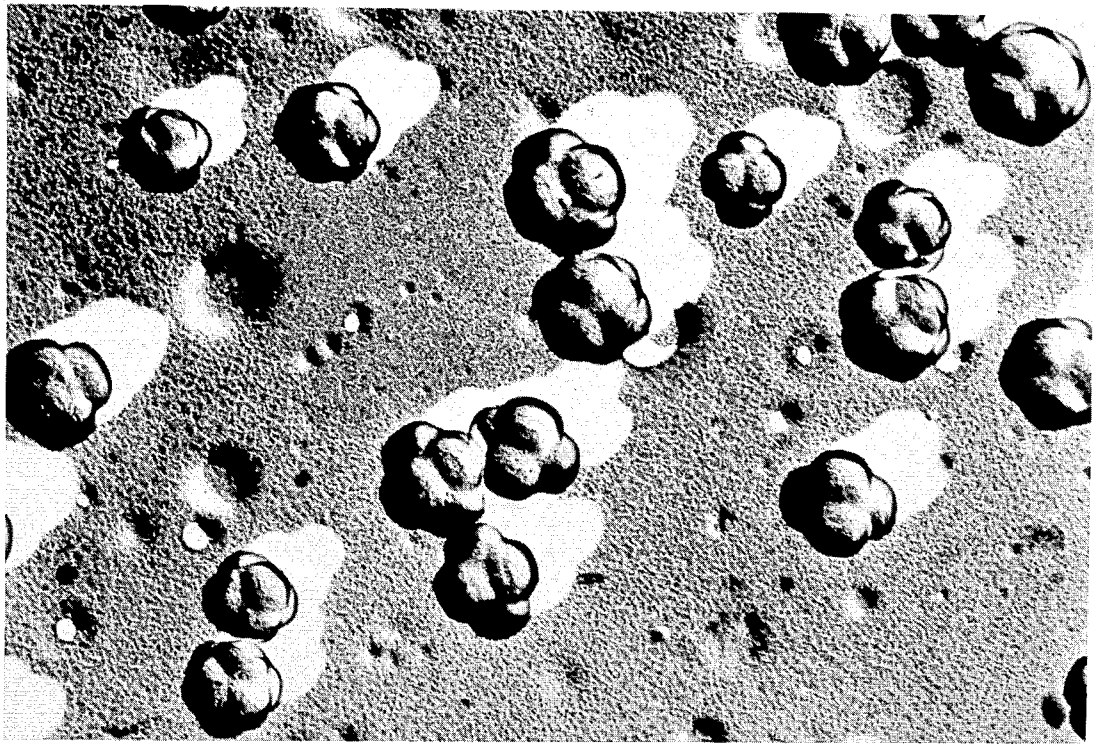
Figure 22:
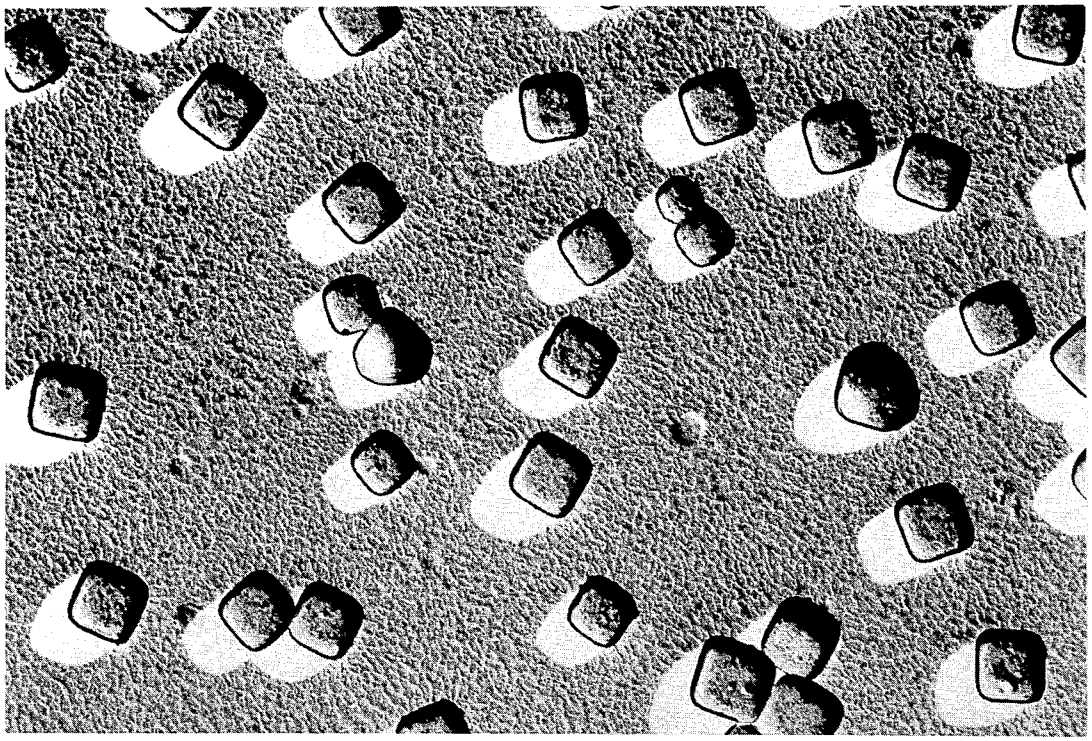
Figure 23:
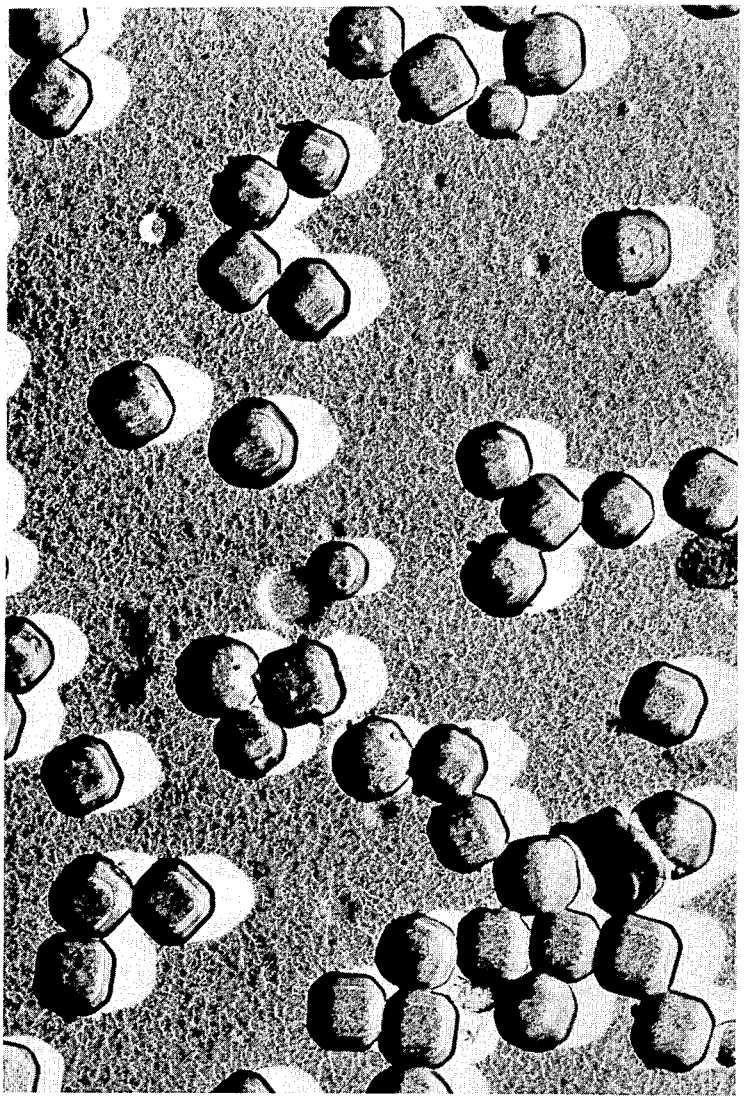
Figure 24:
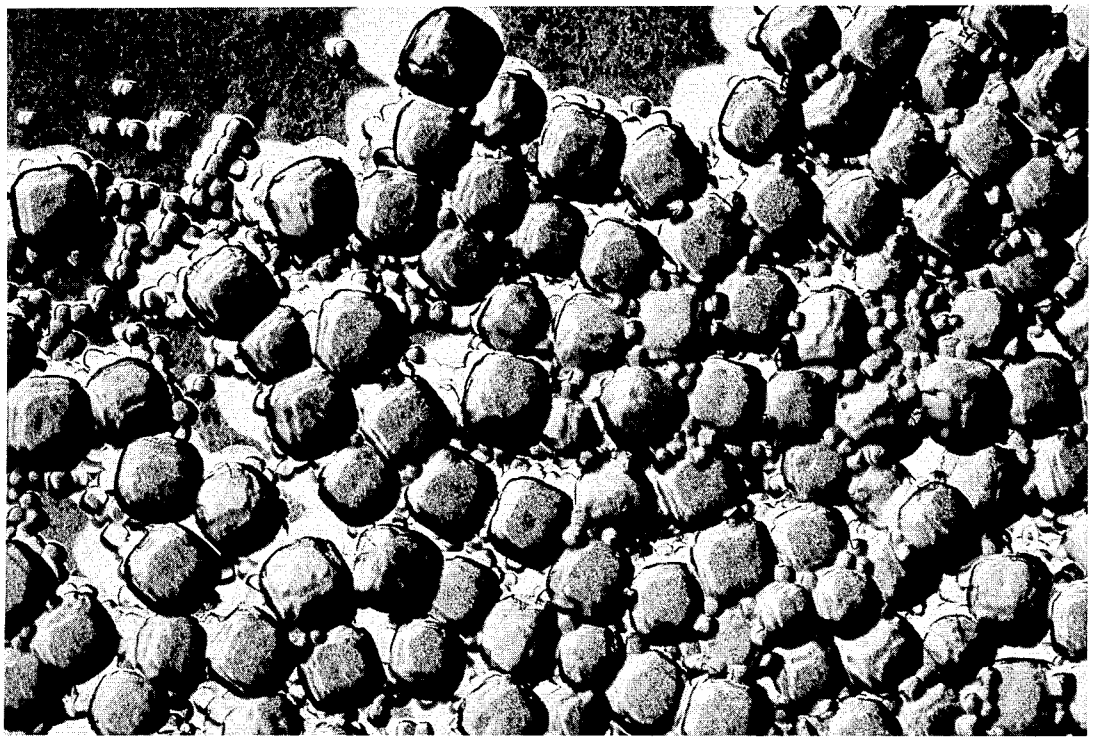
Figure 25:
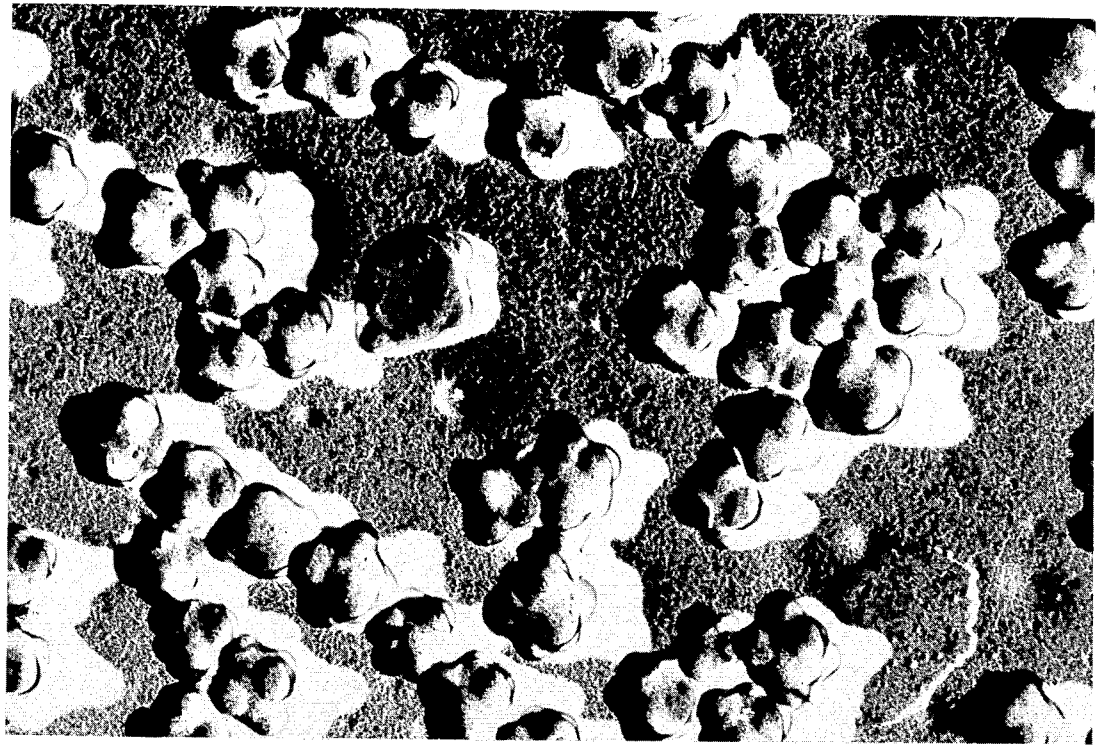
Figure 26:
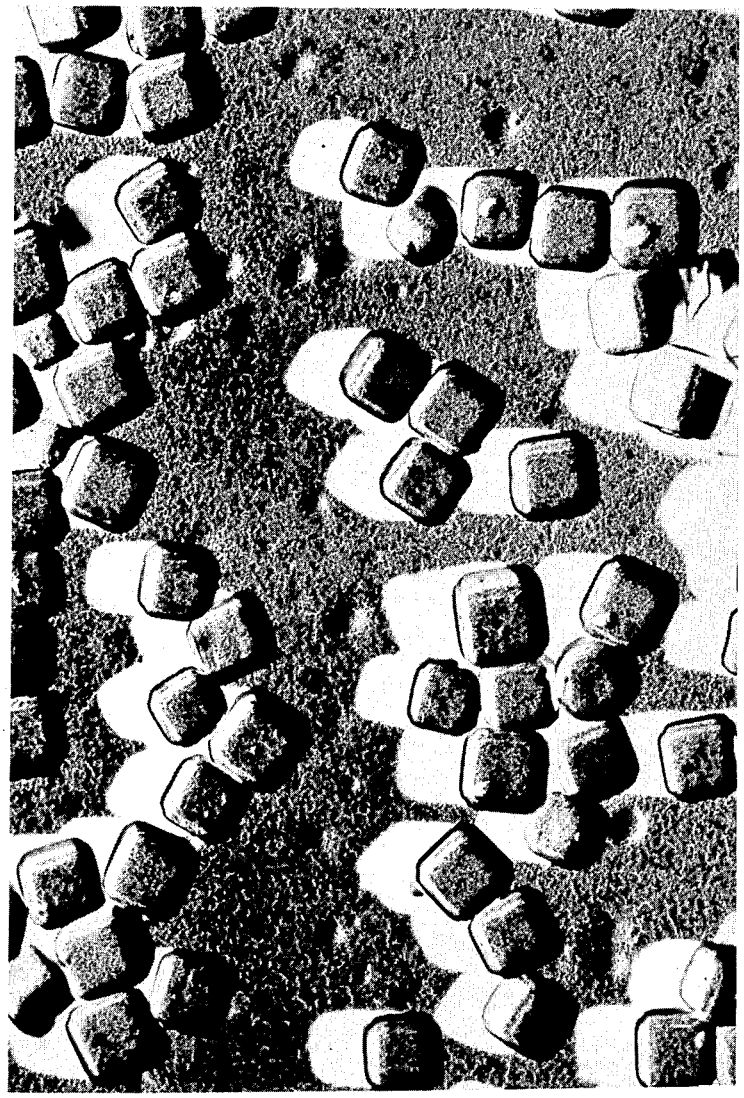
Figure 27:
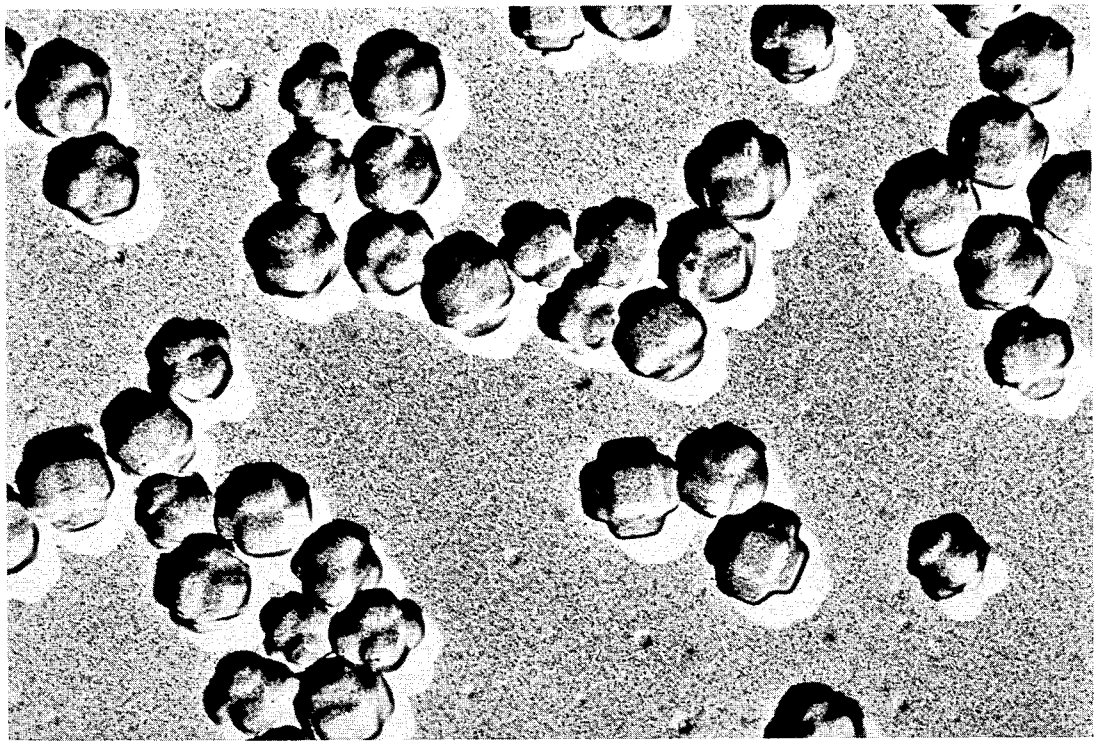

Correspondence of the drawing number and the emulsion name is as follows:

FIG. 2 represents Emulsion A (Example 1).
FIG. 3 represents Emulsion a (Example 1).
FIG. 4 represents Emulsion B (Example 2).
FIG. 5 represents a crystal shape of Emulsion B at the end of the first addition of silver nitrate (Example 2).
FIG. 6 represents an original cubic crystal of Emulsion C (Example 3).
FIG. 7 represents Emulsion C (Example 3).
FIG. 8 represents Emulsion c (Example 3).
FIG. 9 represents Emulsion D (Example 4).
FIG. 10 represents Emulsion F (Example 4).
FIG. 11 represents Emulsion G (Example 4).
FIG. 12 represents Emulsion J (Example 7).
FIG. 13 represents Emulsion K (Example 8).
FIG. 14 represents an original cubic crystal of Emulsion M (Example 15).
FIG. 15 represents Emulsion M (Example 15).
FIG. 16 represents Emulsion m-1 (Example 15).
FIG. 17 represents Emulsion m-2 (Example 15).
FIG. 18 represents Emulsion O (Example 17).
FIG. 19 represents Emulsion P (Example 17).
FIG. 20 represents Emulsion Q (Example 17).
FIG. 21 represents Emulsion R (Example 17).
FIG. 22 represents an original cubic crystal of Emulsion S (Example 18).
FIG. 23 represents Emulsion S (Example 18).
FIG. 24 represents Emulsion W (Example 26).
FIG. 25 represents Emulsion A-1 (Example 33).
FIG. 26 represents Emulsion B-1 (Example 34).
FIG. 27 represents Emulsion C-1 (Example 35).

DETAILED DESCRIPTION OF THE INVENTION

Silver halide emulsions of the present invention and silver halide photographic materials containing the emulsion are explained in detail hereinafter.

The crystal grains of the silver halide emulsions of the present invention typically have projections of other silver halide crystals formed on six (100) crystal faces of the cubic or rectangular parallelepiped basic (host) silver halide crystal grains starting from the (100) surface as a bottom surface. The projection crystals have substantially the same halogen composition as that of the surface of the (100) face of the original crystal grains. The additional crystal parts are formed on the surface of the (100) crystal faces of the original crystal grain, each in the form of a projection, or the projection crystals are so formed that one projection crystal part starting from one (100) crystal face of the original crystal grain as a bottom surface and four other projection crystal parts starting from four other (100) crystal faces of the original crystal grain, each of which crosses the first-mentioned (100) crystal face, has a bottom surface grown almost independently, while newly forming four other edges, each of which is parallel to the corresponding edge of the original cubic or rectangular parallelepiped crystal grain, without being united with one another, whereby the adjacent projection crystals thus formed have four groove parts which are parallel to the corresponding four edge parts of the original crystal grain in all. Accordingly, the most typical crystal grain thus formed may have six projection crystal parts and twelve groove parts in all on one basic crystal grain. However, all grains in the crystal grain-containing emulsion of the present invention do not always have the grain shape. The projection crystal part as formed on the (100) crystal face of the original cubic or rectangular parallelepiped silver halide crystal and starting from the (100) crystal face as a bottom surface will be referred to as a second (guest) crystal hereinafter. The grains to be contained in the emulsion of the present invention may partly include some other crystal grains where the second crystals as formed on the adjacent (100) crystal faces are united to each other with no groove part therebetween. Further, the second crystal may not be formed on every one of all the six (100) crystal faces of the original cubic or rectangular parallelepiped crystal. For instance, the second crystal may be formed on five faces or four faces or, as the case may be, two faces or only one face, and the grains of such various shapes can be contained in the emulsion of the present invention. Specifically, the grains which can satisfy the object of the present invention may be those where the second crystal is formed on at least one (100) crystal face of the original cubic or rectangular parallelepiped crystal grain, more preferably those where the second crystal is formed on two or more (100) crystal faces of the original grain, most preferably those where the second crystal is formed on all of the six (100) crystal faces of the original grain.

The proportion of the crystal grains where the second crystal is formed on all of the six (100) crystal faces of the original cubic or rectangular parallelepiped crystal grain to the total crystal grains in the emulsion of the present invention is preferably 40% or more by weight or by number of the grains. In addition, the proportion of the crystal grains where the second crystal is formed on four or more (100) crystal faces of the six (100) crystal faces of the original grain to the total crystal grains in the emulsion is preferably 60% or more by weight or by number of the grains.

Further, the proportion of the crystal grains where the second crystal is formed on two or more (100) crystal faces of the six (100) crystal faces of the original grain to the total crystal grains in the emulsion is desirably 70% or more by weight or by number of the grains. The proportion of the crystal grains where the second crystal is formed on at least one (100) crystal face of the six (100) crystal faces of the original grain to the total grains in the emulsion is desirably 80% or more by weight or by number of the grains.

The proportion of the crystal grains where the second crystals as formed on the adjacent (100) crystal faces of the same original crystal grain are united to one another over the edge parts of the original crystal grain with no groove part therebetween or those where the three second crystals as formed on the crossed and adjacent three (100) crystal faces of the original crystal grain are united to one another not only over the edge parts of the original crystal grain with no groove part therebetween but also partly over the corner parts of the original crystal is preferred to be at most 80% of the grains having at least two or more independent second crystal parts. The grains where one or more of the twelve edge parts of the original cubic or rectangular parallelepiped crystal grain has the corresponding groove part can meet the condition for use in the present invention.

The shape of the original crystal grain prior to the formation of the second crystal thereon is cubic or rectangular parallelepiped, but grains having somewhat (111) crystal face on the corner or having somewhat (110) crystal face on the edge part can be used in the present invention. Further, grains where the corner or edge is somewhat roundish can also be used. In any case, all grains which have one or more (100) crystal faces, on which the second crystal can be formed, and which can be formed into the crystal grains of the present invention can be utilized. In the crystal grains for use in the present invention, the proportion of the total surface area of the (100) crystal faces to the total surface area of the original cubic or rectangular parallelepiped crystal grain is desirably 30% or more, preferably 50% or more, more preferably 70% or more, most preferably 80% or more. The remaining crystal faces may be any of (111) face or (110) face or may be any other higher dimensional crystal faces. The presence of the (110) face in the original crystal grain does not specifically cause any disadvantage in the formation of the grains of the emulsion of the present invention. The original basic crystal grains on which the second crystal parts are to be formed may have any unlimited inner crystal structure, provided that the halogen composition of the surface thereof is the same as the halogen composition of the second crystal part. In other words, the inner halogen composition may be different from the surface halogen composition, or the inner crystal part having a different halogen composition is not always required to have the same cubic or rectangular parallelepiped crystal shape as the crystal appearance of the surface part.

In the crystal grains for use in the present invention, the original basic cubic or rectangular parallelepiped silver halide crystal grains may have any unlimited halogen composition, provided that the surface thereof contains at least 30 mol % of silver chloride, but these are preferred to contain substantially no silver iodide. The crystal grains which contain substantially no silver iodide means those which contain 3 mol % or less, more preferably 1 mol % or less, silver iodide. Accordingly, the emulsions of the present invention can have a halogen composition comprising silver chloride and silver chlorobromide and optionally a little or less silver iodide.

In the crystal grains for use in the present invention, the surface halogen composition means, in principle, the halogen composition of one atomic layer part of the surface of the crystal grain. However, a difficultly encountered in practice is that the one atomic surface layer of the crystal grain may have a substantially different halogen composition from the inner part thereof. Accordingly, it is more appropriate to define the surface halogen composition as the mean halogen composition of several atomic layers from the surface to the inner part or, in the case where the surface part forms a mixed crystal together with the inner part, for example, by recrystallization or the like, the surface halogen composition means a mean halogen ion composition of several ten atomic layers or more from the surface of the crystal grain. The halogen composition value can be obtained by calculation on the basis of the conditions under which the crystal grains are formed in some cases. However, in some other cases where the crystal grains having different halogen compositions between the surface part and the inner part are formed as mentioned above, the composition often varies because of halogen interchange between the surface part and the inner part or because of recrystallization of the crystal grain and the halogen composition value of the crystal grain cannot be obtained by calculation. Especially in such cases, the halogen composition often varies in accordance with the site of the surface of the crystal grain and estimation of the halogen composition is difficult. In such cases, therefore, the mean halogen composition can be obtained, for example, by XPS (X-ray photoelectronic spectrography) or the like means. In the crystal grains for use in the present invention, the existence of the site having substantially the same halogen composition as the bottom surface of the second crystal on the surface of the original basic cubic or rectangular parallelepiped silver halide crystal grain can meet the object of the present invention, and the crystal grains of the present invention can be formed by deposition of the second crystal on the surface site.

In the silver halide grains of the emulsion of the present invention, the halogen composition distribution of the original cubic or rectangular parallelepiped crystal grain may have a wholly uniform halogen composition distribution but is not always required to have such a structure. In order to most typically display the characteristic feature of the shape of the crystal grain in the emulsion of the present invention, which is characterized in that the second crystal part having substantially the same halogen composition as that of the original basic cubic or rectangular parallelepiped silver halide crystal grain is formed and deposited on the surface of the original crystal grain in the form of projections having a groove part therebetween but is not formed thereon in the form of conventionally known cubic, octahedral or rhombic dodecahedral crystal parts, it is preferred to use such uniform inner halogen composition distribution-having crystal grains as the original basic cubic or rectangular parallelepiped silver halide crystal grains. In that case, a second crystal part as deposited on the surface of the original crystal grain having a uniform inner halogen composition distribution is most typical.

As mentioned above, the halogen composition distribution in the inner part of the second crystal as formed on the surface of the original basic cubic or rectangular parallelepiped silver halide crystal grain may be uniform or may have some nonuniform distribution. In the former uniform halogen composition distribution case, the total halogen composition of the second crystal has the same halogen composition as that in the surface of the original cubic or rectangular parallelepiped crystal grain. In the latter nonuniform halogen composition distribution case, a part of the second crystal having the same halogen composition as that in the surface of the original cubic or rectangular parallelepiped crystal grain is first formed and then the remaining crystal part thereof having a different halogen composition may be formed The crystal part with such different halogen composition may account for almost all or a part other than the bottom surface part of the second crystal, or the crystal part with such different halogen composition may be introduced into the inside of the second crystal or may be positioned on the surface part thereof or may be both in the inside and on the surface thereof or may be a combination thereof.

The crystal part with such different halogen composition can be formed by sedimentation by general addition of a water-soluble silver salt and a water-soluble halide or can be formed by a so-called halogen interchange or the like means. The same means can be utilized for the formation of the original basic cubic or rectangular parallelepiped silver halide crystals having a nonuniform halogen composition distribution in the inner part of the crystal grains.

The halogen composition of the surface part of the original basic cubic or rectangular parallelepiped silver halide grain and that of the bottom surface of the second crystal part as formed on the former, which are to be substantially the same, are required to contain 30 mol % or more silver chloride. If the silver chloride content is less than 30 mol %, the formation of the projected second crystal parts is difficult and the formation of the groove parts between the second crystal parts also is difficult. More preferably, the silver chloride content is 50 mol % or more.

In the crystal grains for use in the present invention, the halogen composition of the bottom surface of the second crystal is substantially the same as that of the surface part of the original basic cubic or rectangular parallelepiped silver halide crystal grain, which means that a small difference in the halogen composition between the two is not excluded from the scope of the present invention. Specifically, the surface of the original basic cubic or rectangular parallelepiped silver halide crystal grain contains 30 mol % or more silver chloride in the present invention, and the difference between the silver chloride content in the bottom surface of the second crystal as deposited on the surface of the original basic grain and that in the surface of the original basic grain is to fall within 7 mol % or less, more typically 3 mol % or less.

The total halogen composition of the emulsion of the present invention may have any unlimited composition value, provided that the surface of the original basic or rectangular parallelepiped crystal grain contains 30 mol % or more silver chloride, and in particular, the emulsion is preferred to contain 30 mol % or more silver chloride throughout the total halogen composition of the emulsion in order to more effectively obtain the crystal grains of the present invention. More preferably, the emulsion is desired to contain 50 mol % or more silver chloride. The formation of the crystal grains of the emulsion of the present invention becomes easier the greater the total silver chloride content is, especially the greater the silver chloride content is in the halogen composition in the surface of the original cubic or rectangular parallelepiped crystal grain. In particular, the formation is far easier when the silver chloride content is 70 mol % or more. The characteristic features of the emulsion of the present invention are often remarkably enhanced when the silver chloride content is higher. The emulsion of the present invention may have a silver chloride content of 90 mol % or more or, as the case may be, 100 mol %, and an extremely favorable result can be obtained in such case.

The proportion of the silver halide amounts of the original cubic or rectangular parallelepiped crystal grain to the second crystal part to be formed on the former in the crystal grains of the emulsion of the present invention is not limitative, but if the proportion of the latter to the former is too small, a definite projected structure could not be observed, while on the contrary, if the proportion is too large, the second crystal could not be formed only on the intended surface of the original crystal grain, but the excess silver halide intended as the second crystal would newly form other crystal grains whereby the projected structure would be lost. Accordingly, the proportion referred to above is preferably within the range of from 0.03 to 16, more preferably from 0.05 to 12.

However, this proportion does not always correspond to the proportion between the cubic or rectangular parallelepiped part as remained when all the projection parts in the finished crystal grain are cut off along the respective plane which is parallel to the (100) crystal face of the original basic crystal grain and the sum of the thus cut-off parts. All the second crystal parts as formed on the surface of the original cubic or rectangular parallelepiped crystal grain are not always completely in the form of projections, but a part of the second crystal parts would often cover the edge parts or corner parts of the original cubic or rectangular parallelepiped crystal grain or, as the case may be, the second crystal parts would be deposited thereon while somewhat dissolving the surface part of the original crystal grain. Accordingly, the above-mentioned proportion between the halogen composition of the original crystal grain and that to be the second crystal part would often somewhat differ from the proportion between the halogen composition of the host crystal grain and that of the second crystal part as deposited.

Even the finished crystal grains in this case are also in the scope of the present invention, provided that these have projected second crystal parts and groove parts therebetween which are parallel to the edge parts of the original crystal grain. The crystal grains in this case are also preferred to have the above-mentioned proportion range between the projected parts and the non-projected parts.

For the intergranular uniform formation of the second crystal parts on the original cubic or rectangular parallelepiped crystal grain, it is desired that not only the shape of the original crystal grain is uniform but also that the grain size distribution is such that a high proportion of grains are monodispersed. In such a case, the ratio of the statistical standard deviation on the volume size of the grain to the mean size thereof is preferred to be 0.25 or less, more preferably 0.15 or less.

If, however, a broad grain size distribution is desired because of some reasons, for example, for soft contrast of gradation, it is possible to prepare the emulsion of the present invention having such broad grain size distribution. To obtain this objective, the conditions under which the second crystal part is formed are appropriately adjusted, for example, by controlling the addition speed of the aqueous silver salt solution and the aqueous halide solution during the formation of the second crystal part, whereby an emulsion containing crystal grains in which the proportion of the amount of the silver halide differs between the original basic crystal grain and the second crystal parts formed can be obtained.

The crystal grains of the emulsion of the present invention can be obtained by the use of a crystal habit-controlling agent ("growth modifier") during the formation thereof. The crystal habit-controlling agent for use in the present invention is not limited, provided that when it is added to cubic or rectangular parallelepiped silver halide crystal grains containing 30 mol % or more silver chloride on the crystal surface and surrounded mainly by (100) crystal faces, one or more projections of second silver halide crystals having the same halogen composition as in the surface of the original crystal grain may continuously be formed on the surface of the original crystalgrain, so that silver halide crystal grains having one or more projections of the second silver halide crystals deposited on at least one (100) surface of the six crystal faces of the original cubic or rectangular parallelepiped silver halide crystal grain are formed in which, starting from the (100) surface as a bottom surface, the adjacent projection crystals have a groove part therebetween which is parallel to the edge part of the original silver halide crystal grains.

Examples of the crystal habit-controlling agents which may be used in the present invention are compounds having an ability to accelerate th growth of the (110) crystal faces of silver halide crystal grains when used in the formation of the silver halide crystal grains in an aqueous medium containing a hydrophilic protective colloid and, therefore, the reasonableness of the use of such crystal habit-controlling agent in the formation of the crystal grains of the present invention is understood in consideration of the fact that the edge part of the original cubic or rectangular parallelepiped crystal grains corresponds to the (110) crystal face.

However, it cannot be said that all the compounds capable of accelerating the growth of the (110) crystal faces will always be effective as a crystal habit-controlling agent in the formation of the crystal grains of the present invention. It has been found by the present inventors that some compounds which are extremely effective as a crystal habit-controlling agent for accelerating the growth of the (110) crystal faces are not so effective for the formation of the crystal grains of the present invention, while some other compounds which are not always effective as a crystal habit-controlling agent for clear and definite growth of the (110) crystal faces are rather effective for easily forming the crystal grains of the emulsion of the present invention.

Regarding the compounds which are excellent as a (110) crystal habit-controlling agent, but which are not effective for the formation of the crystal grains of the present invention, these are believed to be able to somewhat effectively participate in the formation of the crystal grains of the present invention under special conditions, provided that these have the (110) crystal habit-controlling activity.

Crystal habit-controlling agents which have been found by the present inventors to be effective for the formation of the crystal grains of the emulsion of the present invention include the compounds as specifically mentioned hereinafter.

Nucleic acids and decomposed products thereof, for example, are generally effective for the formation of the crystal grains of the emulsion of the present invention. Effective nucleic acids include deoxyribonucleic acid (DNA) and ribonucleic acid (RNA), and decomposed products of nucleic acids include adenine, guanine and the like aminoazaindene compounds, and intermediate decomposed products obtainable during the decomposition of nucleic acids. Of these compounds, ribonucleic acid and intermediate decomposed products thereof are especially effective for the formation of the crystal grains of the present invention. In addition, azaadenine was also found to be effective for the formation of the crystal grains of the present invention.

Mercaptotetrazole compounds having the following general formula (I) were also found to be effective:

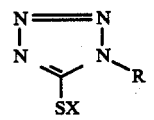

(I)

In the formula (I), R represents an alkyl group, an alkenyl group, or an aryl group and X represents a hydrogen atom, an alkali metal atom, and an ammonium group or a precursor thereof. The alkali metal atom includes, for example, a sodium atom, a potassium atom, etc., and the ammonium group includes, for example, a tetramethylammonium group, a trimethylbenzylammonium group, etc. The precursor means a group which can be a hydrogen atom or an alkali metal atom as X under an alkaline condition, for example, including an acetyl group, a cyanoethyl group, a methanesulfonylethyl group, etc.

In the above-mentioned group R, the alkyl group and alkenyl group may be substituted or unsubstituted and may additionally include alicyclic groups. As substituents for the substituted alkyl group, there may be mentioned a halogen atom, a nitro group, a cyano group, a hydroxyl group, an alkoxy group, an aryl group, an acylamino group, an alkoxycarbonylamino group, a ureido group, an amino group, a heterocyclic group, an acyl group, a sulfamoyl group, a sulfonamido group, a thioureido group, a carbamoyl group, an alkylthio group, an arylthio group, a heterocyclic thio group, a carboxylic acid group, a sulfonic acid group or salts thereof.

The above-mentioned ureido group, thioureido group, sulfamoyl group, carbamoyl group and amino group include unsubstituted groups or N-alkyl-substituted or N-aryl-substituted groups. Examples of the aryl group are a phenyl group and substituted phenyl groups. The substituents on the phenyl group may be selected from an alkyl group and the above-mentioned substituents for substituted alkyl groups.

Specific examples of the compounds of formula (I) which can be used as the crystal habit-controlling agent in the formation of the crystal grains of the present invention are set forth below.

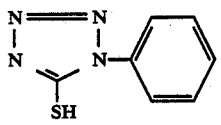
(I-1)

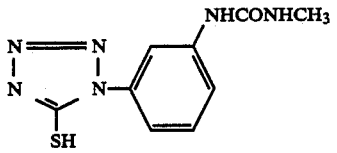
(I-2)

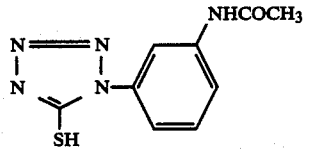
(I-3)

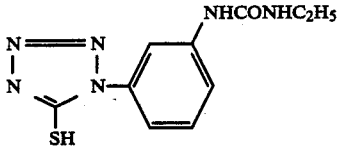
(I-4)

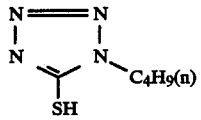
(I-5)

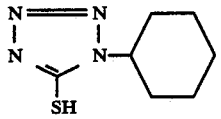
(I-6)

-continued

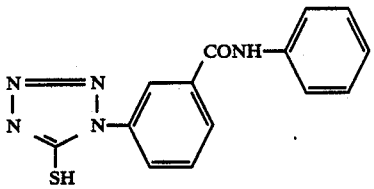
(I-7)

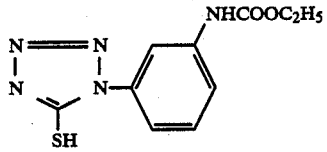
(I-8)

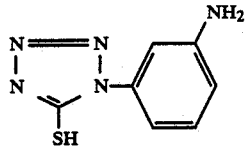
(I-9)

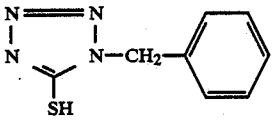
(I-10)

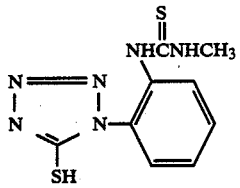
(I-11)

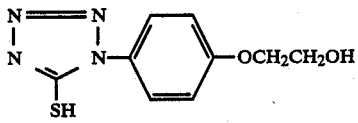
(I-12)

Mercaptothiadiazole compounds having the following general formula (II) are also effective.

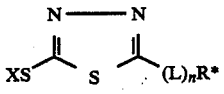
(II)

In the formula (II), R* represents a hydrogen atom, an alkyl group, an alkenyl group or an aryl group. The alkyl group, alkenyl group and aryl group and X in formula (II) have the same meanings as those in the formula (I).

L represents a divalent linking group, and specific examples thereof are as follows:

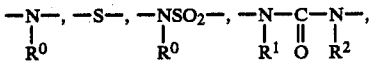

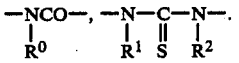

In these groups, $R^0$, $R^1$ and $R^2$ each represents a hydrogen atom, an alkyl group or an aryl group; and n represents 0 or 1.

Specific examples of the compounds of the formula (II) which can be used as the crystal habit-controlling agent are set forth below.

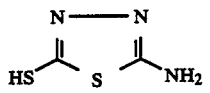
(II-1)

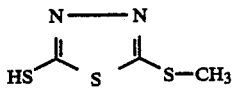
(II-2)

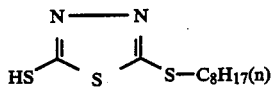
(II-3)

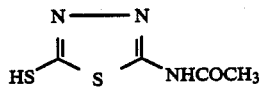
(II-4)

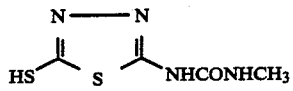
(II-5)

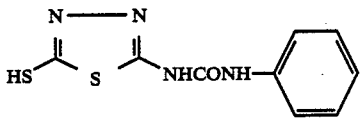
(II-6)

Compounds having the following general formula (III) are also effective.

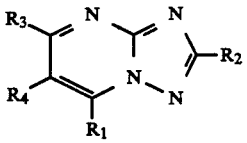
(III)

In this formula, $R_1$, $R_2$, $R_3$ and $R_4$ may be the same or different and each represents a hydroxyl group, an alkyl group, an alkenyl group, an aryl group, a cyano group, a ureido group, an amino group, a halogen atom or a hydrogen atom, provided that the formula must contain at least one hydroxyl group. Preferably, the number of the hydroxyl group in the formula is 1 or 2. These alkyl group, alkenyl group, aryl group, ureido group and amino group have the same meanings as those in the abovementioned formula (I). Preferred substituents for the alkyl group are an aryl group, an alkoxycarbonyl group, a carbamoyl group, a cyano group, an amino group and a sulfonamido group. In addition, $R_3$ and $R_4$ may combine to form a 5-membered or 6-membered, saturated or unsaturated, carbon-containing ring.

Specific examples of the crystal habit-controlling agent as represented by formula (III) are compounds as set forth below.

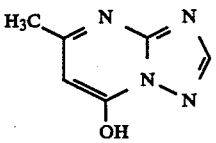
(III-1)

-continued

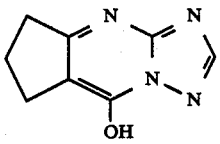
(III-2)

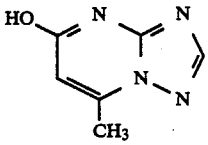
(III-3)

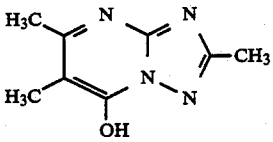
(III-4)

Compounds having the following general formula (IV) are also effective.

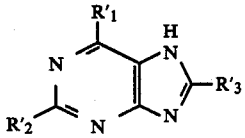
(IV)

In the formula, $R'_1$, $R'_2$ and $R'_3$ have the same meanings as $R_1$, $R_2$, $R_3$ in formula (III) above. Accordingly, at least one of these groups is a hydroxyl group.

Specific examples of the compounds of formula (IV) are set forth below.

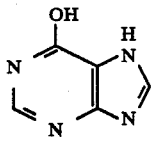
(IV-1)

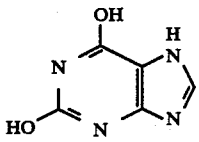
(IV-2)

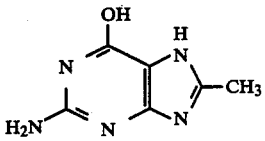
(IV-3)

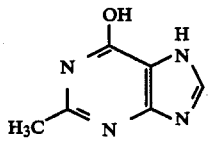
(IV-4)

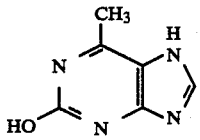
(IV-5)

-continued (IV-6)

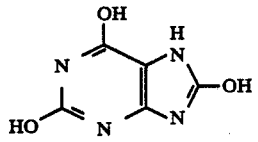

(IV-7)

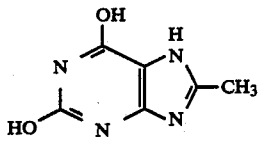

Further, dicarbocyanine compounds having the following general formula (V) are also effective.

(V)

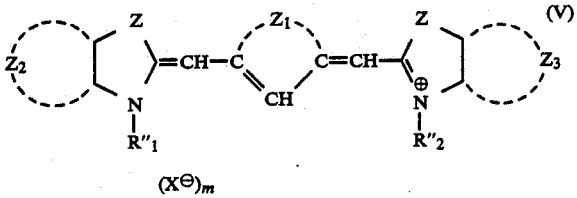

In this formula, $R''_1$ and $R''_2$ each represents an alkyl group, a substituted alkyl group, an aryl group or a substituted aryl group; Z represents a sulfur atom, an oxygen atom or a selenium atom; $Z_1$ represents a hydrocarbon atomic group necessary for forming a 6-membered ring; $Z_2$ and $Z_3$ each represents an atomic group necessary for forming a benzene ring or a naphthalene ring as condensed with a thiazole ring, an oxazole ring or a selenazole ring; $X^{\ominus}$ represents an anion; and m represents 0 or 1.

When $R''_1$ or $R''_2$ represents an alkyl group or a substituted alkyl group, this may be a linear alkyl group or a branched alkyl group, including, for example, a methyl group, an ethyl group, a propyl group, a hydroxyethyl group, a methoxyethyl group, a carboxymethyl group, a carboxyethyl group, a sulfoethyl group, a sulfopropyl group, a sulfobutyl group, an acetoxyethyl group, an ethoxycarbonylmethyl group, a chloroethyl group, a β-hydroxy-γ-sulfopropyl group, a benzyl group, a phenethyl group, an allyl group, a sulfatepropyl group, etc.

When $R''_1$ or $R''_2$ represents an aryl group or a substituted aryl group, this includes, for example, a phenyl group, a sulfophenyl group, a carboxyphenyl group, etc. The heterocyclic nucleus including benzene ring or naphthalene ring, which is formed by $Z_2$ or $Z_3$, can be substituted, and preferred substituents therefor are a halogen atom such as a chlorine atom, a bromine atom, etc., an alkyl group such as a methyl group, an ethyl group, etc., an aryl group such as a phenyl group, etc., an alkoxy group such as a methoxy group, an ethoxy group, etc.

Examples of $X^{\ominus}$ are a chloride ion, a bromide ion, an iodide ion, a p-toluenesulfonate ion, etc.

Specific examples of the compounds of formula (V) which can be used as the crystal habit-controlling agent in the formation of the crystal grains of the present invention are set forth below.

(V-1)

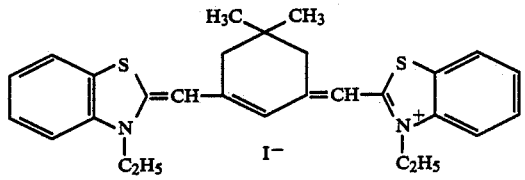

(V-2)

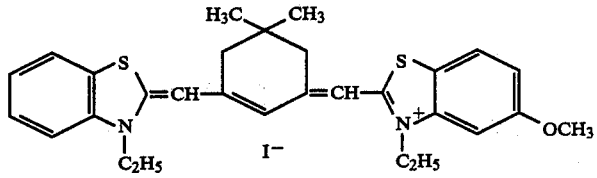

(V-3)

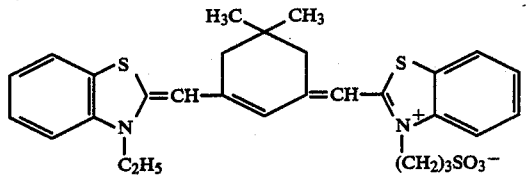

(V-4)

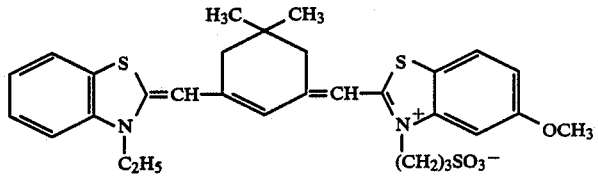

-continued
(V-5)
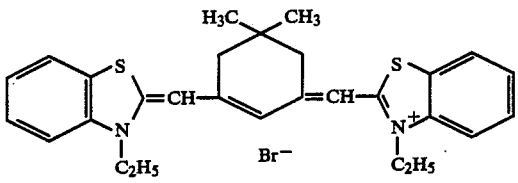
(V-6)
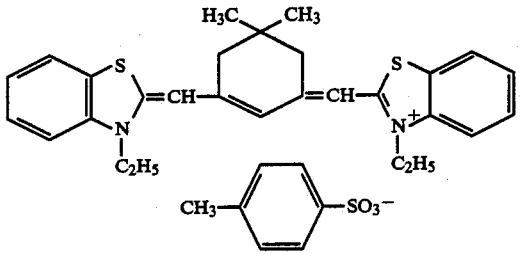
(V-7)
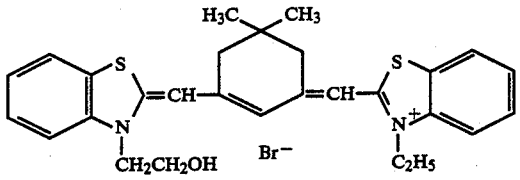
(V-8)
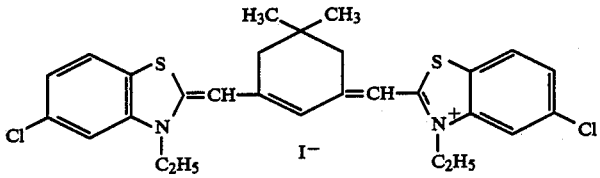
(V-9)
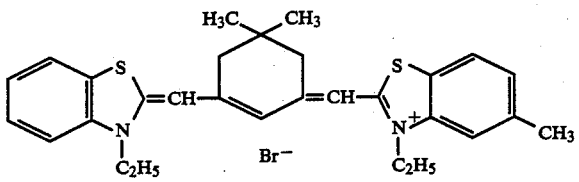
(V-10)
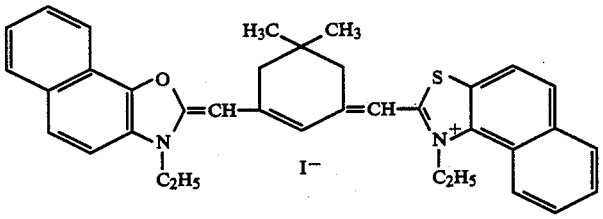
(V-11)
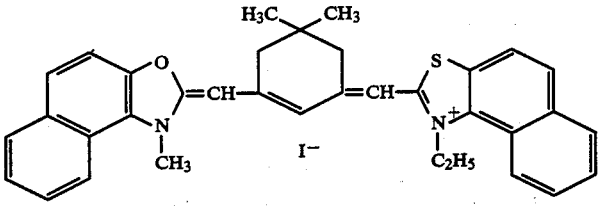
(V-12)
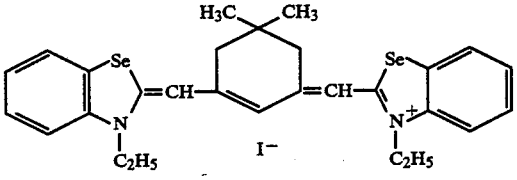
Merocyanine compounds having the following general formula (VI) have been found to also be effective as (VI)

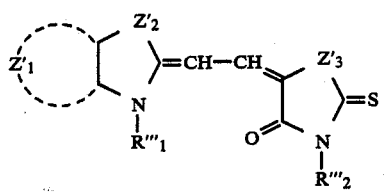

In the formula, $R'''_1$ and $R'''_2$ each represents an alkyl group, a substituted alkyl group, an aryl group or a substituted aryl group. The alkyl group or substituted alkyl group may be a linear alkyl group or a branched alkyl group, for example, including a methyl group, an ethyl group, a propyl group, a hydroxyethyl group, a methoxyethyl group, a carboxymethyl group, a carboxyethyl group, a sulfoethyl group, a sulfopropyl group, a sulfobutyl group, an acetoxyethyl group, an ethoxycarbonylmethyl group, a chloroethyl group, a β-hydroxy-γ-sulfopropyl group, a benzyl group, an allyl group, a sulfatepropyl group, a hydroxyethoxyethyl group, etc. The aryl group or substituted aryl group include, for example, a phenyl group, a sulfophenyl group, a carboxyphenyl group, etc.

$Z'_2$ and $Z'_3$ each represents a sulfur atom, an oxygen atom, a selenium atom or a nitrogen atom. When $Z'_2$ or $Z'_3$ represents a nitrogen atom, an alkyl group, a substituted alkyl group, an aryl group or a substituted aryl group, each of which has the same meaning as $R'''_1$ or $R'''_2$, is bonded to the nitrogen atom. $Z'_1$ represents an atomic group necessary for forming a benzene ring or a naphthalene ring condensed with the thiazole ring, the oxazole ring, the selenazole ring or the imidazole ring or $Z'_1$ represents a bond or a hydrogen atom so that the $Z'_2$-containing 5-membered ring in the formula may form a thiazole ring, an oxazole ring, a selenazole ring, an imidazole ring, a thiazoline ring, an oxazoline ring, a selenazoline ring or an imidazoline ring. These heterocyclic nuclei may optionally be substituted and preferred substituents therefor include a halogen atom, such as a chlorine atom, a bromine atom, etc., an alkyl group, such as a methyl group, an ethyl group, etc., an aryl group, such as a phenyl group, etc., an alkoxy group, such as a methoxy group, an ethoxy group, etc.

Specific examples of the compounds of formula (VI) are set forth below.

(VI-1)

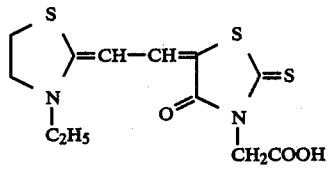

(VI-2)

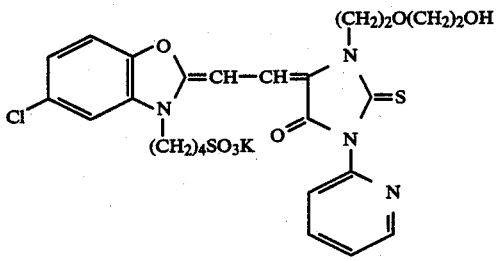

-continued (VI-3)

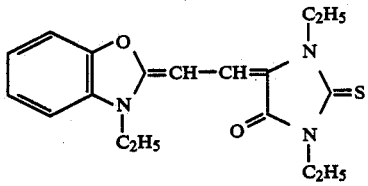

(VI-4)

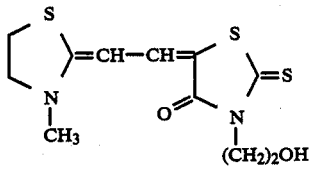

Compounds having the following general formula (VII) are also effective for the formation of the emulsion grains of the present invention.

(VII)

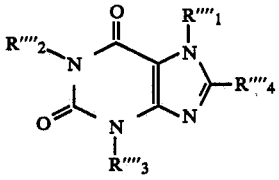

In the formula, $R''''_1$, $R''''_2$, $R''''_3$ and $R''''_4$ may be the same or different and each has the same meaning as $R_1$, $R_2$, $R_3$ and $R_4$ in formula (III), provided that these must not contain a hydroxyl group. In addition, $R''''_3$ and $R''''_4$ must not combine to form a hetero ring.

Specific examples of the compounds of formula (VII) are set forth below.

(VII-1)

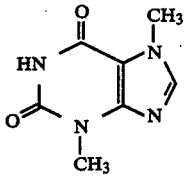

(VII-2)

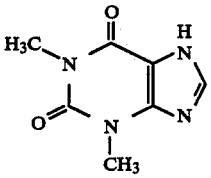

For the addition of these crystal habit-controlling agents, the entire amount thereof may be added at one time or, alternatively, the total amount may be divided into plural parts and the thus-divided part can be added intermittently in accordance with the procedure for growing the crystal grains. In addition, a crystal habit-controlling agent-containing solution can be added gradually at a certain flow rate.

The amount of the azaindene compound, such as adenine, guanine, azaadenine and the like aminoazaindenes and hypoxanthine and the like hydroxyazaindenes, to be used as a crystal habit-controlling agent which is suitable for the formation of the emulsion grains of the present invention varies in accordance with the pH of the reaction solution or other factors during grain formation and is preferably from about $1\times10^{-4}$ mol to about $2\times10^{-1}$ mol, more preferably from about $2\times10^{-4}$ mol, to about $1\times10^{-1}$ mol, per mol of silver.

The amount of the nucleic acid or decomposed product thereof to be used is preferably from about 0.01 g to about 3.0 g, more preferably from about 0.03 g to about 1.5 g, per mol of silver.

The amount of the mercaptotetrazole compound or the mercaptothiadiazole compound to be used is preferably from about $1\times^{-5}$ mol to about $2\times10^{-2}$ mol, more preferably from about $2\times10^{-5}$ mol to about 1 $10^{-2}$ mol, most preferably from about $5\times10^{-5}$ mol to about $5\times10^{-3}$ mol, per mol of silver.

The amount of the dicarbocyanine compound or the merocyanine compound to be used is preferably from about $1\times10^{-5}$ mol to about $2\times10^{-2}$ mol, more preferably from about $2\times$b $10^{-5}$ mol to about $1\times10^{-2}$ mol, per mol of silver.

For chemical sensitization of the emulsion of the present invention, a sulfur sensitization method using active gelatin or a sulfur-containing compound capable of reacting with silver (e.g., thiosulfates, thioureas, mercapto compounds, rhodanines, etc.), a reduction sensitization method using a reducing material (e.g., stannous salts, amines, hydrazine derivatives, formamidinesulfinic acid, silane compounds, etc.), a noble metal sensitization method using a noble metal compound (e.g., gold complex salts and complex salts of metals belonging to Group VIII of the Periodic Table of Elements, such as platinum, iridium, palladium, etc.) can be used individually or in combination with one another.

The photographic emulsion of the present invention can contain various compounds for the purpose of preventing the generation of fog during the manufacture, storage or photographic processing of the photographic materials or for the purpose of stabilizing the photographic characteristics of the materials. For instance, various kinds of compounds which are known as an antifoggant or as a stabilizer can be added to the emulsion, and examples of the compounds are azoles such as benzothiazolium salts, nitroindazoles, triazoles, benzotriazoles, benzimidazoles (especially nitro- or halogen-substituted derivatives); heterocyclic mercapto compounds such as marcaptothiazoles, mercaptobenzothiazoles, mercaptobenzimidazoles, mercaptothiadiazoles, mercaptotetrazoles (especially 1-phenyl-5-mercaptotetrazoles and substituted derivatives thereof), mercaptopyrimidines; the above-mentioned heterocyclic mercapto compounds which additionally have a water-soluble group such as a carboxyl group or a sulfone group; thioketo compounds such as oxazolinethiones; azaindenes such as tetraazaindenes (especially 4-hydroxy-substituted (1,3,3a,7)tetraazaindenes); benzenethiosulfonic acids; benzenesulfinic acids, etc.

The photographic emulsion of the present invention may contain, for the purpose of improvement of sensitivity, elevation of contrast or acceleration of developability, for example, polyalkylene oxides or ether, ester, amine or the like derivatives thereof, thioether compounds, thiomorpholines, quaternary ammonium salt compounds, urethane derivatives, urea derivatives, imidazole derivatives, 3-pyrazolidones, etc.

The silver halide photographic emulsion of the present invention may contain, as a filter dye or for irradiation prevention or for other various purposes, water-soluble dyes (for example, oxonol dyes, hemioxonol dyes and merocyanine des). In addition, known cyanine dyes, merocyanine dyes, hemicyanine dyes, etc., can be used before, during or after chemical sensitization as a spectral sensitizer or for the purpose of controlling the crystal shape or size of the silver halide grains.

The silver halide photographic emulsion of the present invention can contain color couplers such as cyan couplers, magenta couplers, yellow couplers, etc., and compounds for dispersing the couplers. The couplers are preferably nondiffusible due to having a ballast group or being polymerized. Also, the use of 2-equivalent color couplers substituted by a releasable group can reduce the amount of silver in the emulsion as compared to 4-equivalent color couplers having a hydrogen atom at the coupling active group Couplers giving colored dyes having a proper diffusibility, non-color-forming couplers, DIR couplers releasing a development inhibitor with a coupling reaction, or DAR couplers releasing a development accelerator with a coupling reaction can also be used in the present invention.

As the yellow couplers for use in the present invention, there are oil protect type acylacetamido couplers as the typical examples. Specific examples of these couplers are described in U.S. Pat. Nos. 2,407,210, 2,875,057, 3,265,506, etc. In the present invention 2equivalent yellow couplers are preferably used and specific examples of these yellow couplers are the oxygen atom-releasing type yellow couplers described in U.S. Pat. Nos. 3,408,194, 3,447,928, 3,933,501, 4,022,620, etc., and the nitrogen atom-releasing type yellow couplers described in Japanese Patent Publication No. 10739/83, U.S. Pat. Nos. 4,401,752, 4,326,024, *Research Disclosure,* No. 18053 (April, 1979), British Patent 1,425,020, West German Patent Application (OLS) Nos. 2,219,917, 2,261,361, 2,329,587, 2,433,812, etc. In these yellow couplers, α-pivaloylacetanilide couplers are excellent in fastness, particularly in light fastness of the colored dyes formed, while α-benzoylacetanilide couplers are excellent in coloring density.

As the magenta couplers for use in the present invention, there are oil protect type indazolone type or cyanoacetyl type couplers, preferably pyrazoloazole type couplers, such as 5-pyrazolone type or pyrazolotriazole type couplers, as the typical examples. Among the 5-pyrazolone type couplers, those whose 3-position is substituted by an arylamino group or an acylamino group are preferred because of the hue and color density of the colored dyes formed. Specific examples of these couplers are described in U.S. Pat. Nos. 2,311,082, 2,343,703, 2,600,788, 2,908,573, 3,062,653, 3,152,896, 3,936,015, etc. Also, as the releasable groups for the 2-equivalent 5-pyrazolone series couplers, the nitrogen atom-releasing groups described in U.S. Pat. No. 4,310,619 and the arylthio groups described in U.S. Pat. No. 4,351,897 are preferred. Furthermore, the 5-pyrazolone series magenta couplers having a ballast group described in European Patent No. 73,636 give high coloring density.

Pyrazoloazole type couplers which may be used in the present invention include pyrazolobenzimidazoles as described in U.S. Pat. No. 3,369,879, preferably pyrazolo[5,1-c][1,2,4]triazoles as described in U.S. Pat. No. 3,725,067, pyrazolotetrazoles as described in *Research Disclosure,* No. 2422 (June, 1984) and pyrazolopyrazoles as described in *Research Disclosure,* No. 24230 (June, 1984). In particular, the imidazo[1,2-b]pyrazoles described in European Patent No. 119,741 are preferred in view of the low yellow side-absorption of the colored dyes and the high light fastness thereof, and the pyrazolo[1,5-b][1,2,4]triazoles described in European Patent No. 119,860 are especially preferred.

As the cyan couplers for use in the present invention, there are oil protect type naphthol series or phenol series couplers. Specific examples of the naphthol series couplers include the cyan couplers described in U.S. Pat. No. 2,474,293 and preferably the oxygen atom-releasing type 2-equivalent naphthol series couplers described in U.S. Pat. Nos. 4,052,212, 4,146,396, 4,228,233 and 4,296,200. Also, specific examples of the phenol series cyan couplers are described in U.S. Pat. Nos. 2,369,929, 2,801,171, 2,772,162, 2,895,826, etc. Cyan couplers having high fastness to humidity and temperature are preferably used in the present invention and typical examples of these cyan couplers include the phenol series cyan couplers having an alkyl group of 2 or more carbon atoms at the meta-position of the phenol nucleus described in U.S. Pat. No. 3,772,002, the 2,5-diacylamino-substituted phenol series cyan couplers described in U.S. Pat. Nos. 2,772,162, 3,758,308, 4,126,396, 4,334,011, 4,327,173, West German Patent Application (OLS) No. 3,329,729, Japanese Patent Application (OPI) No. 166956/84 (the term "OPI" as used herein refers to a "published unexamined Japanese patent application"), etc., and the phenol series couplers having a phenylureido group at the 2-position thereof and an acylamino group at the 5-position thereof described in U.S. Pat. Nos. 3,446,622, 4,333,999, 4,451,559 and 4,427,767.

In the present invention, by using couplers giving colored dyes having a proper diffusibility together with the aforesaid color couplers, the graininess of color images formed can be improved. Specific examples of the magenta couplers giving such diffusible dyes are described in U.S. Pat. No. 4,366,237 and British Patent No. 2,125,570 and specific examples of yellow, magenta and cyan couplers of this type are described in European Patent No. 96,570 and West German Patent Application (OLS) No. 3,234,533.

The dye-forming couplers of the above-described specific couplers for use in the present invention may form dimers or higher polymers. Typical examples of the polymerized dye-forming couplers are described in U.S. Pat. Nos. 3,451,820 and 4,080,211. Also, specific examples of the polymerized magenta couplers are described in British Patent No. 2,102,173 and U.S. Pat. No. 4,367,282.

The various kinds of couplers for use in the present invention may be used for the same photographic layer of a color photographic material as a combination of two or more kinds thereof for meeting particular characteristics desired for a color photographic materials, or the same kind of coupler may be used for two or more photographic layers to obtain certain desired characteristics.

The standard amount of the color coupler is in the range of from 0.001 to 1 mol per mol of the light-sensitive silver halide of the silver halide emulsion and the preferred amount is from 0.01 to 0.5 mol for yellow coupler, from 0.003 to 0.3 mol for magenta coupler and from 0.002 to 0.3 mol for cyan coupler per mol of the light-sensitive silver halide.

The photographic light-sensitive materials of the present invention can contain hydroquinone derivatives, aminophenol derivatives, amines, gallic acid derivatives, catechol derivatives, ascorbic acid derivatives, colorless compound-forming couplers, sulfonamidophenol derivatives, etc., as color fog preventing agents or coloe mixing preventing agents.

Also, the photographic light-sensitive materials of the present invention can further contain organic anti-fading agents. Examples of such organic anti-fading agents include hindered phenols such as hydroquinones, 6-hydroxycoumarones, 5-hydroxycoumarans, spirochromans, p-alkoxyphenols or bisphenols, gallic acid derivatives, methylenedioxybenzenes, aminophenols, hindered amines, and also the ether or ester derivatives obtained by silylating or alkylating the phenolic hydroxy groups of these compounds. Also, metal complexes such as (bis-salicylaldoximato)nickel complex and (bis-N,N-dialkyldithiocarbamato)nickel complex can be used as anti-fading agents.

The use of a compound having both the moiety structure of a hindered amine and a hindered phenol in the same molecule as described in U.S. Pat. No. 4,268,593 for the color photographic materials gives good results in preventing the deterioration of the yellow dye images by heat, humidity and light. Also, for preventing the deterioration of magenta dye images, particularly by light, the use of the spiroindanes described in Japanese Patent Application (OPI) No. 159644/81 or the chromans having a hydroquinone diether or monoether as a substituent described in Japanese Patent Application (OPI) No. 89835/80 give preferred results.

For improving the stability of cyan images, particularly the light fastness thereof, use of the benzotriazole series of ultraviolet absorbents in the color photographic materials is preferred. The ultraviolet absorbent may be co-emulsified with a cyan coupler.

The ultraviolet absorbent may be used in a coating amount sufficient for imparting light stability to the cyan dye images formed, but if too great of an amount of the agent is used, yellowing sometimes occurs at the unexposed portions (background portions) of color photographic light-sensitive material after processing, and hence the amount is in the range of usually from $1\times10^{-4}$ mol/m$^2$ to $2\times10^{-3}$ mol/m$^2$, preferably from $5\times10^{-4}$ to $1.5\times10^{-3}$ mol/m$^2$.

In an ordinary layer of color photographic paper, an ultraviolet absorbent exists in one or preferably both layers disposed on both sides of a cyan coupler-containing red-sensitive silver halide emulsion layer. Also, when an ultraviolet absorbent is incorporated in an interlayer between a green-sensitive emulsion layer and a red-sensitive emulsion layer, the agent may be co-emulsified with a color mixing preventing agent. When an ultraviolet absorbent exists in a protective layer, another protective layer may be formed as the outermost layer and the protective layer may contain a matting agent having any desired particle sizes.

Moreover, the color photographic materials of the present invention may contain ultraviolet absorbents in hydrophilic colloid layers thereof.

The photographic materials of the present invention may further contain whitening agents such as stilbene series compounds, triazine series compounds, oxazole series compounds, couramin series compounds, etc., in the photographic light-sensitive emulsion layers or in any other hydrophilic colloid layers. In this case, as whitening agents, water-soluble whitening agents may be used or water-insoluble whitening agents may be used as a form of the dispersion thereof.

As mentioned above, the present invention can be applied to multilayer multicolor photographic materials having at least two photographic emulsion layers having different spectral sensitization on a support. A multilayer natural color photographic material usually has at least one red-sensitive emulsion layer, at least one green-sensitive emulsion layer and at least one blue-sensitive emulsion layer on a support. The disposition order of these emulsion layers can be selected according to the intended use. Also, each emulsion layer described above may be composed of two or more emulsion layers, each having different sensitivities. Also, a light-insensitive layer may exist between two or more emulsion layers each having the same color sensitivity.

It is preferred that the photographic light-sensitive material of the present invention has proper auxiliary layers (also referred to as photograph-constituting layers) such as a protective layer or protective layers, one or more interlayers, a filter layer, an antihalation layer, a backing layer, etc., in addition to the silver halide emulsion layers.

As the binder or protective colloid which can be used for the emulsion layers, interlayers, etc., of the photographic light-sensitive materials of the present invention, gelatin is advantageously used, but other hydrophilic colloids can also be used.

For example, there are proteins such as gelatin derivatives, graft polymers of gelatin and other polymers, albumin, casein, etc.; cellulose derivatives such as hydroxyethyl cellulose, carboxymethyl cellulose, cellulose sulfates, etc.; saccharose derivatives such as sodium alginate, starch derivatives, etc.; and various synthetic hydrophilic homopolymers or copolymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

As gelatin, lime-processed gelatin as well as acid-processed gelatin or the enzyme-processed gelatin as described in *Journal of the Society of Photographic Science and Technology of Japan,* No. 16, p. 30 (1966) can be used. Also, the hydrolyzed products or enzyme decomposed products of gelatin can be used.

The finished emulsion is coated on a support, such as a baryta paper, a resin-coated paper, a synthetic paper, a triacetate film, a polyethylene terephthalate film or other plastic base or glass plate.

The silver halide photographic materials of the present invention can be utilized, for example, for color positive films, color papers, color negative films, color reversal films (containing or not containing couplers), photographic light-sensitive materials for a photomechanical process (such as lith films, lith dupe films, etc.), light-sensitive materials for cathode ray display, light-sensitive materials for X-ray recording, light-sensitive materials for silver salt diffusion transfer process, light-sensitive materials for color diffusion transfer process, light-sensitive materials for imbibition transfer process, emulsions to be used in silver dye bleaching process, light-sensitive materials for recording printout images, light-sensitive materials for direct print images, light-sensitive materials for heat development, light-sensitive materials for physical development, etc.

Exposure for the formation of photographic images on the photographic materials may be carried out in a conventional manner. For instance, any and every known light source may be used therefor, including natural light (sunlight), a tungsten lamp, a fluorescent lamp, a mercury lamp, a xenon arc lamp, a carbon arc lamp, a xenon flash lamp, a cathode ray flying spot, etc. Regarding the exposure time, the photographic material may be subjected not only to general exposure by a camera for from 1/1,000 second to 1 second but also to a shorter exposure than for 1/1,000 second, for example, by xenon flash lamp or cathode ray, for from $1/10^4$ to $1/10^6$ second or to a longer exposure than for 1 second. If necessary, the spectral composition of the light to be used for exposure may be appropriately controlled by the use of a color filter. A laser ray may be used for exposure. In addition, the photographic material may be exposed to light emitted by a fluorescent substance excited by an electronic ray, an X-ray, a $\gamma$-ray or an $\alpha$-ray.

For photographic processing of the photographic light-sensitive materials of the present invention, any and every conventional means and known processing solution may be utilized, such as described in *Research Disclosure,* Vol. 176, pp. 28–30 (RD 17643) Any of photographic processing for formation of silver images (black-and-white photographic processing) or for formation of color images (color photographic processing) can be applied to the photographic light-sensitive materials of the present invention in accordance with the objective for using the materials. The processing temperature is generally selected from the range of from 18° C. to 50° C. or, as the case may be, the temperature may be lower than 18° C. or higher than 50° C.

The color developer which can be used for the development of the photographic materials of the present invention is preferably an alkaline aqueous solution consisting essentially of a main component of an aromatic primary amine series color developing agent. p-Phenylenediamine series compounds are preferably used as the color developing agent and specific examples of the compounds are 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline and sulfates, hydrochlorides or phosphates of the above compounds as well as p-toluenesulfonates, tetraphenylborates, p-(t-octyl)benzenesulfonates, etc.

As the aminophenol series derivatives, there may be mentioned, for example, o-aminophenol, p-aminophenol, 4-amino-2-methylphenol, 2-amino-3-methylphenol, 2-hydroxy-3-amino-1,4-dimethylbenzene, etc.

In addition, the compounds described in L.F.A. Mason, *Photographic Processing Chemistry,* pp. 226–229 (published by Focal Press), U.S. Pat. Nos. 2,193,015 and 2,592,364, Japanese Patent Application (OPI) No. 64933/73 can also be used. If necessary, two or more color developing agents can be used in combination.

The processing temperature of the color developer is preferably from 30° C. to 50° C., more preferably from 33° C. to 45° C.

Benzyl alcohol can be used as a color development accelerator, which is, however, preferably not used in view of the prevention of environmental pollution. In place of the benzyl alcohol, other various compounds can be used. For example, various kinds of pyrimidium compounds and other cationic compounds and cationic dyes such as phenosafranine and neutral salts such as thallium nitrate and potassium nitrate as described in U.S. Pat. No. 2,648,604, Japanese Patent Publication No. 9503/69 and U.S. Pat. No. 3,171,247; nonionic compounds such as polyethylene glycol and derivatives thereof and polythioethers described in Japanese Patent Publication No. 9304/69 and U.S. Pat. Nos. 2,533,990, 2,531,832, 2,950,970 and 2,577,127; thioether series compounds as described in U.S. Pat. No. 3,201,242; and compounds as described in Japanese Patent Application (OPI) Nos. 156934/83 and 220344/85 can be used.

In rapid development processing not only a means for accelerating the development, but also a technique for preventing the generation of fog during development is an important subject matter. Preferred are alkali metal halides such as potassium bromide, sodium bromide and potassium iodide and organic anti-foggants as the anti-foggant. Preferably used as the organic antifoggants are, for example, nitrogen-containing heterocyclic compounds such as benzotriazle, 6-nitrobenzimidazole, 5-nitrobenzimidazole, 5-methylbenzotriazole, 5-nitrobenzotriazole, 5-chlorobenzotriazole, 2-thiazolylbenzimidazole, 2-thiazolylmethylbenzimidazole and hydroxyazaindolizine and mercapto-substituted heterocyclic compounds such as 1-phenyl-5-mercaptotetrazole, 2-mercaptobenzimidazole and 2-mercaptobenzothiazole as well as mercapto-substituted aromatic compounds such as thiosalicylic acid. Especially preferred are halides. These antifoggants can be dissolved out from the antifoggant-containing color photographic material during the processing of the material thereby to be incorporated in the color developer being used.

In addition, the color developer can further contain a pH buffer such as alkali metal carbonates, borates or phosphates; a preservative such as hydroxylamine, triethanolamine, the compounds described in West German Patent Application (OLS) No. 2,622,950, sulfites or bisulfites; an organic solvent such as diethylene glycol; a dye-forming coupler; a competing coupler; a nucleating agent such as sodium borohydride; an auxiliary developing agent such as 1-phenyl-3-pyrazolidone; a tackifier; a chelating agent such as ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, the aminopolycarboxylic acids described in Japanese Patent Application (OPI) No. 195845/83, 1-hydroxyethylidene-1,1'-diphosphonic acid, the organic phosphonic acids described in *Research Disclosure,* No. 18170 (May, 1979), aminophosphonic acids including amino-tris(methylenephosphonic acid) and ethylenediamine-N,N,N',N'-tetramethylenehosphonic acid, the phosphonocarboxylic acids described in Japanese Patent Application (OPI) Nos. 102726/77, 42730/78, 121127/79, 4024/80, 4025/80, 126241/80, 65955/80 and 65956/80 and *Research Disclosure,* No. 18170 (May, 1979), etc.

If necessary, the color developer bath line can be divided into two or more baths where a color developer replenisher can be replenished from the first bath or from the last bath, so that development time can be shortened or the amount of the replenisher can be reduced.

The silver halide color photographic materials are, in general, bleached, after having been color developed. The bleaching can be effected simultaneously with fixation (bleach-fixation) or can be effected separately. As the bleaching agent, for example, compounds of polyvalent metals such as iron(III), cobalt(III), chromium(VI), copper(II), etc., as well as peracids, quinones, nitroso compounds, etc., can be used. Specifically, ferricyanides, bichromates, organic complex salts of iron(III) or cobalt(III), for example, complex salts of aminopolycarboxylic acids such as ethylenediaminetetraacetic acid, diethylenetriaminepentaacetic acid, nitrilotriacetic acid, 1,3-diamino-2-propanoltetraacetic acid, etc., or organic acids such as citric acid, tartaric acid, malic acid, etc.; persulfates; manganates; nitrosophenol, etc., can be used. In particular, potassium ferricyanide, sodium ethylenediaminetetraacetato ferrate, ammonium ethylenediaminetetraacetato ferrate, ammonium triethylenetetraminepentaacetato ferrate and persulfates are especially preferred among them. Ethylenediaminetetraacetato ferrate complex salts are usable in either an independent bleaching bath or a combined bleaching and fixing bath.

In addition, the bleaching bath and bleach-fixing bath can contain, if necessary, various kinds of accelerators. For instance, the bath can contain, in addition to a bromide ion or an iodide ion, the thiourea series compounds described in U.S. Pat. No. 3,706,561, Japanese Patent Publication Nos. 8506/70 and 26586/74 and Japanese Patent Application (OPI) Nos. 32735/78, 36233/78 and 37016/78; the thiol series compounds described in Japanese Patent Application (OPI) Nos. 124424/78, 95631/78, 57831/78, 32736/78, 65732/78 and 52534/79, U.S. Pat. No. 3,893,858, etc.; the heterocyclic compounds described in Japanese Patent Application (OPI) Nos. 59644/74, 140129/75, 28426/78, 141623/78, 104232/78 and 35727/78, etc.; the thioether series compounds described in Japanese Patent Application (OPI) Nos. 20832/77, 25064/80 and 26505/80, etc.; the quaternary amines described in Japanese Patent Application (OPI) No. 84440/73; or the thiocarbamoyls described in Japanese Patent Application (OPI) No. 42349/74, etc.

As the fixing agents, there may be mentioned thiosulfates, thiocyanates, thioether series compounds, thioureas, a large amount of iodides, etc.; and the use of thiosulfates in general. As the preservatives for the bleach-fixing bath or the fixing bath, sulfites, bisulfites and carbonyl-bisulfite adducts are preferred.

After the bleach-fixation or fixation, in general, the photographic materials are rinsed or washed in water. In the rinsing step, various kinds of known compounds can be added to the rinsing bath for the purpose of preventing the precipitation of chemical components and economizing the rinsing water. Specifically, a water softener such as inorganic phosphoric acids, aminopolycarboxylic acids, organic phosphoric acids, etc., for preventing precipitation; a germicide or fungicide for preventing propagation of various bacteria, algae and fungi; a hardener such as magnesium salts and aluminum salts; a surfactant for preventing drying load or unevenness, etc., can be added, if desired. In addition, the compounds described in L. E. West, *Photographic Science and Engineering,* Vol. 9, No. 6 (1965), etc., can also be added. In particular, the addition of the chelating agent and fungicide is effective. Further, the application of a multistage countercurrent system (for example, composed of from 2 to 5 stage baths) to the rinsing step is possible so as to economize rinse water.

After rinsing or in place of rinsing, the multistage countercurrent stabilization step as described in Japanese Patent Application (OPI) No. 8543/82 can be carried out. In this step, two to nine countercurrent baths are required. Various kinds of compounds are added to the stabilization baths for the purpose of stabilizing the images formed. For instance, there are mentioned film pH-adjusting buffers (such as borates, metaborates, borax, phosphates, carbonates, potassium hydroxide, sodium hydroxide, aqueous ammonia, monocarboxylic acids, dicarboxylic acids, polycarboxylic acids, etc.)

and formalin. In addition, water softeners (such as inorganic phosphoric acids, aminopolycarboxylic acids, organic phosphoric acids, aminopolyphosphonic acids, phosphonocarboxylic acids, etc.), germicides (such as proxel, isothiazolone, 4-thiazolylbenzimidazole, halogenated phenols, benzotriazoles, etc.), surfactants, brightening agents, hardeners, etc., can be added, if desired.

Further, various kinds of ammonium salts such as ammonium chloride, ammonium nitrate, ammonium sulfate, ammonium phosphate, ammonium sulfite, ammonium thiosulfate, etc., can be added as a film pH adjusting agent after processing.

The following examples are intended to illustrate the present invention but not to limit it in any way.

EXAMPLE 1

30 g of lime-treated gelatin was added to 1,000 cc of distilled water and dissolved at 40° C., and the resulting solution was adjusted to have a pH of 4.0 with sulfuric acid, and 6.5 g of sodium chloride was added thereto and the temperature was elevated to 62.5° C. A solution of 62.5 g of silver nitrate dissolved in 750 cc of distilled water and a solution of 21.5 g of sodium chloride dissolved in 500 cc of distilled water were added to the previous solution within 40 minutes and blended, while the total solution was kept at 62.5° C. The emulsion obtained in this stage was observed with an electron microscope, which indicated that the emulsion contained monodispersed cubic crystal grains each having an edge length of about 0.36 μm. To this emulsion was added a solution of 0.15 g of ribonucleic acid (trade name: RNA-F, manufactured by Sanyo Kokusaku Pulp Co., Ltd., Japan) dissolved in distilled water, and then a solution of 62.5 g of silver nitrate dissolved in 500 cc of distilled water and a solution of 21.5 g of sodium chloride dissolved in 300 cc of distilled water were added thereto within 20 minutes at a temperature of 52.5° C. The resulting emulsion thus obtained was observed with an electron microscope, which indicated the formation of monodispersed crystal grains, each composed of a cubic crystal base having an edge length of about 0.36 μm and six rectangular parallelepiped or trapezoidalpiped projection crystals each growing from each of the six (100) faces of the cubic crystal base as a bottom surface having a thickness of about 0.06 μm. (This was called "Emulsion A", which is an emulsion of the present invention.)

In the same manner as the preparation of Emulsion A, except that ribonucleic acid was not used, another emulsion was prepared, and this emulsion was observed with an electron microscope, which indicated that the emulsion formed contained monodispersed cubic grains each having an edge length of 0.45 μm. (This was called "Emulsion a", which is a comparative emulsion.)

EXAMPLE 2

30 g of lime-treated gelatin was added to 1,000 cc of distilled water and dissolved at 40° C., and then the resulting solution was adjusted to have a pH of 4.0 with sulfuric acid, and 6.5 g of sodium chloride was added thereto and the temperature was elevated to 62.5° C. A solution of 62.5 g of silver nitrate dissolved in 750 cc of distilled water and a solution of 21.5 g of sodium chloride dissolved in 500 cc of distilled water were added to the previous solution within 40 minutes and blended, while the whole was kept at 62.5° C. After 20 minutes into the addition, a solution of 0.15 g of ribonucleic acid (trade name: RNA-F, manufactured by Sanyo Kokusaku Pulp Co., Ltd., Japan) dissolved in distilled water was added. The crystal grains formed within 20 minutes before the addition of the ribonucleic acid were monodispersed cubic grains each having an edge length of about 0.29 μm. The grains formed after the completion of the addition after a total time period of 40 minutes were observed, and these were monodispersed crystal grains each composed of a cubic crystal base having an edge length of about 0.29 μm and six edgeless and roundish trapezoidalpiped projection crystals each growing from each of the six (100) faces of the cubic crystal base as a bottom surface having a thickness of about 0.05 μm. The emulsion obtained in this stage is within the scope of the invention. To this emulsion were further added a solution of 62.5 g of silver nitrate dissolved in 500 cc of distilled water and a solution of 21.5 g of sodium chloride dissolved in 300 cc of distilled water within 20 minutes at a temperature of 52.5° C. The resulting emulsion thus obtained was observed with an electron microscope, which indicated the formation of crystal grains each composed of a cubic crystal base having an edge length of about 0.31 μm and six somewhat edgeless and roundish trapezoidalpiped projection crystals each growing from each of the six (100) faces of the cubic crystal base as a bottom surface having a thickness of about 0.10 to 0.11 μm. (This was called "Emulsion B", which is an emulsion of the present invention.)

EXAMPLE 3

30 g of lime-treated gelatin was added to 1,000 cc of distilled water and dissolved at 40° C., and then the resulting solution was adjusted to have a pH of 4.0 with sulfuric acid, and 6.5 g of sodium chloride and 0.02 g of N,N'-dimethylethylenethiourea were added thereto and the temperature was elevated to 55° C. A solution of 62.5 g of silver nitrate dissolved in 750 cc of distilled water and a solution of 4.4 g of potassium bromide and 19.4 g of sodium chloride dissolved in 500 cc of distilled water were added to the previous solution within 40 minutes and blended, while the whole was kept at 55° C. The emulsion obtained in this stage was observed with an electron microscope, which indicated that the emulsion contained monodispersed cubic crystal grains each having an edge length of about 0.36 μm. To this emulsion was added a solution of 0.15 g of ribonucleic acid (trade name: RNA-F, manufactured by Sanyo Kokusaku Pulp Co., Ltd., Japan) dissolved in distilled water, and then a solution of 62.5 g of silver nitrate dissolved in 500 cc of distilled water and a solution of 4.4 g of potassium bromide and 19.4 g of sodium chloride dissolved in 300 cc of distilled water were added thereto within 20 minutes with maintaining the temperature at 5° C. The resulting emulsion thus obtained was observed with an electron microscope, which indicated the formation of monodispersed crystal grains each composed of a cubic crystal base having an edge length of about 0.36 μm and six rectangular parallelepiped or trapezoidalpiped projection crystals, each growing from each of the six (100) faces of the cubic crystal base as a bottom surface having a thickness of about 0.06 μm. (This was called "Emulsion C", which is an emulsion of the present invention.)

EXAMPLE 4

In the same manner as the preparation of Emulsion C in Example 3, except that the temperature during the formation of the grains was changed to 57.5° C. and the amounts of the potassium bromide and sodium chloride to be added together with silver nitrate were changed to 8.8 g and 17.2 g, respectively, in both the first time period and the second time period, another emulsion was prepared. After the completion of the first addition, the emulsion obtained was observed with an electron microscope, which indicated that the emulsion contained monodispersed cubic crystal grains each having an edge length of about 0.36 μm. After the completion of the second addition, the emulsion obtained was also observed with an electron microscope, which indicated the formation of grains each composed of a cubic crystal base having an edge length of about 0.38 μm and six flat trapezoidalpiped projection crystals each growing from each of the six (100) faces of the cubic crystal base as a bottom-surface having a thickness of about 0.04 to 0.05 μm. (This was called "Emulsion D", which is an emulsion of the present invention.)

Also in the same manner as the preparation of Emulsion C, except that the temperature during the formation of the grains was changed to 60° C., the amounts of the potassium bromide and the sodium chloride to be added together with silver nitrate were changed to 13.1 g and 15.1 g, respectively, in both the first time period and the second time period and that the amount of the ribonucleic acid to be added during the growth of the grains was changed to 0.30 g, still another emulsion was prepared. After completion of the first addition, the emulsion obtained was observed with an electron microscope, which indicated that the emulsion contained monodispersed cubic crystal grains each having an edge length of about 0.36 μm. After completion of the second addition, the emulsion obtained was also observed with an electron microscope, which indicated the formation of monodispersed grains each composed of a cubic crystal base having an edge length of about 0.37 μm and six flat rectangular parallelepiped or trapezoidalpiped projection crystals each growing from each of the six (100) faces of the cubic crystal base as a bottom surface having a thickness of about 0.05 to 0.06 μm. (This was called "Emulsion E", which is an emulsion of the present invention.)

Also in the same manner as the preparation of Emulsion C, except that the temperature during the formation of the grains was changed to 65° C., the amounts of the potassium bromide and the sodium chloride to be added together with silver nitrate were changed to 21.9 g and 10.8 g, respectively, in both the first time period and the second time period and that the amount of the ribonucleic acid to be added during the growth of the grains was changed to 0.30 g, still another emulsion was prepared. After completion of the first addition, the emulsion obtained was observed with an electron microscope, which indicated that the emulsion contained monodispersed cubic crystal grains each having an edge length of about 0.36 μm. After completion of the second addition, the emulsion obtained was also observed with an electron microscope, which indicated the formation of monodispersed grains each composed of a cubic crystal base having an edge length of about 0.37 μm and six flat rectangular parallelepiped or trapezoidalpiped projection crystals each growing from each of the six (100) faces of the cubic crystal base as a bottom surface having a thickness of about 0.05 to 0.06 μm. (This was called "Emulsion F", which is an emulsion of the present invention.)

Also in the same manner as the preparation of Emulsion C, except that the temperature during the formation of the grains was changed to 70° C., the amounts of the potassium bromide and the sodium chloride to be added together with silver nitrate were changed to 30.6 g and 6.5 g, respectively, in both the first time period and the second time period and that the amount of the rinonucleic acid to be added during the growth of the grains was changed to 0.45 g, still another emulsion was prepared. After completion of the first addition, the emulsion obtained was observed with an electron microscope, which indicated that the emulsion contained monodispersed cubic crystal grains each having an edge length of about 0.36 μm. After completion of the second addition, the emulsion obtained was also observed with an electron microscope, which indicated the formation of monodispersed grains each composed of a cubic crystal base having an edge length of about 0.38 μm and six flat rectangular parallelepiped or trapezoidalpiped projection crystals each growing from each of the six (100) faces of the cubic crystal base as a bottom surface having a thickness of about 0.04 to 0.05 μm. (This was called "Emulsion G", which is an emulsion of the present invention.)

Also in the same manner as the preparation of Emulsion C, except that the temperature during the formation of the grains was changed to 70° C., the amounts of the potassium bromide and the sodium chloride to be added together with silver nitrate were changed to 30.6 g and 6.5 g, respectively, in both the first time period and the second time period and that the amount of ribonucleic acid to be added during the growth of the grains was changed to 1.35 g, still another emulsion was prepared. After completion of the first addition, the emulsion obtained was observed with an electron microscope, which indicated that the emulsion contained monodispersed cubic crystal grains each having an edge length of about 0.36 μm. After completion of the second addition, the emulsion obtained was also observed with an electron microscope, which indicated the formation of monodispersed grains each composed of a cubic crystal base having an edge length of about 0.36 μm and six quadrangular pyramid-shaped or trapezoidalpiped projection crystals each growing from each of the six (100) faces of the cubic crystal base as a bottom surface having a height of about 0.15 μm. (This was called "Emulsion H, which is an emulsion of the present invention.)

EXAMPLE 5

For comparison, Comparative Emulsion c through Emulsion h were prepared in the same manner as the preparation of Emulsion C through Emulsion H in Examples 3 and 4, respectively, except that ribonucleic acid was not added during the growth of the grains in the formation of the comparative emulsions. Each of these comparative emulsions was observed with an electron microscope, which indicated that each of the comparative emulsions contained monodispersed cubic crystal grains each having 20 an edge length of 0.45 μm. (These were called "Emulsion c" through "Emulsion h", which are comparative emulsions.)

In order to compare Emulsion A, Emulsion C through Emulsion H and Emulsion a, Emulsion c through Emulsion h, respectively, the same amount of ribonucleic acid as that added in the formation of Emulsion A, Emulsion C through Emulsion H was added to Emulsion a, Emulsion c through Emulsion h, respectively, and each emulsion was cooled, desalted, washed in water and chemically sensitized with from $6\times10^{-6}$ to $1.2\times10^{-5}$ mol/mol (Ag) of sodium thiosulfate. Also, Emulsion A and Emulsion C through Emulsion H were similarly desalted, washed in water and chemically sensitized with sodium thiosulfate. Each of the thus treated emulsions was blended with a dispersion of 1-(2,4,6-trichlorophenyl)-3-(2-chloro-5-tetradecanamido)anilino-2-pyrazolin-5-one dissolved and emulsified in tricresyl phosphate and coated on a polyethylene-laminated paper support in an amount of coated silver of 0.3 g/m$^2$, whereupon the amount of the magenta coupler coated was 0.38 g/m$^2$.

Each of the samples thus obtained was exposed to white light through an optical wedge for 0.1 second and developed in accordance with the procedure as mentioned below. The results obtained were set forth in Table 1.

TABLE 1

| Sample (Emulsion) | Halogen Composition | Developability | Gradation | Fog | Remarks |
|---|---|---|---|---|---|
| A | $AgCl_{100}$ | 0.08 | 0.88 | 0.17 | Invention |
| C | $AgBr_{10}Cl_{90}$ | 0.08 | 0.84 | 0.16 | " |
| D | $AgBr_{20}Cl_{80}$ | 0.07 | 0.89 | 0.16 | " |
| E | $AgBr_{30}Cl_{70}$ | 0.07 | 0.92 | 0.16 | " |
| F | $AgBr_{50}Cl_{50}$ | 0.06 | 0.95 | 0.15 | " |
| G | $AgBr_{70}Cl_{30}$ | 0.05 | 1.01 | 0.15 | " |
| H | $AgBr_{70}Cl_{30}$ | 0.05 | 0.98 | 0.15 | " |
| a | $AgCl_{100}$ | 0.24 | 1.54 | 0.21 | Comparison |
| c | $AgBr_{10}Cl_{90}$ | 0.22 | 1.42 | 0.20 | " |
| d | $AgBr_{20}Cl_{80}$ | 0.21 | 1.39 | 0.20 | " |
| e | $AgBr_{30}Cl_{70}$ | 0.18 | 1.27 | 0.19 | " |
| f | $AgBr_{50}Cl_{50}$ | 0.14 | 1.11 | 0.17 | " |
| g | $AgBr_{70}Cl_{30}$ | 0.13 | 1.13 | 0.16 | " |
| h | $AgBr_{70}Cl_{30}$ | 0.13 | 1.15 | 0.16 | " |

In Table 1, developability indicates the difference in sensitivities between the case where the sample was color-developed for 3 minutes and 30 seconds and that where the sample was color-developed for 1 minute and 30 seconds, which is represented by the difference in the respective logarithms of the exposure amounts. In this case, sensitivity was determined to be point of the density of (fog+0.5). A smaller value for developability means that the variation of the image density is smaller even under the variation of the development time and, hence, processing stability is better.

Gradation is represented by the value of the ratio of (a)/(b), in which (a) is the difference between the logarithm of the exposure amount corresponding to the density of (fog+1.5) and that of the exposure amount corresponding to the density of (fog+2.5) and (b) is the difference between the logarithm of the exposure amount corresponding to the density of (fog+1.5) and that of the exposure amount corresponding to the density of (fog+0.5). A value for gradation which is close to 1 means that the gradient of the characteristic curve is constant when the density is in the range from about 0.6 to 0.7 to about 2.6 to 2.7, and, hence, the gradation is more excellent with neither lowering of contrast in the area receiving less exposure nor excess elevation of contrast in the area receiving high exposure.

From the results of Table 1, it is understood that the emulsions of the invention having different halogen compositions have negligible fog and are excellent in gradation and in developability.

The processing procedure is comprised of the following steps:

| Processing Step | Time | Temperature (°C.) |
|---|---|---|
| Color Development | 3 min 30 sec or 1 min 30 sec | 33 |
| Bleach-Fixation | 1 min 30 sec | 33 |
| Rinsing (washing with water) | 3 min 24–34 | |
| Drying | 10 min | 70 |

The processing solutions used had the following compositions:

| | |
|---|---|
| Color Developer: | |
| Water | 800 cc |
| Benzyl Alcohol | 15 cc |
| Diethylene Glycol | 5 cc |
| Potassium Carbonate | 25 g |
| Sodium Chloride | 0.1 g |
| Potassium Bromide | 0.5 g |
| Sodium Sulfite | 1.6 g |
| Hydroxylamine Sulfate | 2 g |
| N—Ethyl-N—(β-methanesulfonamidoethyl)-3-methyl-4 aminoaniline Sulfate | 4.5 g |
| Water to make | 1,000 cc |
| KOH to make a pH | 10.25 |
| Bleach-Fixing Solution: | |
| Water | 400 cc |
| Ammonium Thiosulfate (70 wt %) | 150 cc |
| Ammonium Metabisulfite | 13.3 g |
| Sodium Sulfite | 2.5 g |
| Ammonium Ethylenediaminetetraacetato Ferrate | 65 g |
| Water to make | 1,000 cc |
| | pH: 6.75 |

EXAMPLE 6

30 g of lime-treated gelatin was added to 1,000 cc of distilled water and dissolved at 40° C., and then the resulting solution was adjusted to a pH 4.0 with sulfuric acid, and 6.5 g of sodium chloride and 0.02 g of N,N'-dimethylethylenethiourea were added thereto and the temperature was elevated to 75° C. A solution of 62.5 g of silver nitrate dissolved in 750 cc of distilled water and a solution of 39.4 g of potassium bromide and 2.2 g of sodium chloride dissolved in 500 cc of distilled water were added to the previous solution within 40 minutes and blended while maintaining the temperature at 75° C. The emulsion obtained was observed with an electron microscope, which indicated that the emulsion contained cubic grains each having an edge length of about 0.36 μm. To this emulsion were further added a solution of 62.5 g of silver nitrate dissolved in 500 cc of distilled water and a solution of 39.4 g of potassium bromide and 2.2 g of sodium chloride dissolved in 300 cc of distilled water within 20 minutes at a temperature of 75° C. The resulting emulsion thus obtained was observed with an electron microscope, which indicated the formation of cubic crystal grains each having an edge length of about 0.45 μm. (This was called "Emulsion i", which is a comparative emulsion.)

Next, in the same manner as the preparation of Emulsion i, except that a solution of 0.45 g of ribonucleic acid (trade name: RNA-F, manufactured by Sanyo Kokusaku Pulp Co., Ltd., Japan) dissolved in distilled water Was added between the first addition of the silver nitrate and the halides and the second addition of the silver nitrate and the halides, another emulsion was prepared. In this procedure, the emulsion obtained after the completion of the first addition was found to contain the same cubic grains as those in Emulsion i, while the emulsion obtained after the completion of the second addition was observed with an electron microscope to contain grains which were cubic crystal grains each having an edge length of about 0.46 μm and having (110) faces and (111) faces in the edge parts and the corner parts thereof. (This emulsion was called "Emulsion I", which falls outside the scope of the present invention.)

EXAMPLE 7

30 g of lime-treated gelatin was added to 1,000 cc of distilled water and dissolved at 40° C., and then 6.5 g of sodium chloride was added thereto and the temperature was elevated to 52.5° C. A solution of 62.5 g of silver nitrate dissolved in 750 cc of distilled water and a solution of 21.5 g of sodium chloride dissolved in 500 cc of distilled water were added to the previous solution within 40 minutes and blended while maintaining the temperature at 52.5° C. The emulsion obtained in this stage was observed with an electron microscope, which indicated that the emulsion contained cubic grains each having an edge length of about 0.36 μm. To this emulsion was added a solution of 0.15 g of ribonucleic acid (trade name: RNA-F, manufactured by Sanyo Kokusaku Pulp Co., Ltd., Japan) dissolved in distilled water, and then a solution of 62.5 g of silver nitrate dissolved in 500 cc of distilled water and a solution of 21.5 g of sodium chloride dissolved in 300 cc of distilled water were added thereto within 20 minutes at a temperature of 52.5° C. and blended. The resulting emulsion thus obtained was observed with an electron microscope, which indicated that the emulsion contained grains composed of a cubic crystal base having an edge length of about 0.36 μm and some rectangular parallelepiped projection crystal parts each growing from the (100) faces of the cubic crystal base as a bottom surface having a thickness of about 0.1 to 0.2 μm. However, most of the grains contained in this emulsion had some crystal faces with no projection crystal parts, being different from the grains contained in Emulsion A which were formed by initially adjusting the pH value to 4.0 during the growth of the grains and most of which had projection crystal parts formed on almost all of the six (100) faces thereof. (This emulsion was called "Emulsion J", which is an emulsion of the present invention.)

EXAMPLE 8

30 g of lime-treated gelatin was added to 1,000 cc of distilled water and dissolved at 40° C., and the resulting solution was adjusted to pH 4.0 with sulfuric acid, and 6.5 g of sodium chloride and 0.02 g of N,N'-dimethylethylenethiourea were added thereto and the temperature was elevated to 52.5° C. A solution of 62.5 g of silver nitrate dissolved in 750 cc of distilled water and a solution of 21.5 g of sodium chloride dissolved in 500 cc of distilled water were added to the previous solution within 40 minutes and blended while maintaining the temperature at 52.5° C. The emulsion thus obtained was observed with an electron microscope, which indicated that the emulsion contained cubic grains each having an edge length of about 0.36 μm. To this emulsion was added a solution of 0.2 g of the abovementioned Compound (I-2) dissolved in methyl alcohol, and then a solution of 62.5 g of silver nitrate dissolved in 500 cc of distilled water and a solution of 21.5 g of sodium chloride dissolved in 300 cc of distilled water were added thereto within 20 minutes and blended at a temperature of 52.5° C. The resulting emulsion thus obtained was observed with an electron microscope, which indicated the formation of grains each composed of a cubic crystal base having an edge length of about 0.36 μm and six fairly roundish trapezoidalpiped projection crystals each growing from each of the six (100) faces of the cubic crystal base as a bottom surface having a height of about 0.08 to 0.16 μm. (This was called "Emulsion K", which is an emulsion of the present invention.)

30 g of lime-treated gelatin was added to 1,000 cc of distilled water and dissolved at 40° C., and the resulting solution was adjusted to pH 4.0 with sulfuric acid, and 6.5 g of sodium chloride and 0.02 g of N,N'-dimethylethylenethiourea were added thereto and the temperature was elevated to 60° C. A solution of 62.5 g of silver nitrate dissolved in 750 cc of distilled water and a solution of 13.1 g of potassium bromide and 15.1 g of sodium chloride dissolved in 500 cc of distilled water were added to the previous solution within 40 minutes and blended while maintaining the temperature at 60° C. The emulsion thus obtained was observed with an electron microscope, which indicated that the emulsion contained cubic grains each having an edge length of about 0.36 μm. To this emulsion was added a solution of 0.2 g of the above-mentioned Compound (I-2) dissolved in methyl alcohol, and then a solution of 62.5 g of silver nitrate dissolved in 500 cc of distilled water and a solution of 13.1 g of potassium bromide and 15.1 g of sodium chloride dissolved in 300 cc of distilled water were added thereto within 20 minutes and blended at a temperature of 60° C. The resulting emulsion thus obtained was observed with an electron microscope, which indicated the formation of grains each composed of a cubic crystal base having an edge length of about 0.36 μm and six fairly roundish trapezoidalpiped projection crystals each growing from each of the six (100) faces of the cubic crystal base as a bottom surface having a height of about 0.08 to 0.16 μm, the projection crystals being more roundish than those of the grains in Emulsion K. (This was called "Emulsion L", which is an emulsion of the present invention.)

EXAMPLE 9

In the same manner as the preparation of Emulsion K and Emulsion L in Example 8, except that 0.25 g of the above-mentioned Compound (I-3) was used and added during the growth of the grains in place of Compound (I-2), almost the same results were obtained.

EXAMPLE 10

In the same manner as the preparation of Emulsion K and Emulsion L in Example 8, except that 0.16 g of the above-mentioned Compound (I-4) was used and added during the growth of the grains in place of Compound (I-2), almost the same emulsion grains were obtained.

EXAMPLE 11

In the same manner as the preparation of Emulsion K and Emulsion L in Example 8, except that 0.18 g of the above-mentioned Compound (I-7) was used and added during the growth of the grains in place of Compound (I-2), almost the same emulsion grains were obtained.

EXAMPLE 12

In the same manner as the preparation of Emulsion K and Emulsion L in Example 8, except that 0.21 g of the above-mentioned Compound (II-1) was used and added during the growth of the grains in place of Compound (I-2), almost the same emulsion grains were obtained.

EXAMPLE 13

In the same manner as the preparation of Emulsion K and Emulsion L in Example 8, except that 0.21 g of the above-mentioned Compound (II-2) was used and added during the growth of the grains in place of Compound (I-2), almost the same emulsion grains were obtained.

EXAMPLE 14

In the same manner as the preparation of Emulsion K and Emulsion L in Example 8, except that 0.18 g of the above-mentioned Compound (II-5) was used and added during the growth of the grains in place of Compound (I-2), almost the same emulsion grains were obtained.

EXAMPLE 15

30 g of lime-treated gelatin was added to 1,000 cc of distilled water and dissolved at 40° C., and the resulting solution was adjusted to pH 4.0 with sulfuric acid, and 6.5 g of sodium chloride and 0.02 g of N,N'-dimethylethylenethiourea were added thereto and the temperature was elevated to 52.5° C. A solution of 62.5 g of silver nitrate dissolved in 750 cc of distilled water and a solution of 21.5 g of sodium chloride dissolved in 500 cc of distilled water were added to the previous solution within 40 minutes and blended while maintaining the temperature at 52.5° C. The emulsion obtained was observed with an electron microscope, which indicated that the emulsion contained cubic crystals each having an edge length of about 0.36 μm. To this emulsion was added a solution of 0.8 g of guanine dissolved in distilled water together with 0.48 g of sodium hydroxide, and then a solution of 18.0 g of silver nitrate dissolved in 145 cc of distilled water and a solution of 6.2 g of sodium chloride dissolved in 90 cc of distilled water were added thereto within 6 minutes and blended at a temperature of 52.5° C. The resulting emulsion thus obtained was observed with an electron microscope, which indicated the formation of grains each composed of a cubic crystal base having an edge length of about 0.36 μm and six pyramid-shaped projection crystals each growing almost from the center of each (100) face of the cubic crystal base as a bottom surface of a square of about 0.24 μm×0.24 μm having a height of about 0.12 μm, the projection crystal having an outer surface of definite (110) crystal faces. (This was called "Emulsion M", which is an emulsion of the present invention.)

In the same manner as the preparation of Emulsion M, except the absence of the sulfuric acid in the initial stage used for adjusting the pH value to 4.0, other grains were formed. In the procedure, the same cubic grains as those in Emulsion M, each having a size of about 0.36 μm, were formed in the stage of the completion of the first addition of the silver nitrate and the sodium chloride, while the finally formed grains were different from those of Emulsion M and contained fine cubic grains and needle-like grains which were newly formed by additional nucleation apart from the original cubic grains. (The emulsion was called "Emulsion (m-1)", which falls outside the scope of the present invention.)

In the same manner as the preparation of Emulsion M, except that the pH of the emulsion was again adjusted to 4.0 with sulfuric acid after the addition of the guanine and then the second addition of the silver nitrate and the sodium chloride was effected for the growth of the grains, other grains were formed. After the procedure, the finally formed grains were different from those of Emulsion M and were cubic grains each having an edge length of about 0.4 μm, and the corners and edges of each grain were somewhat roundish. (This emulsion was called "Emulsion (m-2)", which falls outside the scope of the present invention.)

EXAMPLE 16

30 g of lime-treated gelatin was added to 1,000 cc of distilled water and dissolved at 40° C., and the resulting solution was adjusted to pH 4.0 with sulfuric acid, and 6.5 g of sodium chloride and 0.02 g of N,N'-dimethylethylenethiourea were added thereto and the temperature was elevated to 70° C. A solution of 62.5 g of silver nitrate dissolved in 750 cc of distilled water and a solution of 30.6 g of potassium bromide and 6.5 g of sodium chloride dissolved in 500 cc of distilled water were added to the previous solution within 40 minutes and blended while maintaining the temperature at 70° C. The emulsion thus obtained was observed with an electron microscope, which indicated that the emulsion contained cubic grains each having an edge length of about 0.36 μm. To this emulsion was added a solution of 0.8 g of guanine dissolved in distilled water together with 0.48 g of sodium hydroxide, and then a solution of 18.0 g of silver nitrate dissolved in 145 cc of distilled water and a solution of 8.7 g of potassium bromide and 1.9 g of sodium chloride dissolved in 90 cc of distilled water were added thereto within 6 minutes and blended at a temperature of 70° C. The resulting emulsion thus obtained was observed with an electron microscope, which indicated the formation of grains each composed of a cubic crystal base having an edge length of about 0.36 μm and six roundish pyramid-shaped projection crystals each growing from each of the six (100) faces of the cubic crystal base as a bottom surface having a height of about 0.1 μm, the bottom surface of the projection crystal being a square which is somewhat smaller than the (100) face of the cubic crystal base. (This was called "Emulsion N", which is an emulsion of the present invention.)

EXAMPLE 17

30 g of lime-treated gelatin was added to 1,000 cc of distilled water and dissolved at 40° C., and the resulting solution was adjusted to pH 4.0 with sulfuric acid, and 6.5 g of sodium chloride and 0.02 g of N,N'-dimethylethylenethiourea were added thereto and the temperature was elevated to 52.5° C. A solution of 62.5 g of silver nitrate dissolved in 750 cc of distilled water and a solution of 16.2 g of sodium chloride dissolved in 500 cc of distilled water were added to the previous solution within 40 minutes and blended while maintaining the temperature at 52.5° C. To this emulsion was added a solution of 0.15 g of ribonucleic acid dissolved in distilled water, and then a solution of 62.5 g of silver nitrate dissolved in 500 cc of distilled water and a solution of 21.5 g of sodium chloride dissolved in 300 cc of distilled water were added thereto within 20 minutes and blended at a temperature of 52.5° C. The resulting emulsion thus obtained was observed with an electron microscope, which indicated the formation of a mixture of cubic grains having an average edge length of about 0.45 μm and cubic grains having an average edge length of about 0.2 μm, some of these cubic grains having some rectangular parallelepiped projection crystal parts growing from some (100) faces of the cubic grains as a bottom surface having a thickness of about 0.04 to 0.08 μm. (This was called "Emulsion O ", which is an emulsion of the present invention.)

In the same manner as the preparation of Emulsion O, except that the amount of the sodium chloride in the aqueous halide solution to be added in the first time period was changed from 16.2 g to 17.5 g, another emulsion was prepared. This was observed with an electron microscope, which indicated the formation of grains each composed of a cubic crystal base having an edge length of about 0.36 μm and six rectangular parallelepiped production crystals each growing from each of the six (100) faces of the cubic crystal base as a bottom surface to have a thickness of about 0.06 μm, the corners of the projection crystal parts being not so roundish. (This was called "Emulsion P", which is an emulsion of the present invention.)

In the same manner as the preparation of Emulsion O, except that the amount of the sodium chloride in the aqueous halide solution to be added in the first time period was changed from 16.2 g to 27.0 g, still another emulsion was prepared. The emulsion obtained was observed with an electron microscope, which indicated the formation of grains each composed of a cubic crystal base having an edge length of about 0.36 μm and six hemispherical projection crystals each growing from each of the six (100) faces of the cubic crystal base as a bottom surface having a height of about 0.15 μm. (This was called "Emulsion Q", which is an emulsion of the present invention.)

In the same manner as the preparation of Emulsion O, except that the amount of the sodium chloride in the aqueous halide solution to be added in the first time period was changed from 16.2 g to 38.0 g, still another emulsion was prepared. The emulsion thus obtained was observed with an electron microscope, which indicated the formation of grains each composed of a cubic crystal base having an edge length of about 0.36 μm and six hemispherical projection crystals each growing from each of the six (100) faces of the cubic crystal base as a bottom surface having a height of about 0.15 μm, the projection crystal part being more roundish than that of the grains of Emulsion Q. (This was called "Emulsion R", which is an emulsion of the present invention.)

EXAMPLE 18

30 g of lime-treated gelatin was added to 1,000 cc of distilled water and dissolved at 40° C., and the resulting solution was adjusted to pH 4.0 with sulfuric acid, and 6.5 g of sodium chloride and 0.02 g of N,N'-dimethylethylenethiourea were added thereto and the temperature was elevated to 52.5° C. A solution of 62.5 g of silver nitrate dissolved in 750 cc of distilled water and a solution of 21.5 g of sodium chloride dissolved in 500 cc of distilled water were added to the previous solution within 40 minutes and blended while maintaining the temperature at 52.5° C. This emulsion was observed with an electron microscope, which indicated that the emulsion contained cubic grains each having an edge length of about 0.36 μm. To this emulsion was added 0.6 g of adenine dissolved in distilled water together with 0.24 g of sulfuric acid, and then a solution of 18.0 of silver nitrate dissolved in 145 cc of distilled water and a solution of 6.2 g of sodium chloride dissolved in 90 cc of distilled water were added thereto within 6 minutes and blended at a temperature of 52.5° C. The emulsion thus obtained was observed with an electron microscope, which indicated the formation of grains each composed of a cubic crystal base having an edge length of about 0.36 μm and six thin trapezoidalpiped projection crystals each growing from each of the six (100) faces of the cubic crystal base as a bottom surface having a thickness of about 0.06 μm. (This was called "Emulsion S", which is an emulsion of the present invention.)

In the same manner as the preparation of Emulsion S, except that the aqueous halide solution to be added in the first and second time periods were replaced by solutions containing 30.6 g of potassium bromide and 6.5 g of sodium chloride, respectively, and that the temperature during the growth of the grains was changed to 70° C., another emulsion was prepared. The emulsion obtained was observed with an electron microscope, which indicated the formation of grains each composed of a cubic crystal base having an edge length of about 0.36 μm and six roundish trapezoidalpiped projection crystals each growing from each of the six (100) faces of the cubic crystal base as a bottom surface having a height of about 0.06 μm, the projection crystal part being somewhat more roundish than that of the grains of Emulsion S. (This was called "Emulsion T", which is an emulsion of the present invention.)

EXAMPLE 19

30 g of lime-treated gelatin was added to 1,000 cc of distilled water and dissolved at 40° C., and the resulting solution was adjusted to Ph 4.0 with sulfuric acid, and 6.5 g of sodium chloride and 0.02 g of N,N'-dimethylethylenethiourea were added thereto and the temperature was elevated to 52.5° C. A solution of 62.5 g of silver nitrate dissolved in 750 cc of distilled water and a solution of 21.5 g of sodium chloride dissolved in 500 cc of distilled water were added to the previous solution within 40 minutes and blended while maintaining the temperature at 52.5° C. This emulsion was observed with an electron microscope, which indicated that the emulsion contained cubic grains each having an edge length of about 0.36 μm. To this emulsion was added a solution of 0.6 g of the above-mentioned Compound (VI-1) dissolved in distilled water together with 0.24 g of sulfuric acid, and then a solution of 18.0 g of silver nitrate dissolved in 145 cc of distilled water and a solution of 6.2 g of sodium chloride dissolved in 90 cc of distilled water were added thereto within 6 minutes and blended at a temperature of 52.5° C. This emulsion thus obtained was observed with an electron microscope, which indicated the formation of grains each composed of a cubic crystal base having an edge length of about 0.36 μm and six thin trapezoidalpiped projection crystals each growing from each of the six (100) faces of the cubic crystal base as a bottom surface having a thickness of about 0.06 μm. (This was called "Emulsion U", which is an emulsion of the present invention.)

In the same manner as the preparation of Emulsion U, except that the aqueous halide solutions to be added in the first and second time periods were replaced by solutions containing 30.6 g of potassium bromide and 6.5 g of sodium chloride and that the temperature during the growth of the grains was changed to 70° C., another emulsion was prepared. The emulsion obtained was observed with an electron microscope, which indicated the formation of grains each composed of a cubic crystal base having an edge length of about 0.36 μm and six roundish trapezoidalpiped projection crystals each growing from each of the six (100) faces of the cubic crystal base as a bottom surface having a height of about 0.06 μm, the projection crystal part being somewhat more roundish than that of the grains of Emulsion U. (This was called "Emulsion V", which is an emulsion of the present invention.),

EXAMPLE 20

In the same manner as the preparation of Emulsion U and Emulsion V in Example 19, except that 0.27 g of the above-mentioned Compound (IV-2) was used and added during the growth of the grains in place of Compound (IV-1), almost the same emulsion grains were obtained.

EXAMPLE 21

In the same manner as the preparation of Emulsion U and Emulsion V in Example 19, except that 0.27 g of the above-mentioned Compound (IV-4) was used and added during the growth of the grains in place of Compound (IV-1), almost the same emulsion grains were obtained.

EXAMPLE 22

In the same manner as the preparation of Emulsion U and Emulsion V in Example 19, except that 0.40 g of the above-mentioned Compound (III-1) was used and added during the growth of the grains in place of Compound (VI-1), emulsions containing almost the same grains were obtained.

EXAMPLE 23

In the same manner as the preparation of Emulsion U and Emulsion V in Example 19, except that 0.32 g of the above-mentioned Compound (III-2) was used and added during the growth of the grains in place of Compound (VI-1), emulsions containing almost the same grains were obtained.

EXAMPLE 24

In the same manner as the preparation of Emulsion U and Emulsion V in Example 19, except that the initial pH adjustment with sulfuric acid was not carried out and that 0.65 g of the above-mentioned Compound (VII-1) was used and added during the growth of the grains in place of Compound (VI-1), emulsions containing grains with almost the same shape were obtained.

EXAMPLE 25

In the same manner as the preparation of emulsions in Example 24, except that 0.65 g of the above-mentioned Compound (VII-2) was used in place of Compound (VII-1), emulsions were prepared, which contained almost the same grains.

EXAMPLE 26

30 g of lime-treated gelatin was added to 1,000 cc of distilled water and dissolved at 40° C, and the resulting solution was adjusted to pH 4.0 with sulfuric acid, and 6.5 g of sodium chloride and 0.02 g of N,N'-dimethylethylenethiourea were added thereto and the temperature was elevated to 52.5° C. A solution of 62.5 g of silver nitrate dissolved in 750 cc of distilled water and a solution of 21.5 g of sodium chloride dissolved in 500 cc of distilled water were added to the previous solution within 40 minutes and blended while maintaining the temperature at 52.5° C. This emulsion was observed with an electron microscope, which indicated that the emulsion contained cubic grains each having an edge length of about 0.36 μm. To this emulsion was added a solution of 0.30 g of the above-mentioned Compound (V-1) dissolved in methyl alcohol, and then a solution of 62.5 g of silver nitrate dissolved in 500 cc of distilled water and a solution of 21.5 g of sodium chloride dissolved in 300 cc of distilled water were added thereto within 20 minutes and blended at a temperature of 52.5° C. This emulsion thus obtained was observed with an electron microscope, which indicated the formation of grains each composed of a cubic crystal base having an edge length of about 0.36 μm and six thin rectangular parallelepiped or trapezoidalpiped projection crystals each growing from each of the six (100) faces of the cubic crystal base as a bottom surface having a thickness of about 0.04 to 0.05 μm. In addition, fine cubic grains each having an edge length of about 0.06 μm, which could not be deposited on the original cubic grains but which must have been newly nucleated and have grown by themselves, were observed to be contained in the emulsion in mixture with the projection crystal part having cubic grains. (This was called "Emulsion W", which is an emulsion of the present invention.)

In the same manner as the preparation of Emulsion W, except that the aqueous halide solutions to be added in the first and second time periods were replaced by solutions containing 30.6 g of potassium bromide and 6.5 g of sodium chloride and the temperature during the growth of the grains was changed to 70° C., another emulsion was prepared. The emulsion thus obtained was observed with an electron microscope, which indicated the formation of grains each composed of a cubic crystal base having an edge length of about 0.36 μm and six rectangular parallelepiped or trapezoidalpiped projection crystals each growing from each of the six (100) faces of the cubic crystal base as a bottom surface having a thickness of about 0.05 82 m. (This was called "Emulsion X", which is an emulsion of the present invention.)

EXAMPLE 27

In the same manner as the preparation of Emulsion W and Emulsion X in Example 26, except that 0.30 g of the above-mentioned Compound (V-3) was used and added during the growth of the grains in place of Compound (V-1), emulsions containing almost the same grains were obtained.

EXAMPLE 28

In the same manner as the preparation of Emulsion W and Emulsion X in Example 26, except that 0.34 g of the above-mentioned Compound (V-10) was used and added during the growth of the grains in place of Compound (V-1), emulsions containing grains with almost the same shape were obtained.

EXAMPLE 29

In the same manner as the preparation of Emulsion W and Emulsion X in Example 26, except that 0.16 g of the above-mentioned Compound (VI-1) was used and added during the growth of the grains in place f Compound (V-1), emulsions containing grains with almost the same shape were obtained.

EXAMPLE 30

30 g of lime-treated gelatin was added to 1,000 cc of distilled water and dissolved at 40° C., and the resulting solution was adjusted to pH 4.0 with sulfuric acid, and 6.5 g of sodium chloride and 0.02 g of N,N'-dimethylethylenethiourea were added thereto and the temperature was elevated to 57.5° C. A solution of 1.25 g of silver nitrate dissolved in 375 cc of distilled water and a solution of 4.4 g of potassium bromide and 8.6 g of sodium chloride dissolved in 250 cc of distilled water were added to the previous solution within 20 minutes and blended while maintaining the temperature at 57.5° C. To this emulsion were further added a solution of 31.25 g of silver nitrate dissolved in 375 cc of distilled water and a solution of 10.75 g of sodium chloride dissolved in 250 cc of distilled water within 10 minutes, while the temperature was kept at 52.5° C., and the emulsion continued to undergo physical ripening for 20 minutes under these conditions The emulsion thus obtained was observed with an electron microscope, which indicated that the emulsion contained cubic grains each having an edge length of about 0.38 μm. In addition, the halogen composition in the surface of the grains of the emulsion was determined using the XPS method, which established that the silver chlorobromide in the surface contained about 4.2 mol % of silver bromide. To this emulsion was added a solution of 0.15 g of ribonucleic acid (trade name: RNA-F, manufactured by Sanyo Kokusaku Pulp Co., Ltd., Japan) dissolved in distilled water, and then a solution of 62.5 g of silver nitrate dissolved in 500 cc of distilled water and a solution of 2.2 g of potassium bromide and 20.4 g of sodium chloride dissolved in 300 cc of distilled water were further added thereto within 20 minutes and blended at a temperature of 54.0° C. The emulsion thus obtained was observed with an electron microscope, which indicated the formation of grains each composed of a cubic crystal base having an edge length of about 0.38 μm and six thin rectangular parallelepiped or trapezoidalpiped projection crystals each growing from each of the six (100) faces of the cubic crystal base as a bottom surface having a thickness of about 0.04 to 0.05 μm. (This was called "Emulsion Y", which i an emulsion of the present invention.)

EXAMPLE 31

30 g of lime-treated gelatin was added to 1,000 cc of distilled water and dissolved at 40° C., and the resulting solution was adjusted to pH 4.0 with sulfuric acid, and 6.5 g of sodium chloride and 0.02 g of N,N'-dimethylethylenethiourea were added thereto and the temperature was elevated to 52.5° C. A solution of 31.25 g of silver nitrate dissolved in 375 cc of distilled water and a solution of 10.75 g of sodium chloride dissolved in 250 cc of distilled water were added to the previous solution within 20 minutes and blended while maintaining the temperature at 52.5° C. To this emulsion were further added a solution of 31.25 g of silver nitrate dissolved in 375 cc of distilled water and a solution of 4.4 g of potassium bromide and 8.6 g of sodium chloride dissolved in 250 cc of distilled water within 10 minutes, while the temperature was maintained at 57.5° C., and the emulsion continued to undergo physical ripening for 20 minutes under these conditions. The emulsion thus obtained was observed with an electron microscope, which indicated that the emulsion contained somewhat deformed cubic grains each having an edge length of about 0.38 μm. In addition, the halogen composition in the surface of the grains of the emulsion was determined using the XPS method, which established that the silver chlorobromide in the surface contained about 17.9 mol % of silver bromide. To this emulsion was added a solution of 0.15 g of ribonucleic acid dissolved in distilled water and then a solution of 62.5 g of silver nitrate dissolved in 500 cc of distilled water and a solution of 8.8 g of potassium bromide and 17.2 g of sodium chloride dissolved in 300 cc of distilled water were further added thereto within 20 minutes and blended at a temperature of 57.5° C. The emulsion thus obtained was observed with an electron microscope, which indicated the formation of grains each composed of a cubic crystal base having an edge length of about 0.38 μm and six thin rectangular parallelepiped or trapezoidalpiped projection crystals each growing from each of the six (100) faces of the cubic crystal base as a bottom surface having a thickness of about 0.05 μm. (This was called "Emulsion Z", which is an emulsion of the present invention.)

EXAMPLE 32

Plural layers as shown below were formed in order on a paper support, both surfaces of which were coated with polyethylene laminates, to obtain a multilayer color photographic paper. The coating compositions for the layers were prepared as follows:

Coating Composition for the First Layer

In a mixture of 27.2 cc of ethyl acetate and 7.9 cc of Solvent (c) were dissolved 19.1 g of Yellow Coupler (a) and 4.4 g of Color Image Stabilizer (b) and the solution thus obtained was dispersed by emulsification in 185 cc of an aqueous 10 wt % gelatin solution containing 8 cc of a 10 wt % sodium dodecylbenzenesulfonate solution. On the other hand, the blue-sensitive sensitizing dye shown below was added to a silver chlorobromide emulsion (containing 1.0 mol % silver bromide and -4 mol per 70 g/kg of silver) in an amount of $5.0\times10^{-4}$ mol per mol of silver to obtain an emulsion. The emulsified dispersion prepared above was mixed with the aforesaid silver halide emulsion and the coating solution for the first layer, having the composition as shown below, was prepared. The other coating solutions for the second to seventh layers were also prepared in the same manner as the coating solution for the first layer. As a gelatin hardener for each layer, 1-hydroxy-3,5-dichloro-s-triazine sodium salt was used. As the spectral sensitizer for the respective emulsions, the following substances were used.

Blue-Sensitive Emulsion Layer

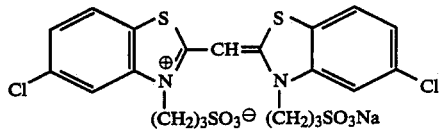

(amount added: $5.0\times10^{-4}$ mol per mol of silver halide)

Green-Sensitive Emulsion Layer

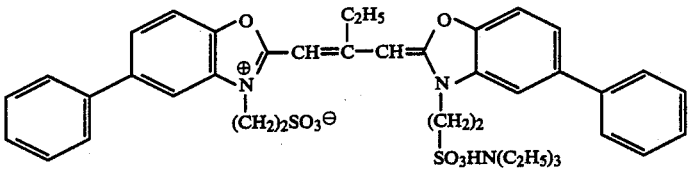

(amount added: $4.0\times10^{-4}$ mol per mol of silver halide) and

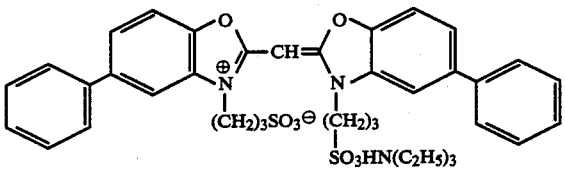

(amount added: $7.0\times10^{-5}$ mol per mol of silver halide)

Red-Sensitive Emulsion Layer (amount added: $0.9\times10^{-4}$ mol per mol of silver halide)

To the red-sensitive emulsion layer was added the following compound in an amount of $2.6\times10^{-3}$ mol per mol of silver halide.

4,4'-Bis[2,6-di(2naphthoxy)pyrimidin-4-yl-amino[stilbene-2,2'-disulfonic acid

Further, 1-(5-methylureidophenyl)-4-mercaptotetrazole was added to the blue-sensitive emulsion layer, the green-sensitive emulsion layer and the red-sensitive emulsion layer, in an amount of $8.5\times10^{-5}$ mol, $7.7\times10^{-4}$ mol and $2.5\times10^{-4}$ mol, respectively, per mol of silver halide.

The following dyes were added to the emulsion layers for prevention of irradiation.

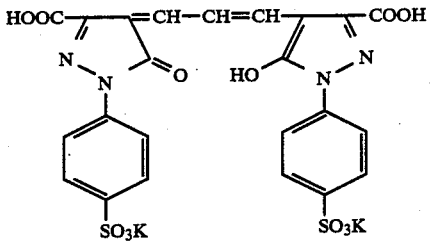

and

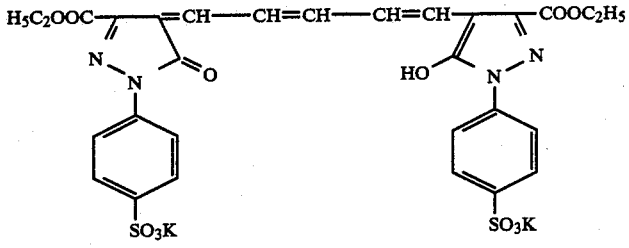

The other compounds, including couplers, used in Example 32 have the following structural formulae.

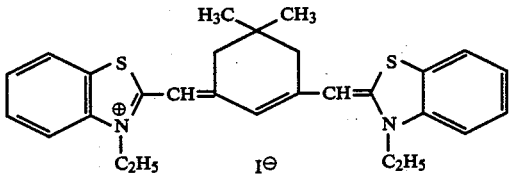

Yellow Coupler (a):

-continued
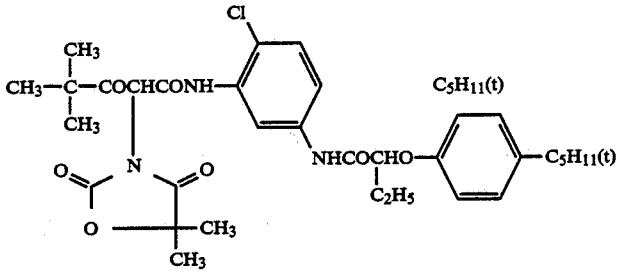
Color Image Stabilizer (b):
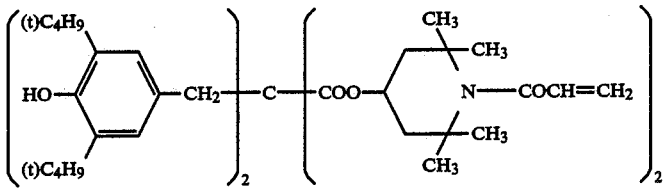
Solvent (c):
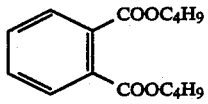
Color Mixing Preventing Agent (d):
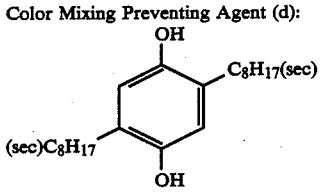
Magenta Coupler (e):
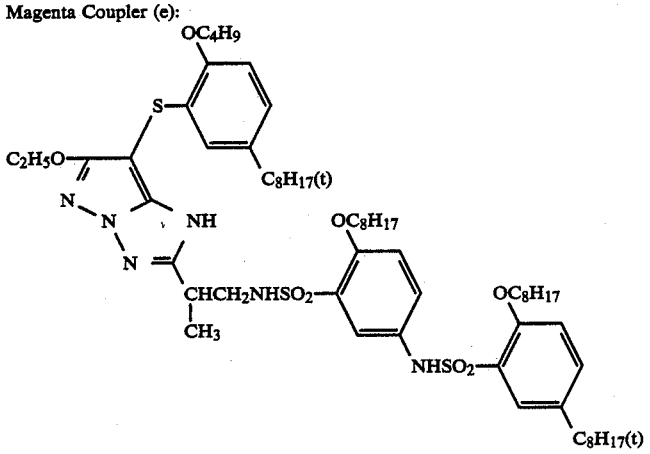
Color Image Stabilizer (f):
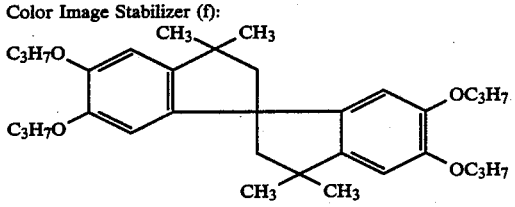
Solvent (g): 2/1 (by weight) mixture of the following compounds
$(C_8H_{17}O)_3P{=}O$ and
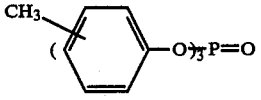

-continued

Ultraviolet Absorbent (h): 1/5/3 (by the molar ratio) mixture of the following compounds

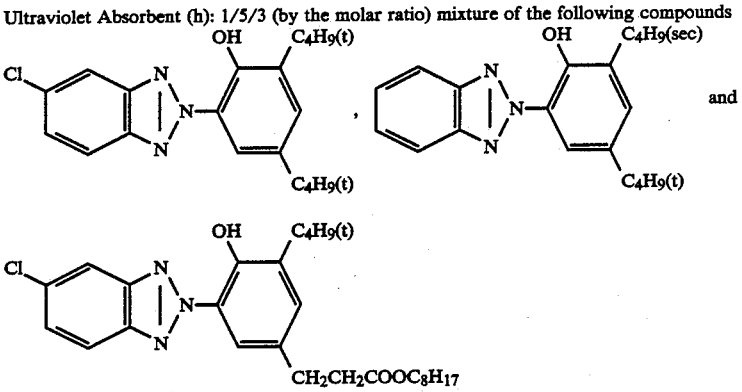

Color Mixing Preventing Agent (i):

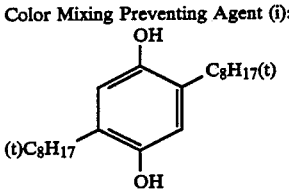

Solvent (j):

$(isoC_9H_{18}O)_3P{=}O$

Cyan Coupler (k):

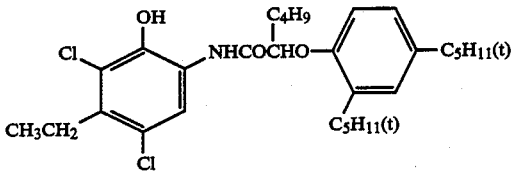

Color Image Stabilizer (l): 1/3/3 (by molar ratio) mixture of the following compounds

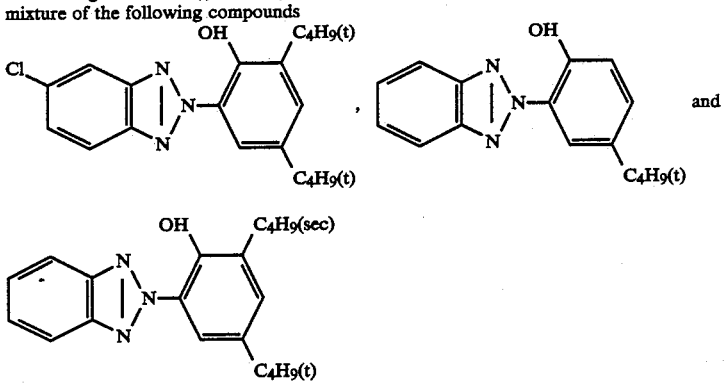

The compositions of the layers were as follows. The layers were formed on the polyethylene laminate-duplicated paper support in order, and the support contained $TiO_2$ and ultramarine in the polyethylene on the side of the support on which the first layer is deposited. The amount of the silver chlorobromide emulsion means the amount of silver in the emulsion coated.

| | |
|---|---|
| First Layer: Blue-Sensitive Emulsion Layer | |
| Silver chlorobromide emulsion (silver bromide: 1.0 mol %) | 0.27 g/m$^2$ |
| Gelatin | 1.86 g/m$^2$ |
| Yellow Coupler (a) | 0.74 g/m$^2$ |
| Color Image Stabilizer (b) | 0.17 g/m$^2$ |
| Solvent (c) | 0.31 cc/m$^2$ |

-continued

| | |
|---|---|
| Second Layer: Color Mixing Preventing Layer | |
| Gelatin | 0.99 g/m$^2$ |
| Color Mixing Preventing Agent (d) | 0.08 g/m$^2$ |
| Third Layer: Green-Sensitive Emulsion Layer | |
| Silver chlorobromide emulsion (silver bromide: 1.0 mol %) Emulsion A', Emulsion a' | 0.16 g/m$^2$ |
| Gelatin | 1.80 g/m$^2$ |
| Magenta Coupler (e) | 0.45 g/m$^2$ |
| Color Image Stabilizer (f) | 0.20 g/m$^2$ |
| Solvent (g) | 0.45 cc/m$^2$ |
| Fourth Layer: Ultraviolet Absorbing Layer | |
| Gelatin | 1.60 g/m$^2$ |
| Ultraviolet Absorbent (h) | 0.62 g/m$^2$ |
| Color Mixing Preventing Agent (i) | 0.05 g/m$^2$ |
| Solvent (j) | 0.26 cc/m$^2$ |

-continued

| | |
|---|---|
| Fifth Layer: Red-Sensitive Emulsion Layer | |
| Silver chlorobromide emulsion (silver bromide: 1.0 mol %) Emulsion A', Emulsion a' | 0.24 g/m$^2$ |
| Gelatin | 0.96 g/m$^2$ |
| Cyan Coupler (k) | 0.38 g/m$^2$ |
| Color Image Stabilizer (l) | 0.17 g/m$^2$ |
| Solvent (c) | 0.23 cc/m$^2$ |
| Sixth Layer: Ultraviolet Absorbing Layer | |
| Gelatin | 0.54 g/m$^2$ |
| Ultraviolet Absorbent (h) | 0.21 g/m$^2$ |
| Solvent (j) | 0.09 cc/m$^2$ |
| Seventh Layer: Protective Layer | |
| Gelatin | 1.33 g/m$^2$ |
| Acryl-modified copolymer of polyvinyl alcohol (modification degree of 17%) | 0.17 g/m$^2$ |

The samples of the color photographic papers thus obtained were exposed through an optical wedge and then developed in accordance with the following processing steps.

| Processing Step | Time | Temperature (°C.) |
|---|---|---|
| Color Development | 45 sec | 35 |
| Bleach-Fixing | 45 sec | 35 |
| Rinsing (four-tank cascade) | 1 min 30 sec | 30 |
| Drying | 50 sec | 80 |

The processing solutions used had the following compositions:

| | |
|---|---|
| Color Developer: | |
| Water | 800 cc |
| Diethylenetriaminepentaacetic Acid | 1.0 g |
| Sodium Sulfite | 0.2 g |
| N,N—Diethylhydroxylamine | 4.2 g |
| Potassium Bromide | 0.01 g |
| Sodium Chloride | 1.5 g |
| Triethanolamine | 8.0 g |
| Potassium Carbonate | 30 g |
| N—Ethyl-N—(β-methanesulfonamidoethyl)-3-methyl-4-aminoaniline Sulfate | 4.5 g |
| 4,4'-Diaminostilbene Brightnning Agent (Whitex 4, by Sumitomo Chemical Co., Ltd., Japan) | 2.0 g |
| Water to make | 1,000 cc |
| KOH to make pH | 10.25 |
| Bleach-Fixing Solution: | |
| Water | 400 cc |
| Ammonium Thiosulfate (70 wt %) | 150 cc |
| Sodium Sulfite | 18 g |
| Ammonium Ethyenediamintetraacetato Ferrate | 55 g |
| Ethylenediaminetetraacetic Acid | 5 g |
| Water to make | 1,000 cc |
| | pH: 6.75 |
| Rinsing Solution: | |
| 1-Hydroxyethylidene-1,1-disulfonic Acid (60 wt %) | 1.5 cc |
| Nitrilotriacetic Acid | 1.0 g |
| Ethylenediaminetetraacetic Acid | 0.5 g |
| Ethylenediamine-N,N,N',N'—tetramethylene-phosphonic Acid | 1.0 g |
| Bismuth Chloride (40 wt %) | 0.5 g |
| Magnesium Sulfate | 0.2 g |
| Zinc Sulfate | 0.3 g |
| Ammonium Alum | 0.5 g |
| 5-Chloro-2-methyl-4-isothiazolin-3-one | 30 mg |
| 2-Methyl-4-isothiazolin-3-one | 10 mg |
| 2-Octyl-4-isothiazolin-3-one | 10 mg |
| Ethylene Glycol | 1.5 g |
| Sulfanylamide | 0.1 g |
| 1,2,3-Benzotriazole | 1.0 g |

-continued

| | |
|---|---|
| Ammonium Sulfite (40 wt %) | 1.0 g |
| Aqueous Ammonia (26 wt %) | 2.6 cc |
| Polyvinyl Pyrrolidone | 1.0 g |
| 4,4'-Diaminostilbene Brightening Agent (Whitex 4) | 1.0 g |
| Water to make | 1,000 cc |
| KOH to make pH | 7.0 |

For the silver chlorobromide emulsions in the fifth and third layers, Emulsion A' and Emulsion a' were used, which were prepared as follows: After the same amount of ribonucleic acid as that used in Emulsion A was added to Emulsion A and Emulsion a, the resulting emulsions were cooled and washed in water for demineralization and then chemically sensitized with $1\times10^{-2}$ mol/mol (Ag) of potassium bromide and $6\times10^{-6}$ mol/mol (AG) of sodium thiosulfate. The thus prepared emulsions were Emulsion ' and Emulsion a', respectively. The sample containing Emulsion A' in both the fifth and third layers was called Sample (A); and the sample containing Emulsion a' in both the fifth and third layers were called Sample (a).

The results obtained are given in Table 2.

In Table 2, developability indicates the difference in the sensitivities between the case where the sample was color developed for 45 seconds and that where the sample was color developed for 60 seconds, which is represented by the difference in the respective logarithms of the exposure amounts. The other have the same meanings as those given in Example 5.

TABLE 2

| Sample | Layer | Sensitivity | Developability | Gradation | Fog | Remarks |
|---|---|---|---|---|---|---|
| (A) | Red-Sensitive Layer | 100 | 0.02 | 0.88 | 0.14 | Invention |
| (A) | Green-Sensitive Layer | 100 | 0.04 | 0.93 | 0.16 | Invention |
| (a) | Red-Sensitive Layer | 83 | 0.06 | 1.32 | 0.18 | Comparison |
| (a) | Green-Sensitive Layer | 91 | 0.11 | 1.42 | 0.20 | Comparison |

From the results of Table 2, it can be seen that Sample (A) of the present invention is better than Sample (a) in developability and gradation and the former has less fog and higher sensitivity than the latter.

EXAMPLE 33

In the same manner as the preparation of Emulsion A in Example 1, except that 0.45 g of ribonucleic acid (trade name: RNA-F, manufactured by Sanyo Kokusaku Pulp Co., Ltd., Japan) was used and added during the growth of the grains in place of 0.15 g of the ribonucleic acid. The emulsion thus obtained was observed with an electron microscope, which indicated that the projection part of the obtained crystal was fairly roundish as compared with Emulsion A. (This was called "Emulsion A-1", which is an emulsion of the present invention.)

EXAMPLE 34

In the same manner as the preparation of Emulsion B in Example 2, except that the addition period of the ribonucleic acid which was added during the growth of the grains was changed between in the course of the first addition of silver nitrate and sodium chloride and 8 minutes and 30 seconds after the second addition of silver nitrate and sodium chloride. The emulsion thus obtained was observed with an electron microscope, which indicated that the formation of grains each composed of a cubic crystal base having an edge length of about 0.40 μm and six thin trapezoildalpiped projection crystals each growing from each of the six (100) faces of the cubic crystal base as a bottom surface having a thickness of about 0.02 μm to 0.03 μm. (This was called "Emulsion B-1", which is an emulsion of the present invention.)

EXAMPLE 35

In the same manner as the preparation of Emulsion C in Example 3, except that 0.45 g of ribonucleic acid (trade name: RNA-F, manufactured by Sanyo Kokusaku Pulp Co., Ltd., Japan) was used and added during the growth of the grains in place of 0.15 g of the ribonucleic acid. The emulsion thus obtained was observed with an electron microscope, which indicated that the thickness of the projection crystal was increased as compared with Emulsion C and the projection crystal obtained was closely akin to Emulsion A rather than Emulsion C. (This was called Emulsion C-1, which is an emulsion of the present invention.)

While the invention has been described in detail and with reference to specific embodiments thereof, it will be apparent to one skilled in the art that various changes and modifications can be made therein without departing from the spirit and scope thereof.

What is claimed is:

1. A silver halide emulsion comprising silver halide crystal grains containing silver chloride, wherein on at least one of six (100) surfaces of a cubic or rectangular parallelepiped host crystals surrounded mainly by (100) surfaces and containing 30 mol % or more silver chloride at said (100) surfaces of the host crystal, a guest silver halide crystal containing substantially the same halide composition as said (100) surfaces is formed in projection so that the bottom surface of the guest crystal is a part of said (100) surfaces of the host crystal and so that the intersections of the surfaces of the host crystal and the guest crystal form re-entrant angle parallel to the edges of the (100) surfaces of the host crystal.

2. A silver halide emulsion as claimed in claim 1, which contains silver chloride in an amount of at least 30 mol % of the total silver halide content therein.

3. A silver halide emulsion as claimed in claim 1, which contains silver chloride in an amount of at least 50 mol % of the total silver halide content therein.

4. A silver halide emulsion as claimed in claim 1, wherein the projection crystal part on the surface of the silver halide crystal grains is formed in the presence of a crystal habit-controlling agent during the growth of said silver halide crystal grains.

5. A silver halide emulsion as claimed in claim 4, wherein the crystal habit-controlling agent is selected from the group consisting of a nucleic acid or decomposition products thereof, a mercaptotetrazole compound, a mercaptothiadiazole compound, a hydroxyazaindene compound, a dicarbocyanine compound and a merocyanine compound.

6. A silver halide emulsion as claimed in claim 5, wherein the crystal habit-controlling agent is selected from a deoxyribonucleic acid, a ribonucleic acid, and decomposition products thereof.

7. A silver halide emulsion as claimed in claim 5, wherein the crystal habit-controlling agent is selected from mercaptotetrazole compounds of general formula (I):

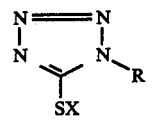

(I)

wherein R represents an alkyl group, an alkenyl group or an aryl group and X represents a hydrogen atom, an alkali metal atom, an ammonium group or a precursor thereof.

8. A silver halide emulsion as claimed in claim 5, wherein the crystal habit-controlling agent is selected from mercaptothiadiazole compounds of general formula (II):

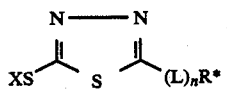

(II)

wherein R* represents a hydrogen atom, an alkyl group, an alkenyl group or an aryl group; X represents a hydrogen atom, an alkali metal atom, an ammonium group or a precursor thereof; L represents a divalent linking group; and n represents 0 or 1.

9. A silver halide emulsion as claimed in claim 5, wherein the crystal habit-controlling agent is selected from compounds of general formula (III):

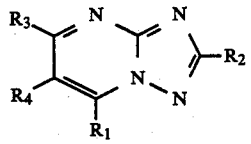

(III)

wherein $R_1$, $R_2$, $R_3$ and $R_4$ may be the same or different and each represents a hydroxyl group, an alkyl group, an alkenyl group, an aryl group, a cyano group, a ureido group, an amino group, a halogen atom or a hydrogen atom, provided that the compound must contain at least one hydroxyl group; or $R_3$ and $R_4$ may combine to form a 5-membered or 6-membered, saturated or unsaturated, carbon-containing ring.

10. A silver halide emulsion as claimed in claim 5, wherein the crystal habit-controlling agent is selected from compounds of general formula (IV):

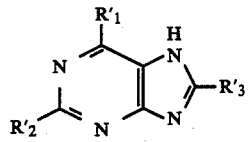

(IV)

wherein $R_1'$, $R_2'$ and $R_3'$ may be the same or different and each represents a hydroxyl group, an alkyl group, an alkenyl group, an aryl group, a cyano group, a ureido group, an amino group, a halogen atom or a hydrogen atom, provided that the compound must contain at least one hydroxyl group.

11. A silver halide emulsion as claimed in claim 5, wherein the crystal habit-controlling agent is selected from dicarbocyanine compounds of general formula (V):

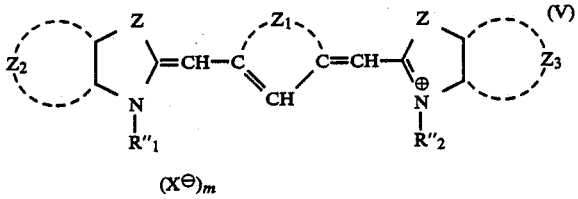

(V)

wherein $R''_1$ and $R''_2$ each represents an alkyl group, a substituted alkyl group, an aryl group or a substituted aryl group; Z represents a sulfur atom, an oxygen atom or a selenium atom; $Z_1$ represents a hydrocarbon atomic group necessary for forming a 6-membered ring; $Z_2$ and $Z_3$ each represents an atomic group necessary for forming a benzene ring or a naphthalene ring condensed with a thiazole ring, an oxazole ring or a selenazole ring; $X^{\ominus}$ represents an anion; and m represents 0 or 1.

12. A silver halide emulsion as claimed in claim 5, wherein the crystal habit-controlling agent is selected from merocyanine compounds of general formula (VI):

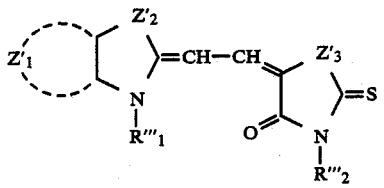

(VI)

wherein $R''_1$ and $R''_2$ each represents an alkyl group, a substituted alkyl group, an aryl group or a substituted aryl group; $Z'_2$ and $Z'_3$ each represents a sulfur atom, an oxygen atom, a selenium atom or a nitrogen atom, and when $Z'_2$ or $Z'_3$ represents a nitrogen atom, an alkyl group, a substituted alkyl group, an aryl group or a substituted aryl group is bonded to the nitrogen atom; $Z'_1$ represents an atomic group necessary for forming a benzene ring or a naphthalene ring condensed with a thiazole ring, an oxazole ring, a selenazole ring or an imidazole ring or $Z'_1$ represents a bond or a hydrogen atom so that the $Z'_2$-containing 5-membered ring in the formula may form a thiazole ring, an oxazole ring, a selenazole ring, an imidazole ring, a thiazoline ring, an oxazoline ring, a selenazoline ring or an imidazoline ring.

13. A silver halide emulsion as claimed in claim 5, wherein the crystal habit-controlling agent is selected from compounds of general formula (VII):

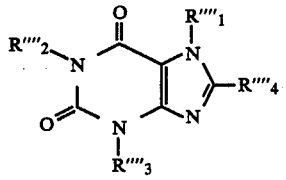

(VII)

wherein $R''''_1$, $R''''_2$, $R''''_3$ and $R''''_4$ may be the same or different and each represents an alkyl group, an alkenyl group, an aryl group, a cyano group, a ureido group, an amino group, a halogen atom or a hydrogen atom.

14. A silver halide photographic material having at least one light-sensitive layer which contains the silver halide emulsion as claimed in claim 1.

15. A silver halide photographic material as claimed in claim 14, which contains a coupler capable of forming a dye by a coupling reaction with an oxidation product of an aromatic primary amine color developing agent in the light-sensitive layer.

* * * * *